US012687120B1

(12) United States Patent
O'Donnell et al.

(10) Patent No.: US 12,687,120 B1
(45) Date of Patent: Jul. 21, 2026

(54) THERMAL ENERGY STORAGE SYSTEMS WITH AN ENERGY EMITTING SURFACE

(71) Applicant: Rondo Energy, Inc., Alameda, CA (US)

(72) Inventors: John Setel O'Donnell, Oakland, CA (US); Yusef Desjardins Ferhani, Menlo Park, CA (US)

(73) Assignee: Rondo Energy, Inc., Alameda, CA (US)

( * ) Notice: Subject to any disclaimer, the term of this patent is extended or adjusted under 35 U.S.C. 154(b) by 0 days.

(21) Appl. No.: 19/069,061

(22) Filed: Mar. 3, 2025

Related U.S. Application Data

(60) Provisional application No. 63/560,507, filed on Mar. 1, 2024.

(51) Int. Cl.

| | |
|---|---|
| ***F01K 3/14*** | (2006.01) |
| ***F01K 3/18*** | (2006.01) |
| ***F01K 23/08*** | (2006.01) |

(52) U.S. Cl.
CPC ..... *F01K 3/14* (2013.01); *F01K 3/186* (2013.01); *F01K 23/08* (2013.01)

(58) Field of Classification Search
None
See application file for complete search history.

(56) References Cited

U.S. PATENT DOCUMENTS

| | | | |
|---|---|---|---|
| 1,089,951 | A | 3/1914 | Otto |
| 1,700,542 | A | 1/1929 | O'Donnell |
| 1,700,642 | A | 1/1929 | Meindersma |
| 2,833,532 | A | 5/1958 | Ries |
| 3,103,917 | A | 9/1963 | Bauer et al. |
| 3,381,113 | A | 4/1968 | Jacques et al. |
| 3,549,136 | A | 12/1970 | Baab et al. |
| 3,788,066 | A | 1/1974 | Nebgen |
| 3,908,381 | A | 9/1975 | Barber et al. |
| 3,995,434 | A | 12/1976 | Kato et al. |
| 4,011,430 | A | 3/1977 | Witkin et al. |
| 4,028,884 | A | 6/1977 | Martz et al. |
| 4,110,987 | A | 9/1978 | Cahn et al. |

(Continued)

FOREIGN PATENT DOCUMENTS

| | | | |
|---|---|---|---|
| AU | 2012292959 | B2 | 2/2016 |
| AU | 2016100264 | A4 | 4/2016 |

(Continued)

OTHER PUBLICATIONS

International Search Report and Written Opinion mailed on Aug. 29, 2025 for International Application No. PCT/ US2025/030863, 19 pages.

(Continued)

*Primary Examiner* — Shafiq Mian
(74) *Attorney, Agent, or Firm* — Procopio, Cory, Hargreaves & Savitch LLP; Matt Rainey

(57) ABSTRACT

An energy storage system (TES) converts variable renewable electricity (VRE) to continuous heat at over 900° C. Intermittent electrical energy heats a solid medium. Heat from the solid medium is delivered continuously on demand. Heat may be delivered by radiation from one or more emitting surfaces of the solid medium. The delivered heat may be used for processes including power generation, cogeneration, or an industrial process.

29 Claims, 24 Drawing Sheets

(56) References Cited

U.S. PATENT DOCUMENTS 4,123,909 A 11/1978 French
4,124,061 A 11/1978 Mitchell et al.
4,127,161 A 11/1978 Clyne et al.
4,146,057 A 3/1979 Friedman et al.
4,172,442 A 10/1979 Boblitz
4,200,783 A 4/1980 Ehret
4,222,365 A 9/1980 Thomson
4,234,782 A 11/1980 Barabas et al.
4,237,692 A 12/1980 Ahrens et al.
4,312,324 A 1/1982 Ross et al.
4,329,592 A 5/1982 Wagner et al.
4,397,962 A 8/1983 Schockmel
4,438,630 A 3/1984 Rowe
4,524,756 A 6/1985 Laverman
4,651,810 A 3/1987 Triessnig
4,809,523 A 3/1989 Vandenberg
4,874,034 A 10/1989 Hirata et al.
4,979,374 A 12/1990 Kabakov et al.
5,154,224 A 10/1992 Yasui et al.
5,286,472 A 2/1994 Fulford
5,384,489 A 1/1995 Bellac
5,416,416 A 5/1995 Bisher
5,419,388 A 5/1995 Hickel et al.
5,553,604 A 9/1996 Frei
5,634,313 A 6/1997 Mögling
5,924,477 A 7/1999 Doru
6,274,855 B1 8/2001 Tatematsu et al.
6,302,188 B1 10/2001 Ruhl et al.
6,322,356 B1 11/2001 Gupta et al.
6,631,754 B1 10/2003 Bremont et al.
7,213,409 B1 5/2007 Nuckols
7,693,402 B2 4/2010 Hudson et al.
7,800,024 B2 9/2010 Duguay et al.
8,226,917 B2 7/2012 Fan et al.
8,544,275 B2 10/2013 Shinnar
8,701,773 B2 4/2014 O'Donnell et al.
8,960,182 B2 2/2015 Magaldi et al.
9,370,044 B2 6/2016 McDonald
9,512,826 B2 12/2016 Rodionov et al.
9,556,708 B2 1/2017 Schneider et al.
9,642,188 B2 5/2017 Bach et al.
9,816,490 B2 11/2017 Conlon
9,816,491 B2 11/2017 Perry
9,948,140 B2 4/2018 Pietsch et al.
9,989,271 B1 6/2018 Becker
10,113,535 B2 10/2018 Conlon
10,221,726 B2 3/2019 Balczunas et al.
10,334,881 B1 7/2019 Conley et al.
10,345,050 B2 7/2019 Pietsch et al.
10,527,026 B2 1/2020 Muir et al.
10,767,935 B2 9/2020 Bergan et al.
10,775,111 B2 9/2020 Kerth
10,876,521 B2 12/2020 Anderson et al.
11,038,431 B2 6/2021 Ness et al.
11,352,951 B2 6/2022 Apte et al.
11,459,944 B2 10/2022 Robinson
11,480,160 B1 10/2022 Mokheimer et al.
11,603,776 B2 3/2023 O'Donnell et al.
11,809,153 B1 11/2023 Kearns et al.
11,994,347 B2 5/2024 Ponec et al.
2003/0101728 A1 6/2003 Wakana et al.
2003/0113255 A1 6/2003 Harlan
2004/0062063 A1 4/2004 Siri
2004/0099261 A1 5/2004 Litwin
2004/0148922 A1* 8/2004 Pinkerton ..... F02C 7/08 60/670
2004/0182081 A1 9/2004 Sim et al.
2004/0211215 A1 10/2004 Maier-Laxhuber et al.
2005/0095500 A1 5/2005 Corless et al.
2005/0126172 A1 6/2005 Hudson et al.
2006/0107664 A1 5/2006 Hudson et al.
2006/0165908 A1* 7/2006 Fey ..... B05D 1/286 427/532
2006/0174622 A1 8/2006 Skowronski
2006/0179840 A1 8/2006 Murphy et al.
2006/0211777 A1 9/2006 Severinsky
2006/0231466 A1 10/2006 Nuber
2006/0266039 A1 11/2006 Skowronski et al.
2006/0277910 A1 12/2006 Hoetger
2007/0209365 A1 9/2007 Hamer et al.
2007/0220889 A1 9/2007 Nayef et al.
2008/0000231 A1 1/2008 Litwin et al.
2008/0066736 A1 3/2008 Zhu
2008/0127647 A1 6/2008 Leitner
2008/0134681 A1 6/2008 Nayef et al.
2008/0279761 A1 11/2008 Kimura et al.
2008/0318143 A1 12/2008 Nakayama et al.
2009/0038668 A1 2/2009 Plaisted
2009/0090109 A1 4/2009 Mills et al.
2009/0117633 A1 5/2009 Bradley et al.
2009/0125152 A1 5/2009 Skowronski et al.
2009/0208402 A1 8/2009 Rossi
2009/0320828 A1 12/2009 Koketsu et al.
2010/0005966 A1 1/2010 Wibberley
2010/0101462 A1 4/2010 Hayashi et al.
2010/0132391 A1 6/2010 Barot
2010/0178156 A1 7/2010 Rivas Cortes et al.
2010/0195357 A1 8/2010 Fornage et al.
2010/0229523 A1 9/2010 Holt et al.
2010/0251711 A1 10/2010 Howes et al.
2010/0295306 A1 11/2010 Ridnik et al.
2011/0083443 A1 4/2011 Jockenhoevel et al.
2011/0226440 A1 9/2011 Bissell et al.
2011/0247335 A1 10/2011 Schmid et al.
2011/0277469 A1 11/2011 Brenmiller et al.
2011/0286902 A1 11/2011 Fan et al.
2011/0289924 A1 12/2011 Pietsch
2012/0067047 A1 3/2012 Peterson et al.
2012/0097151 A1 4/2012 Matsuno et al.
2012/0102950 A1 5/2012 Turchi
2012/0131898 A1 5/2012 Mokheimer et al.
2012/0151926 A1 6/2012 Labbe
2012/0167559 A1 7/2012 Havel
2012/0167567 A1 7/2012 Kleine
2012/0227926 A1 9/2012 Field et al.
2012/0241677 A1 9/2012 Perkins et al.
2012/0255309 A1 10/2012 Venetos et al.
2012/0286524 A1 11/2012 Bronicki
2013/0025817 A1 1/2013 Callaghan
2013/0047976 A1 2/2013 Kaftori
2013/0056170 A1 3/2013 Klemencic
2013/0081394 A1 4/2013 Perry
2013/0081395 A1 4/2013 Frey et al.
2013/0118169 A1 5/2013 Milam et al.
2013/0175006 A1 7/2013 Robinson et al.
2013/0227947 A1 9/2013 Bronicki et al.
2014/0004469 A1 1/2014 Recourt et al.
2014/0008033 A1 1/2014 Howes et al.
2014/0053554 A1 2/2014 Tartibi et al.
2014/0074314 A1 3/2014 Niknafs et al.
2014/0102073 A1 4/2014 Pang et al.
2014/0110080 A1 4/2014 Bergan
2014/0116069 A1 5/2014 Peterson et al.
2014/0190469 A1 7/2014 O'Donnell et al.
2014/0216717 A1 8/2014 O'Donnell et al.
2014/0223906 A1 8/2014 Gee et al.
2014/0224469 A1 8/2014 Mirmobin et al.
2014/0366536 A1 12/2014 Muren
2015/0007577 A1 1/2015 Li et al.
2015/0027122 A1 1/2015 Brunhuber et al.
2015/0033740 A1 2/2015 Anderson et al.
2015/0053266 A1 2/2015 Chen et al.
2015/0134120 A1 5/2015 Sun et al.
2015/0143806 A1 5/2015 Friesth
2015/0143811 A1 5/2015 Pang et al.
2015/0167489 A1 6/2015 Heiligenstein et al.
2015/0176920 A1 6/2015 Vendeirinho
2015/0224850 A1 8/2015 Bank et al.
2015/0267566 A1 9/2015 Vamvas
2015/0276234 A1 10/2015 Muro et al.
2015/0295508 A1 10/2015 Conry
2015/0354545 A1 12/2015 Conlon
2015/0369125 A1 12/2015 Reiter et al.
2016/0130709 A1 5/2016 Hong et al.

(56) References Cited

U.S. PATENT DOCUMENTS

| | | | |
|---|---|---|---|
| 2016/0146110 | A1 | 5/2016 | Hackstein et al. |
| 2016/0164451 | A1 | 6/2016 | Lenert et al. |
| 2016/0208657 | A1 | 7/2016 | Brückner et al. |
| 2016/0214910 | A1 | 7/2016 | King |
| 2016/0281607 | A1 | 9/2016 | Asati et al. |
| 2016/0301093 | A1 | 10/2016 | Bosmann et al. |
| 2016/0355932 | A1 | 12/2016 | Reytier et al. |
| 2017/0051949 | A1 | 2/2017 | Uselton |
| 2017/0058768 | A1 | 3/2017 | Bergins et al. |
| 2017/0093163 | A1 | 3/2017 | Johnson et al. |
| 2017/0204741 | A1 | 7/2017 | Hogen et al. |
| 2017/0241649 | A1 | 8/2017 | Cave |
| 2017/0241669 | A1 | 8/2017 | von Behrens |
| 2017/0283713 | A1 | 10/2017 | Stephens et al. |
| 2017/0362090 | A1 | 12/2017 | Melsert et al. |
| 2017/0362724 | A1 | 12/2017 | Planque et al. |
| 2018/0003445 | A1 | 1/2018 | Bergan et al. |
| 2018/0028967 | A1 | 2/2018 | Balfe et al. |
| 2018/0038352 | A1 | 2/2018 | Conlon |
| 2018/0073777 | A1 | 3/2018 | O'Donnell et al. |
| 2018/0083449 | A1 | 3/2018 | Green |
| 2018/0106165 | A1 | 4/2018 | Barmeier |
| 2018/0106739 | A1 | 4/2018 | Esmaili et al. |
| 2018/0163574 | A1 | 6/2018 | Bailey et al. |
| 2018/0179955 | A1 | 6/2018 | Apte et al. |
| 2018/0207557 | A1 | 7/2018 | Nellis |
| 2018/0216010 | A1 | 8/2018 | Hong |
| 2018/0231316 | A1 | 8/2018 | Watremetz et al. |
| 2018/0238563 | A1 | 8/2018 | Stepa et al. |
| 2018/0245485 | A1 | 8/2018 | Conlon |
| 2018/0278439 | A1 | 9/2018 | Cox |
| 2018/0292097 | A1 | 10/2018 | Specter |
| 2018/0347406 | A1 | 12/2018 | Friesth |
| 2018/0372337 | A1 | 12/2018 | Walker |
| 2018/0372420 | A1 | 12/2018 | Ahadi et al. |
| 2019/0003308 | A1 | 1/2019 | Laughlin |
| 2019/0043624 | A1 | 2/2019 | Fork et al. |
| 2019/0045617 | A1 | 2/2019 | Fork et al. |
| 2019/0096535 | A1 | 3/2019 | Olshansky et al. |
| 2019/0140477 | A1 | 5/2019 | Yang et al. |
| 2019/0162482 | A1 | 5/2019 | Kerth |
| 2019/0170435 | A1 | 6/2019 | Anguiano et al. |
| 2019/0170436 | A1 | 6/2019 | De et al. |
| 2019/0186786 | A1 | 6/2019 | Neiser |
| 2019/0226462 | A1 | 7/2019 | Conlon |
| 2019/0245224 | A1 | 8/2019 | Lacroix et al. |
| 2019/0331098 | A1 | 10/2019 | von Behrens et al. |
| 2019/0359894 | A1 | 11/2019 | Heidel et al. |
| 2020/0095984 | A1 | 3/2020 | Karni et al. |
| 2020/0124356 | A1 | 4/2020 | Ma et al. |
| 2020/0136202 | A1 | 4/2020 | Trawick |
| 2020/0172815 | A1 | 6/2020 | Stephens et al. |
| 2020/0217518 | A1 | 7/2020 | Field et al. |
| 2020/0232345 | A1 | 7/2020 | Zwinkels |
| 2020/0251909 | A1 | 8/2020 | Falk et al. |
| 2020/0332201 | A1 | 10/2020 | Koseoglu et al. |
| 2020/0346165 | A1 | 11/2020 | Lu et al. |
| 2020/0358112 | A1 | 11/2020 | Chatroux et al. |
| 2020/0378599 | A1 | 12/2020 | Risseeuw et al. |
| 2020/0386447 | A1 | 12/2020 | Wang |
| 2021/0053689 | A1 | 2/2021 | Lynn et al. |
| 2021/0094834 | A1 | 4/2021 | Chen et al. |
| 2021/0143446 | A1 | 5/2021 | Ponec et al. |
| 2021/0172685 | A1 | 6/2021 | Bergan et al. |
| 2021/0190044 | A1 | 6/2021 | Anderson et al. |
| 2021/0207527 | A1 | 7/2021 | Robinson |
| 2021/0211066 | A1 | 7/2021 | Vavilpalli et al. |
| 2021/0325069 | A1 | 10/2021 | Cotton et al. |
| 2021/0328544 | A1 | 10/2021 | Johnson et al. |
| 2021/0389056 | A1 | 12/2021 | Calvet et al. |
| 2022/0049615 | A1 | 2/2022 | Truong |
| 2022/0049631 | A1 | 2/2022 | Deng |
| 2022/0060142 | A1 | 2/2022 | Akhavan-Tafti |
| 2022/0085603 | A1 | 3/2022 | McNamara et al. |
| 2022/0090827 | A1 | 3/2022 | Magaldi et al. |
| 2022/0132633 | A1 | 4/2022 | Forsberg et al. |
| 2022/0146205 | A1 | 5/2022 | Eronen et al. |
| 2022/0170386 | A1* | 6/2022 | O'Donnell ..... F01K 3/02 |
| 2022/0228271 | A1 | 7/2022 | Ashok et al. |
| 2022/0228772 | A1 | 7/2022 | Murata et al. |
| 2022/0268179 | A1 | 8/2022 | O'Donnell et al. |
| 2022/0290929 | A1 | 9/2022 | Doerbeck |
| 2022/0307386 | A1 | 9/2022 | Savic et al. |
| 2022/0403759 | A1 | 12/2022 | Stapp, III et al. |
| 2022/0412228 | A1 | 12/2022 | Ponec et al. |
| 2023/0052951 | A1 | 2/2023 | Migl et al. |
| 2023/0086892 | A1* | 3/2023 | Robertson ..... F28D 20/0056 219/201 |
| 2023/0216297 | A1 | 7/2023 | Peri et al. |
| 2023/0287808 | A1 | 9/2023 | Conlon |
| 2023/0407186 | A1 | 12/2023 | Sundaram et al. |
| 2024/0092646 | A1 | 3/2024 | Isobe et al. |
| 2024/0418106 | A1 | 12/2024 | Bostick et al. |
| 2025/0026986 | A1 | 1/2025 | Zellhuber et al. |

FOREIGN PATENT DOCUMENTS

| | | | |
|---|---|---|---|
| AU | 2016204109 | B2 | 5/2018 |
| CH | 703751 | A1 | 3/2012 |
| CN | 1559893 | A | 1/2005 |
| CN | 101799200 | A | 8/2010 |
| CN | 101592439 | B | 4/2011 |
| CN | 102897812 | A | 1/2013 |
| CN | 104242433 | A | 12/2014 |
| CN | 104296577 | B | 4/2016 |
| CN | 105575659 | A | 5/2016 |
| CN | 105605957 | A | 5/2016 |
| CN | 105948037 | A | 9/2016 |
| CN | 106052451 | A | 10/2016 |
| CN | 106247836 | A | 12/2016 |
| CN | 107246732 | A | 10/2017 |
| CN | 107872196 | A | 4/2018 |
| CN | 108167034 | A | 6/2018 |
| CN | 108204760 | A | 6/2018 |
| CN | 108362151 | A | 8/2018 |
| CN | 108362152 | A | 8/2018 |
| CN | 108612634 | A | 10/2018 |
| CN | 106767074 | B | 12/2018 |
| CN | 109883241 | A | 6/2019 |
| CN | 110411260 | A | 11/2019 |
| CN | 111256364 | A | 6/2020 |
| CN | 210802160 | U | 6/2020 |
| CN | 211183438 | U | 8/2020 |
| CN | 111655989 | A | 9/2020 |
| CN | 110725725 | B | 12/2020 |
| CN | 112113203 | A | 12/2020 |
| CN | 212157096 | U | 12/2020 |
| CN | 113835372 | A | 12/2021 |
| CN | 114754617 | A | 7/2022 |
| CN | 109445511 | B | 3/2024 |
| DE | 19808810 | C1 | 6/1999 |
| DE | 10029732 | A1 | 1/2002 |
| DE | 102008051384 | B3 | 2/2010 |
| DE | 102009020531 | B3 | 4/2011 |
| DE | 102012024526 | B4 | 9/2014 |
| DE | 102013212981 | A1 | 1/2015 |
| DE | 102017212684 | A1 | 1/2019 |
| DE | 102019210737 | A1 | 1/2021 |
| EP | 79247 | A1 | 5/1983 |
| EP | 794161 | B1 | 2/2003 |
| EP | 1930587 | A2 | 6/2008 |
| EP | 2372116 | A1 | 10/2011 |
| EP | 2722496 | A2 | 4/2014 |
| EP | 3081770 | A1 | 10/2016 |
| EP | 3324018 | A1 | 5/2018 |
| EP | 3486594 | A1 | 5/2019 |
| EP | 2837086 | B1 | 11/2019 |
| EP | 3245388 | B1 | 11/2019 |
| EP | 3574191 | A1 | 12/2019 |
| EP | 3725917 | A1 | 10/2020 |
| EP | 2909547 | B1 | 9/2021 |
| EP | 3642296 | B1 | 1/2022 |
| EP | 4471367 | A1 | 12/2024 |
| GB | 2109026 | A | 5/1983 |

(56) References Cited

FOREIGN PATENT DOCUMENTS

| | | | |
|---|---|---|---|
| GB | 2152652 | A | 8/1985 |
| GB | 2477801 | A | 8/2011 |
| IL | 284451 | | 8/2021 |
| JP | S63-119874 | U | 8/1988 |
| JP | 2006145200 | A | 6/2006 |
| KR | 2001-0100320 | A | 11/2001 |
| KR | 102308531 | B1 | 10/2021 |
| MA | 40029 | A | 12/2015 |
| TW | 202100240 | A | 1/2021 |
| WO | WO 1980/000170 | | 2/1980 |
| WO | WO 2007/108014 | A | 9/2007 |
| WO | WO 2008/052249 | A1 | 5/2008 |
| WO | WO 2008/108870 | A1 | 9/2008 |
| WO | WO 2009/152562 | A1 | 12/2009 |
| WO | WO 2011/066039 | A1 | 6/2011 |
| WO | WO 2011/077248 | A2 | 6/2011 |
| WO | WO 2011/109514 | A1 | 9/2011 |
| WO | WO 2012/123853 | A1 | 9/2012 |
| WO | WO 2012/127178 | A1 | 9/2012 |
| WO | WO 2012/150969 | A1 | 11/2012 |
| WO | WO 2013/020176 | A1 | 2/2013 |
| WO | WO 2014/063191 | A1 | 5/2014 |
| WO | WO 2014/151843 | A2 | 9/2014 |
| WO | WO 2015/149124 | A1 | 10/2015 |
| WO | WO 2015/187423 | A2 | 12/2015 |
| WO | 2016/062425 | A1 | 4/2016 |
| WO | WO 2016/065191 | A1 | 4/2016 |
| WO | WO 2016/150455 | A1 | 9/2016 |
| WO | WO 2017/001710 | A1 | 1/2017 |
| WO | WO 2017/049320 | A1 | 3/2017 |
| WO | WO 2017/147022 | A1 | 8/2017 |
| WO | WO 2018/011363 | A1 | 1/2018 |
| WO | 2018/024409 | A1 | 2/2018 |
| WO | WO 2018/101989 | A1 | 6/2018 |
| WO | WO 2018/164647 | A | 9/2018 |
| WO | WO 2019/020562 | A1 | 1/2019 |
| WO | WO 2019/149623 | A1 | 8/2019 |
| WO | WO 2019/224538 | A1 | 11/2019 |
| WO | WO 2020/068758 | A1 | 4/2020 |
| WO | 2020/136456 | A1 | 7/2020 |
| WO | WO 2020/254001 | A1 | 12/2020 |
| WO | WO 2022/086630 | A1 | 4/2022 |
| WO | WO 2022/187903 | A1 | 9/2022 |
| WO | 2023/219610 | A1 | 11/2023 |
| ZA | 201603514 | B | 11/2018 |

OTHER PUBLICATIONS

International Search Report and Written Opinion mailed on Oct. 16, 2025 for International Application No. PCT/ US2025/036518, 13 pages.

International Search Report and Written Opinion mailed on Oct. 21, 2025 for International Application No. PCT/ US2025/026289, 19 pages.

Waste Heat Recovery: Technology and Opportunities in U.S. Industry, prepared by BCS, Incorporation, Mar. 2008, in 112 pages.

"Ethylene Production via Cracking of Ethane-Propane", Chemical Engineering, Nov. 1, 2015, Total pp. 4.

"Matching Time of Use Periods With Grid Conditions Maximizes Use of Renewable Resources", California ISO, Outcropping Way, Folsom, 2015, Total pp. 2.

"Miscibility Gap Alloys", University of Newcastle, accessed at https://miscibilitygapalloy.blogspot.com/p/how-did-it-stater-ted.html on Apr. 2, 2022.

Aaron Rimpel et al., "Liquid Air Combined Cycle (LACC) for Power and Storage", Thermal-Mechanical-Chemical Energy Storage (TMCES) Workshop, Aug. 10-11, 2021, Total pp. 6.

Alexis McKittrick, "Low Temperature & Coproduced Resources Reservoir Thermal Energy Storage (RTES) Portfolio", Geothermal Technologies Office, U.S. Department of Energy, dated Feb. 2022. Total pp. 4.

AMETEK Process Instruments, "Reduce Nox Emissions While Improving Fuel Efficiency", EDG Series Gas Analyzers, Year: 2018, in 2 pages.

Anthony Rawson et al., "Effective conductivity of Cu—Fe and Sn—Al miscibility gap alloys", International Journal of Heat and Mass Transfer, vol. 77, Oct. 2014, pp. 395-405, Total pp. 11.

Antoni Gil et al., "State of the art on high temperature thermal energy storage for power generation. Part 1-Concepts, materials and modellization", Renewable and Sustainable Energy Reviews, vol. 14, Issue 1, Jan. 2010, pp. 31-55, Total pp. 25.

Audrey Barucchi, "Calix files a new patent for zero emissions iron and steel", https://www.calix.global/co2-mitigation-focus-area/new-patent-for-zero-emissions-iron-and-steel/, Nov. 23, 2021, Total pp. 5.

Bao Truong, "Malta Pumped Heat Energy Storage System Green Heat & Power Application", Energy Storage for Manufacturing and Industrial Decarbonization Workshop, Feb. 9, 2022, Total pp. 5.

Ben Bollinger, "Malta Pumped Heat Energy Storage", Malta, Aug. 10, 2021, Total pp. 9.

Cédric Philibert, "Renewable Energy for Industry", Renewable Energy Division, International Energy Agency, Nordic Pavillion, COP23, Fidji—Bonn, Nov. 15, 2017, Total pp. 17.

Charles Forsberg et al., "Coupling heat storage to nuclear reactors for variable electricity output with baseload reactor operation", The Electricity Journal, vol. 31, Issue 3, Apr. 2018, pp. 23-31, Total pp. 9.

Charles Forsberg et al., "Variable Electricity from Base-load Nuclear Power Plants Using Stored Heat", International Congress on Advances in Nuclear Power Plants (ICAPP 2015), May 2015, Total pp. 12.

Charles Forsberg, "Heat Storage and the Electricity Grid Integrating Nuclear and Renewables into a Low-Carbon Economic Grid", Massachusetts Institute of Technology, Jan. 2017, Massachusetts, Cambridge, Total pp. 114.

Charles Forsberg, "Hybrid systems to address seasonal mismatches between electricity production and demand in nuclear renewable electrical grids", Energy Policy, vol. 62, Nov. 2013, pp. 333-341, Total pp. 9.

Charles W Forsberg et al., "Converting excess low-price electricity into high-temperature stored heat for industry and high-value electricity production", The Electricity Journal, vol. 30, Issue 6, Jul. 2017, pp. 42-52, Total pp. 11.

Christopher Fraughton, "Electro-Thermal Energy Storage General Presentation", MAN Energy Solutions, Aug. 2021, Total pp. 23.

CK-12 Foundation, "Saturated Hydrocarbon", Apr. 2, 2022, Total pp. 8.

Clifford K. Ho, "High-Temperature Thermal Storage in Moving and Fixed Particle Beds", Thermal-Mechanical-Chemical Energy Storage (TMCES) Workshop, San Antonio, TX, dated Aug. 10, 2021. Total pp. 13.

Cowper Stove an overview ScienceDirect Topics, Sep. 13, 2021, Total pp. 25.

D. Fernandes et al., "Thermal energy storage: How previous findings determine current research priorities", Energy, vol. 39, Issue 1, Mar. 2012, pp. 246-257, Total pp. 12.

Daniel C Stack et al., "Performance of firebrick resistance-heated energy storage for industrial heat applications and round-trip electricity storage", Applied Energy, vol. 242, May 15, 2019, pp. 782-796, Total pp. 15.

Daniel Christopher Stack, "Conceptual Design and Performance Characteristics of Firebrick Resistance-Heated Energy Storage for Industrial Heat Supply and Variable Electricity Production", Thesis, Master of Science in Nuclear Science and Engineering, Massachusetts Institute of Technology, Feb. 2017, Total pp. 166.

Daniel Christopher Stack, "Development of high-temperature firebrick resistance-heated energy storage (FIRES) using doped ceramic heating system", Thesis, Doctor of Philosophy in Nuclear Science and Engineering, Massachusetts Institute of Technology, Feb. 2021, Total pp. 121.

Daniel Stack et al., "Joule Hive-Replacing fire with renewable heat", Aug. 28, 2021, Total pp. 15.

David Bierman, "Clean, affordable, and reliable heat & electricity", Antora Energy, Feb. 2022, Total pp. 9.

(56) References Cited

OTHER PUBLICATIONS

David L. Chandler "MIT News: Turning desalination waste into a useful resource" MIT News Office, Feb. 13, 2019 (NFOA dated Sep. 14, 2022 in related U.S. Appl. No. 17/650,522.).
David Roberts, "Solar power's greatest challenge was discovered 10 years ago. It looks like a duck", www.vox.com, Aug. 29, 2018, Total pp. 19.
Dr. Avi Shultz, "Concentrating Solar-thermal Power and Thermal Energy Storage", U.S. Department of Energy, dated Feb. 8, 2022. Total pp. 7.
Dr. Avi Shultz, "Industrial Decarbonization:Renewable Process Heating from Concentrating Solar Thermal", U.S. Department of Energy, dated Feb. 8, 2022. Total pp. 6.
Dr. Eric L. Miller, "The Hydrogen Energy Earthshot and H2@Scale: Importance to Industrial Decarbonization", Energy StorM Panel, Feb. 8, 2022, Total pp. 9.
Dr. Gianluca Ambrosetti et al., "Cement Production", Energy Storage for Manufacturing and Industrial Decarbonization Workshop "Energy StorM", Feb. 8, 2022, Total pp. 10.
Dr. Jeffrey Goldmeer, "Power to Gas: Hydrogen for Power Generation Fuel Flexible Gas Turbines as Enablers for a Low or Reduced Carbon Energy Ecosystem," GE Power, Feb. 2019, 19 pages.
Echogen, "CO2-Based Pumped-Thermal Energy Storage Technical Overview & Status", Echogen Power System, Total pp. 20, Aug. 10-11, 2021.
Elizabeth Endler, "Energy Storage for Manufacturing Petrochemical Industry Perspective", Feb. 8, 2022, "Energy StorM" Workshop, US Department of Energy, Total pp. 14.
Elliott Group, "Materials for Hydrogen Compression", Thermo-Mechanical-Chemical Energy Storage Workshop, Elliott, Aug. 10-11, 2021, Total pp. 25.
Emiliano Bellini, "Long-duration thermal storage system based on silica sand", pv magazine International, Nov. 5, 2021, Total pp. 6.
Emiliano Bellini, "Storing wind, solar power with silica sands", pv magazine International, Sep. 1, 2021, Total pp. 10.
Fakhroleslam, Mohammad, et al., "Thermal/catalytic cracking of hydrocarbons for the production of olefins; a state-of-the-art review III: Process modeling and simulation", Elsevier, www.elsevier.com/locate/fuel, Fuel 252 (2019) 553-566, in 14 pages.
GE Energy Storage Unit RSU-4000, Modular, Scalable Energy Storage Solution for Utility-Scale Applications; www/ge.com/energystorage; 2020, 1 page.
Gregory C Staple, "California's Grid Geeks: Flattening the 'duck curve'", Jan. 25, 2017, www.greenbiz.com, Total Page Count 9.
Grid Energy Storage, U.S. Department of Energy, Dec. 2013, Total pp. 67.
Haisheng Chen et al., "Progress in electrical energy storage system: a critical review", Progress in Natural Science, vol. 19, Issue 3, Mar. 10, 2009, pp. 291-312, Total pp. 22.
Hamish Andrew Miller, et al. "Green hydrogen from anion exchange membrane water electrolysis: a review of recent developments in critical materials and operating conditions," rsc.li/sustainable-energy; DOI: 10.1039/c9se01240k; Received Dec. 14, 2019; Accepted Mar. 4, 2020; 20 pages.
Heber Sugo, "Miscibility gap alloys with inverse microstructures and high thermal conductivity for high energy density thermal storage applications", Applied Thermal Engineering, vol. 51, Issues 1-2, Mar. 2013, pp. 1345-1350, Total pp. 6.
Hélder Da Silva, "Energy Storage for Manufacturing and Industrial Decarbonization Workshop "Energy StorM"", Feb. 8, 2022, Total pp. 11.
Hitesh Bindra et al., "Sliding flow method for exergetically efficient packed bed thermal storage", Applied Thermal Engineering, vol. 64, Issues 1-2, Mar. 2014, pp. 201-208, Total pp. 8.
Hitesh Bindra et al., "Thermal analysis and exergy evaluation of packed bed thermal storage systems", Applied Thermal Engineering, vol. 52, Issue 2, Apr. 15, 2013, pp. 255-263, Total pp. 9.
"How thermal power plants can benefit from the energy transition", The Future of Energy 2019, Siemens Gamesa Renewable Energy, 10 pages.
Ilievski D, "New Two-Stage Calcination Technology", Proceedings of the 9th International Alumina Quality Workshop, Alcoa World Alumina, Technology Delivery Group, Western Australia, 2012, Total pp. 7.
Industrial Decarbonization using Electric Thermal Energy Storage (ETES), Jan. 25, 2022, Total pp. 11.
International Search Report mailed on Sep. 14, 2022 for International Application No. PCT/US2021/061041, 41 pages.
International Search Report and Written Opinion mailed on Mar. 1, 2024 for International Application No. PCT/US2023/034488, 14 pages.
International Search Report and Written Opinion mailed on May 17, 2024 for International Application No. PCT/US2023/085826, 14 pages.
International Search Report and Written Opinion mailed on Aug. 23, 2024 for International Application No. PCT/US2024/024158, 9 pages.
International Search Report and Written Opinion mailed on Dec. 20, 2024 for International Application No. PCT/US2024/024156, 29 pages.
Jaume Gasia et al., "Review on system and materials requirements for high temperature thermal energy storage. Part 1: General requirements", Renewable and Sustainable Energy Reviews, vol. 75, Aug. 2017, pp. 1320-1338, Total pp. 19.
Jay Fitzgerald, "Bioenergy and Chemical Energy Storage", Energy Storage for Manufacturing & Industrial Decarbonization Workshop, Feb. 8-9, 2022, Total pp. 6.
Jeff Moore, "Development of sCO2 Turbomachinery and its Application to Energy Storage", Thermal Mechanical-Chemical-Energy-Storage Workshop, Aug. 10-11, 2021, San Antonio, TX, Total pp. 41.
Jeff Moore, "Oxygen Storage Incorporated into the Allam OxyFuel Power Cycle", Southwest Research Institute, Total pp. 8, Aug. 10-11, 2021.
Ji, Huichao, et al., "Electricity Consumption Prediction of Solid Electric Thermal Storage with a Cyber-Physical Approach", Energies 2019, 12, 47441 doi:10.3390/en12244744, www.mdpi.com/journal/energies, published on Dec. 12, 2019, in 18 pages.
Joe Cresko, "Energy Storage for Manufacturing", Energy Storage for Manufacturing & Industrial Decarbonization Workshop, Feb. 8-9, 2022, Total pp. 11.
Joe Paladino, "Transformation of the Electric Grid", Energy StorM Workshop, Feb. 4, 2022, Total pp. 5.
Joe Stekli, "LCRI Update TMCES 2021", Low-Carbon Resources Initiative, Electric Power Research Institute, Aug. 2021, Total pp. 31.
Joshua Schmitt, "Development of an Advanced Hydrogen Energy Storage System Using Aerogel in a Cryogenic Flux Capacitor (CFC)", Southwest Research Institute, Aug. 10, 2021, Total pp. 8.
Lion Hirth, "The market value of variable renewables: the effect of solar wind power variability on their relative price", Energy Economics, vol. 38, Jul. 2013, pp. 218-236, Total pp. 19.
Lion Hirth, "The Optimal Share of Variable Renewables: How the Variability of Wind and Solar Power affects their Welfare-optimal Deployment", The Energy Journal, vol. 36, No. 1, p. 149-184, (2015). Total pp. 36.
Lori Schaefer-Weaton, "Solar & Battery Energy Solution Agri-Industrial Plastics Co.", Agri-Industrial Plastics Company, Feb. 2022, Total pp. 12.
Luisa F Cabeza, "Advances in Thermal Energy Storage Systems Methods and Applications", Woodhead Publishing Series in Energy, No. 66, 2015, Total pp. 592.
M Gajendiran et al., "Application of Solar Thermal Energy Storage for Industrial Process Heating", Advanced Materials Research, vols. 984-985, Jul. 2014, Total pp. 7.
Marc Medrano et al., "State of the art on high-temperature thermal energy storage for power generation. Part 2-Case studies", Renewable and Sustainable Energy Reviews, vol. 14, Issue 1, Jan. 2010, pp. 56-72, Total 17.

(56) References Cited

OTHER PUBLICATIONS

Mathieu Hubert, "Lecture 3: Basics of industrial glass melting furnaces", IMI-NFG Course in Processing of Glass, Spring 2015, Total pp. 75.
Mecys Palsauskas, et al.: ""Device ensuring effective usage of photovoltaics for water heating"", Electrical Engineering, 101 (1), 189-202, Apr. 8, 2019 (Apr. 8, 2019), DOI: 10.1007/s00202-019-00766-0.
Michael Pesin, "The Office of Electricity Grid Modernization R&D Portfolio", Aug. 2, 2021, Total pp. 18.
Mike Gravely, "The Role of Energy Storage in Helping California Meet the State's Future Zero Carbon Energy Goals", Energy Research and Development Division, California, 2021, Total pp. 23.
Natalie Smith et al., "Integration of Pumped Heat Energy Storage with a Fossil-Fired Power Plant", U.S. Department of Energy, 2021, Total pp. 6.
PCT; Invitation to Pay Additional Fees issued in International Patent Application No. PCT/US2021/061041; mailed Mar. 24, 2022; 21 Pages.
Pintail Power LLC, "Liquid Air Combined Cycle Hybrid Energy Storage", Pintail Power LLC, TMCES Workshop, Aug. 10-11, 2021, San Antonio, TX, Total pp. 12.
Office Action in U.S. Appl. No. 17/650,519 mailed Apr. 20, 2022, 10 pages.
Office of Fossil Energy and Carbon Management, "U.S. Department of Energy Selects 12 Projects to Improve Fossil-Based Hydrogen Production, Transport, Storage and Utilization", dated Jul. 7, 2021, in 8 pages.
R. B. Laughlin, "Variable Blading in Closed-Cycle Brayton Energy Storage", TMCES, Aug. 10, 2021, San Antonio, Total pp. 26.
Rainer Kurz, "Hydrogen Pipelines & Storage", Mar. 8, 2021, Total pp. 16.
Reply to Communication Under Rule 71(3) EPC, received in corresponding EP App. No. 21 843 808.3, submitted May 6, 2024, in 9 pages.
Revterra, "Revterra Company Overview", TMCES 2021, Total pp. 14.
Reyad Sawafta, "Thermal Energy Storage—Cold Storage", Energy Storage for Manufacturing and Industrial Decarbonization Workshop, Feb. 9, 2022, Total pp. 11.
Richard Brody, "Powering the Carbon-Free Electric Future, Modular Geomechanical Pumped Storage (GPS)", Quidnet Energy, 3rd TMCES—Storage Deployment Panel, Aug. 11, 2021, Total pp. 7.
Richard T. Ibekwe, "Induction Heating of Firebricks for the Large-Scale Storage of Nuclear and Renewable Energy", Massachusetts Institute of Technology, Jun. 2018, Total pp. 40.
Robert J. Krane, "A second law analysis of a thermal energy storage system with Joulean heating of the storage element", American Society of Mechanical Engineers, Winter Annual Meeting, Miami Beach, Florida, USA, Nov. 17-21, 1985, Total pp. 10.
Russ Weed, "Market Needs & Technology Overview", Thermal-Mechanical-Chemical Energy Storage Workshop—Storage Deployment, Aug. 11, 2021, Total pp. 20.
S. W. Sucech et al., "Alcoa Pressure Calcination Process for Alumina", Light Metals 1986, R.E. Miller, 669-674, Total pp. 6.
Sakakibara, Reyu, et al., "Practical emitters for thermophotovoltaics: a review", Journal of Photonics for Energy, vol. 9, Issue 3, 032713 (Feb. 2019), https://doi.org/10.1117/1.JPE.9.032713, in 38 pages.
Sanjoy Banerjee, "Energy Storage to Decarbonize the Industrial Sector Through Direct Electrification", Energy Storage for Manufacturing and Industrial Decarbonization Workshop, Feb. 8, 2022, Total pp. 9.
Scott Hume, "Mid-Duration Energy Storage (MDES) Benefits and Challenges", 3rd TMCES Workshop, Aug. 10, 2021, Total pp. 11.
Sempra Energy Utility, "SoCalGas", Total pp. 6, Oct. 2021.
Sharadga, Hussein, et al., "A hybrid PV/T and Kalina cycle for power generation", Int J Energy Res. 2018;42:4817-4829, https://doi.org/10.1002/er.4237, dated Sep. 7, 2018.
Shaun Sullivan, "Reversible Counter-Rotating Turbomachine to Enable Brayton-Laughlin Cycle", 3rd Thermal-Mechanical-Chemical Energy Storage Workshop, Aug. 10, 2021, San Antonio TX, Total pp. 7.
Siemens AG, "Compressed Air Energy Storage (CAES)", 3rd Thermal-Mechanical-Chemical Energy Storage Workshop, Siemens Energy, Aug. 2021, Total pp. 17.
Siemens Gamesa, "Electric Thermal Energy Storage (ETES)—Industrial Decarbonization", Siemens Gamesa Renewable Energy, 2020, Total pp. 9.
Song, Jian, et al., "Combined supercritical CO2 (SCO2) cycle and organic Rankine cycle (ORC) system for hybrid solar and geothermal power generation: Thermoeconomic assessment of various configurations", (Year: 2021), in 16 pages.
Soteris Kalogirou, "The potential of solar industrial process heat applications", Applied Energy, vol. 76, Issue 4, Dec. 2003, pp. 337-361, Total pp. 25.
Steffes, ThermElect Hydronic, Demand-Free, off-Peak Heating, May 2020, Total pp. 2.
Stefica Nicol Bikes, "Australian engineers patent thermal block to store renewable energy", www.reuters.com, Oct. 26, 2021, Total pp. 6.
Storworks Power, 3rd Thermal-Mechanical-Chemical Energy Storage Workshop, Aug. 10, 2021, Total pp. 8.
Swagelok Energy Advisors Inc, "Steam Quality—Plant Operations Require a High Steam Quality", Steam Systems Best Practices, Document No. 23, 2009, Total pp. 3.
T. Fiedler et al., "Thermal capacitors made from Miscibility Gap Alloys (MGAs)", WIT Transactions on Ecology and The Environment, vol. 186, 2014, Total pp. 8.
Third Party Objections raised in corresponding EP App. No. 21 843 808.3, dated Apr. 30, 2024, with English Translation, in 8 pages.
Thomas A. Buscheck, "Hybrid-energy technology enabled by heat storage and oxy-combustion for power and industrial-heat applications with near-zero or negative CO2 emissions", Thermal-Mechanical-Chemical Energy Storage Workshop, San Antonio, Texas, Aug. 10, 2021, Total pp. 22.
Timothy C. Allison, "Thermal-Mechanical-Chemical Energy Storage Technology Overview and Research Activities", Southwest Research Institute, Aug. 9, 2021, Total pp. 22.
Todd Brix, "Converting Carbon. Storing Energy", Richland, Washington U.S.A, Feb. 9, 2022, Total pp. 13.
Tony Bowdery et al., "Heat Exchangers for Thermal Energy Storage: Challenges and Mitigation", Meggitt, Aug. 2021, Total pp. 20.
Torbjörn Lindquist, "Powering the evolution of a renewable society, by redefining energy infrastructure", Azelio, Feb. 7, 2022, Total pp. 10.
Travis McLing et al., "Dynamic Earth Energy Storage: Grid Scale Energy Storage using Planet Earth as a Thermal Battery (RTES)", Feb. 2022, Total pp. 7.
Trevor Brown, "Ammonia: the other hydrogen", Energy Storage for Manufacturing and Industrial Decarbonization Workshop "Energy StorM", Feb. 9, 2022, Total pp. 13.
Veera Gnaneswar Gude, "Energy storage for desalination processes powered by renewable energy and waste heat sources", Applied Energy, vol. 137, Jan. 1, 2015, pp. 877-898, Total pp. 22.
Vishal Sardeshpande, "Performance analysis for glass furnace regenerator", Applied Energy, vol. 88, Issue 12, Dec. 2011, pp. 4451-4458, Total pp. 8.
Whitlock, "NREL scientists partnering with Antora Energy and MIT on TPV projects" Renewable Energy Magazine Dec. 10, 2021, https://www.renewableenergymagazine.com/pv_solar/nrel-scientists-partnering-with-antoraenergy-and-20211210.
Written Opinion of the International Searching Authority mailed on Sep. 14, 2022 for PCT/US2021/061041, 26 pages.
Zhao, Haichuan, et al., "Thermal Calculation and Experimental Investigation of Electric Heating and Solid Thermal Storage System", Energies 2020, 13, 5241; doi:10.3390/en13205241, www.mdpi.com/journal/energies, published on Oct. 9, 2020, in 20 pages.
Zhou et al., "Highly Conductive Porous Graphene/Ceramic Composites for Heat Transfer and Thermal Energy Storage," Adv. Funct. Mater., 2013, 23, pp. 2263-2269.

(56) References Cited

OTHER PUBLICATIONS

International Search Report and Written Opinion mailed on Apr. 25, 2025 for International Application No. PCT/US2024/051145, 19 pages.
Deepinder Jot Singh, et al., "On the reduction of electric energy consumption in electrolysis: A thermodynamic study," www.sciencedirect.com, Mar. 26, 2021, Total 13 pages.

* cited by examiner

THERMAL ENERGY STORAGE SYSTEMS WITH AN ENERGY EMITTING SURFACE

CROSS-REFERENCE TO RELATED APPLICATIONS

This application claims priority to the following:

U.S. Provisional Patent Application No. 63/560,507 filed on Mar. 1, 2024;

The following patent applications and patent are directed to related technologies:

U.S. Provisional Patent Application No. 63/459,540 filed on Apr. 14, 2023;

U.S. Provisional Patent Application No. 63/578,139 filed on Aug. 22, 2023;

U.S. Provisional Patent Application No. 63/626,501 filed on Jan. 29, 2024;

U.S. patent application Ser. No. 18/395,266 filed on Dec. 22, 2023;

U.S. patent application Ser. No. 17/537,407 (filed Nov. 29, 2021; issued as U.S. Pat. No. 11,603,776 on Mar. 14, 2023); and International Patent Application No.: PCT/US2021/061041 (filed Nov. 29, 2021).

All of the foregoing applications are incorporated herein by reference in their entirety for all purposes.

BACKGROUND

Technical Field

The present disclosure relates to thermal energy storage and utilization systems. More particularly, the present disclosure relates to an energy storage system that stores electrical energy in the form of thermal energy, which can be used for the supply of hot air, carbon dioxide ($CO_2$), steam, process gas, or other heated fluids, for various applications including the supply of heat for power generation. More specifically, the present disclosure relates to using thermal energy storage systems to improve efficiency and reduce carbon emissions associated with industrial applications.

Related Art

I. Thermal Energy Systems

A. Variable Renewable Electricity

The combustion of fossil fuels has been used as a heat source in thermal electrical power generation to provide heat and steam for uses such as industrial process heat. The use of fossil fuels has various problems and disadvantages, however, including global warming and pollution. Accordingly, there is a need to switch from fossil fuels to clean and sustainable energy.

Variable renewable electricity (VRE) sources such as solar power and wind power have grown rapidly, as their costs have reduced as the world moves towards lower carbon emissions to mitigate climate change. But a major challenge relating to the use of VRE is, as its name suggests, its variability. The variable and intermittent nature of wind and solar power does not make these types of energy sources natural candidates to supply the continuous energy demands of electrical grids, industrial processes, etc. Accordingly, there is an unmet need for storing VRE to be able to efficiently and flexibly deliver energy at different times.

Moreover, the International Energy Agency has reported that the use of energy by industry comprises the largest portion of world energy use, and that three-quarters of industrial energy is used in the form of heat, rather than electricity. Thus, there is an unmet need for lower-cost energy storage systems and technologies that utilize VRE to provide industrial process energy, which may expand VRE and reduce fossil fuel combustion.

B. Storage of Energy as Heat

Thermal energy in industrial, commercial, and residential applications may be collected during one time period, stored in a storage device, and released for the intended use during another period. Examples include the storage of energy as sensible heat in tanks of liquid, including water, oils, and molten salts; sensible heat in solid media, including rock, sand, concrete and refractory materials; latent heat in the change of phase between gaseous, liquid, and solid phases of metals, waxes, salts and water; and thermochemical heat in reversible chemical reactions which may absorb and release heat across many repeated cycles; and media that may combine these effects, such as phase-changing materials embedded or integrated with materials which store energy as sensible heat. Thermal energy may be stored in bulk underground, in the form of temperature or phase changes of subsurface materials, in contained media such as liquids or particulate solids, or in self-supporting solid materials.

Electrical energy storage devices such as batteries typically transfer energy mediated by a flowing electrical current. Some thermal energy storage devices similarly transfer energy into and out of storage using a single heat transfer approach, such as convective transfer via a flowing liquid or gas heat transfer medium. Such devices use "refractory" materials, which are resistant to high temperatures, as their energy storage media. These materials may be arranged in configurations that allow the passage of air and combustion gases through large amounts of material.

Some thermal energy systems may, at their system boundary, absorb energy in one form, such as incoming solar radiation or incoming electric power, and deliver output energy in a different form, such as heat being carried by a liquid or gas. But thermal energy storage systems must also be able to deliver storage economically. For sensible heat storage, the range of temperatures across which the bulk storage material—the "storage medium"—can be heated and cooled is an important determinant of the amount of energy that can be stored per unit of material. Thermal storage materials are limited in their usable temperatures by factors such as freezing, melting, softening, boiling, or thermally driven decomposition or deterioration, including chemical and mechanical effects.

Further, different uses of thermal energy—different heating processes or industrial processes—require energy at different temperatures. Electrical energy storage devices, for example, can store and return electrical energy at any convenient voltage and efficiently convert that voltage up or down with active devices. On the other hand, the conversion of lower-temperature heat to higher temperatures is intrinsically costly and inefficient. Accordingly, a challenge in thermal energy storage devices is the cost-effective delivery of thermal energy with heat content and at a temperature sufficient to meet a given application.

Some thermal energy storage systems store heat in a liquid that flows from a "cold tank" through a heat exchange device to a "hot tank" during charging, and then from the hot tank to the cold tank during discharge, delivering relatively isothermal conditions at the system outlet during discharge. Systems and methods to maintain sufficient outlet temperature while using lower-cost solid media are needed.

Thermal energy storage systems generally have costs that are primarily related to their total energy storage capacity (how many MWh of energy are contained within the system) and to their energy transfer rates (the MW of instantaneous power flowing into or out of the energy storage unit at any given moment). Within an energy storage unit, energy is transferred from an inlet into storage media, and then transferred at another time from storage media to an outlet. The rate of heat transfer into and out of storage media is limited by factors including the heat conductivity and capacity of the media, the surface area across which heat is transferring, and the temperature difference across that surface area. High rates of charging are enabled by high temperature differences between the heat source and the storage medium, high surface areas, and storage media with high heat capacity and/or high thermal conductivity.

Each of these factors can add significant cost to an energy storage device. For example, larger heat exchange surfaces commonly require 1) larger volumes of heat transfer fluids, and 2) larger surface areas in heat exchangers, both of which are often costly. Higher temperature differences require heat sources operating at relatively higher temperatures, which may cause efficiency losses (e.g. radiation or convective cooling to the environment, or lower coefficient of performance in heat pumps) and cost increases (such as the selection and use of materials that are durable at higher temperatures). Media with higher thermal conductivity and heat capacity may also require selection of costly higher-performance materials or aggregates.

Another challenge of systems storing energy from VRE sources relates to rates of charging. A VRE source, on a given day, may provide only a small percentage of its energy during a brief period of the day, due to prevailing conditions. For an energy storage system that is coupled to a VRE source and that is designed to deliver continuous output, all the delivered energy must be absorbed during the period when incoming VRE is available. As a result, the peak charging rate may be some multiple of the discharge rates (e.g., 3-5×), for instance, in the case of a solar energy system, if the discharge period (overnight) is significantly longer than the charge period (during daylight). In this respect, the challenge of VRE storage is different from, for example, that of heat recuperation devices, which typically absorb and release heat at similar rates. For VRE storage systems, the design of units that can effectively charge at high rates is important and may be a higher determinant of total system cost than the discharge rate.

C. Thermal Energy Storage Problems and Disadvantages

The above-described approaches have various problems and disadvantages. Earlier systems do not take into account several critical phenomena in the design, construction, and operation of thermal energy storage systems, and thus does not facilitate such systems being built and efficiently operated. More specifically, current designs fail to address "thermal runaway" and element failure due to non-uniformities in thermal energy charging and discharging across an array of solid materials, including the design of charging, discharging, and unit controls to attain and restore balances in temperature across large arrays of thermal storage material.

Thermal energy storage systems with embedded radiative charging and convective discharging are in principle vulnerable to "thermal runaway" or "heat runaway" effects. The phenomenon may arise from imbalances, even small imbalances, in local heating by heating elements and in cooling by heat transfer fluid flow. The variations in heating rate and cooling rate, unless managed and mitigated, may lead to runaway temperatures that cause failures of heaters and/or deterioration of refractory materials. Overheating causes early failures of heating elements and shortened system life. In Stack, for example, the bricks closest to the heating wire are heated more than the bricks that are further away from the heating wire. As a result, the failure rate for the wire is likely to increase, reducing heater lifetime.

One effect that further exacerbates thermal runaway is the thermal expansion of air flowing in the air conduits. Hotter air expands more, causing a higher outlet velocity for a given inlet flow, and thus a higher hydraulic pressure drop across the conduit, which may contribute to a further reduction of flow and reduced cooling during discharge. Thus, in successive heating and cooling cycles, progressively less local cooling can occur, resulting in still greater local overheating.

The effective operation of heat supply from thermal energy storage relies upon continuous discharge, which is a particular challenge in systems that rely upon VRE sources to charge the system. Solutions are needed that can capture and store that VRE energy in an efficient manner and provide the stored energy as required to a variety of uses, including a range of industrial applications, reliably and without interruption.

Previous systems do not adequately address problems associated with VRE energy sources, including variations arising from challenging weather patterns such as storms, and longer-term supply variations arising from seasonal variations in VRE generation. In this regard, there is an unmet need in the art to provide efficient control of energy storage system charging and discharging in smart storage management. Current designs do not adequately provide storage management that considers a variety of factors, including medium-term through short-term weather forecasts, VRE generation forecasts, and time-varying demand for energy, which may be determined in whole or in part by considerations such as industrial process demand, grid energy demand, real-time electricity prices, wholesale electricity market capacity prices, utility resource adequacy value, and carbon intensity of displaced energy supplies. A system is needed that can provide stored energy to various demands that prioritizes by taking into account these factors, maximizing practical utility and economic efficiencies.

There are a variety of unmet needs relating generally to energy, and more specifically, to thermal energy. Generally, there is a need to switch from fossil fuels to clean and sustainable energy. There is also a need to store VRE to deliver energy at different times in order to help meet society's energy needs. There is also a need for lower-cost energy storage systems and technologies that allow VRE to provide energy for industrial processes, which may expand the use of VRE and thus reduce fossil fuel combustion. There is also a desire to maintain sufficient outlet temperature while using lower-cost solid media.

Still further, there is a need to design VRE units that can be rapidly charged at low cost, supply dispatchable, continuous energy as required by various industrial applications despite variations in VRE supply, and that facilitate efficient control of charging and discharging of the energy storage system.

II. Storage of Intermittent Energy

Fossil fuels have driven the world economy since the industrial revolution; however, mankind has discovered that not only is there a limited supply of these energy resources, but also that the combustion of fossil fuels to extract their energy produces greenhouse gases and other pollutants that threaten planet-wide ecosystems. Specifically, such systems are inherently inefficient in their use of the energy locked up in chemical bonds because they emit innumerable tons of hot combustion gases out smokestacks into our atmosphere, directly causing global warming, indirectly causing global warming through the effects of greenhouse gas emissions on the increased absorption of sunlight by planet Earth, as well as the effects of the pollutants' contribution to the degradation of our planet through, for example, the washing of the Earth's various ecosystems in acid rain.

Energy sources that address this problem, such as solar energy, wind energy, and tidal energy are being developed to meet our need for renewable energy sources that do not generate these harmful greenhouse gases. One drawback that renewable energy sources have is that they are of an intermittent nature. The sun does not always shine; the wind does not always blow; tides are not always flowing. This has prevented these technologies from becoming replacements for fossil fueled energy sources, since industry requires power on demand, 24 hours a day, 365 days a year.

Therefore, what is needed is a way to store the intermittent energy that renewable energy sources provide in a closed loop to meet the constant power demands of industry without expelling heat and pollutants to the atmosphere. This has led to the development of green energy storage solutions, as well as the systems and methods for heat storage and extraction from structured solid blocks in thermal energy storage units as described herein.

One hurdle that lies between the conception and initial development of thermal storage solutions and their actual implementation is the interfacing of such solutions with existing industrial equipment to make use of existing assets and infrastructure. Consequently, what is needed are systems for the modularization of such thermal energy storage units that may be combined in various fashions to provide for customized solutions that meet the individual needs for retrofitting such fossil fuel fired power systems. Furthermore, there is a great need to enable the evaluation of thermal energy storage units as a green energy alternative to existing fuel fired boiler systems without redesigning and rebuilding existing industrial infrastructure. Along these lines, what is desperately needed are systems that allow for easily switching between fossil fuel energy sources and variable renewable electricity sources to evaluate the latter as replacements for existing fossil fuel fired energy sources. This would greatly help achieve the worldwide goals set forth in the Paris Climate Accord, in particular a 45% reduction in greenhouse gas emissions by 2030, with a net zero emission goal target set for 2050. In particular, systems and methods for the coupling of one or more thermal energy storage units to fuel fired boiler systems is needed, along with control systems that coordinate the operation of systems containing multiple thermal energy storage units. This coupling of two completely different energy sources allows for reversibly evaluating this new sustainable technology for the possible retrofitting or replacement of the fossil fuel based systems with a green energy supply, while retaining much of the capital equipment that is already paid for and in service.

III. Industrial Applications of Stored Thermal Energy

The steel industry accounts for as much as 5% of total world greenhouse gas emissions because of its significant use of coal. Traditional steel making process using refined coal generates about two tons of carbon dioxide ($CO_2$) for every ton of steel produced. Low $CO_2$ emitting steelmaking and ironmaking solutions are being developed to reduce the amount of greenhouse gas emissions associated with the steel and iron industries.

These traditional industrial processes continue to rely on carbon emitting sources to provide sufficient heat to drive their processing.

SUMMARY

The example implementations advance the art of thermal energy storage and enable the practical construction and operation of high-temperature thermal energy storage (TES) systems that can charge by VRE, store energy in storage media, and deliver high-temperature heat. This Section of the Summary relates to the disclosure as it appears in U.S. patent application Ser. No. 17/668,333 (U.S. Pat. No. 11,603,776).

Aspects of the example implementations relate to a system for thermal energy storage, including an input (e.g., electricity from a variable renewable electricity (VRE) source), a container having sides, a roof and a lower platform, a plurality of vertically oriented thermal storage units (TSUs), inside the container, the TSUs each including a plurality of stacks of bricks and heaters attached thereto, each of the heaters being connected to the input electricity via switching circuitry, an insulative layer interposed between the plurality of TSUs, the roof and at least one of the sides, a duct formed between the insulative layer and a boundary formed by the sides, an inner side of the roof and the lower platform of the container, a blower that blows relatively cooler fluid such as air or another gas (e.g. $CO_2$) along the flow path, an output (e.g., hot air at prescribed temperature to industrial application), a controller that controls and co-manages the energy received from the input and the hot air generated at the output based on a forecast associated with an ambient condition (e.g., season or weather) or a condition (e.g., output temperature, energy curve, etc.). The exterior and interior shapes of the container may be rectangular, cylindrical (in which case "sides" refers to the cylinder walls), or other shapes suitable to individual applications.

The terms air, fluid and gas are used interchangeably herein to refer to a fluid heat transfer medium of any suitable type, including various types of gases (air, $CO_2$, oxygen and other gases, alone or in combination), and when one is mentioned, it should be understood that the others can equally well be used. Thus, for example, "air" can be any suitable fluid or gas or combinations of fluids or gases.

Thermal energy storage (TES) systems according to the present designs can advantageously be integrated with or coupled to steam generators, including heat recovery steam generators (HRSGs) and once-through steam generators (OTSGs). The terms "steam generator", "HRSG", and "OTSG" are used interchangeably herein to refer to a heat exchanger that transfers heat from a first fluid into a second fluid, where the first fluid may be air circulating from the TSU and the second fluid may be water (being heated and/or boiled), oil, salt, air, $CO_2$, or another fluid. In such implementations, the heated first fluid is discharged from a TES unit and provided as input to the steam generator, which extracts heat from the discharged fluid to heat a second fluid, including producing steam, which heated second fluid may be used for any of a variety of purposes (e.g., to drive a turbine to produce shaft work or electricity). After passing through a turbine, the second fluid still contains significant heat energy, which can be used for other processes. Thus, the TES system may drive a cogeneration process. The first fluid, upon exiting the steam generator, can be fed back as input to the TES, thus capturing waste heat to effectively preheat the input fluid. Waste heat from another process may also preheat input fluid to the TES.

According to another aspect, a dynamic insulation system include a container having sides, a roof and a lower platform, a plurality of vertically oriented thermal storage units (TSUs) spaced apart from one another, an insulative layer interposed between the plurality of TSUs, the roof and at least one of the sides and floor, a duct formed between the insulative layer and a boundary formed by the sides, an inner side of the roof and the lower platform of the container, and a blower that blows unheated air along the air flow path, upward from the platform to a highest portion of the upper portion, such that the air path is formed from the highest portion of the roof to the platform, and is heated by the plurality of TSUs, and output from the TES apparatus. The unheated air along the flow path forms an insulated layer and is preheated by absorbing heat from the insulator.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF DRAWINGS

The accompanying drawings are included to provide a further understanding of the present disclosure and are incorporated in and constitute a part of this specification. The drawings illustrate example implementations of the present disclosure and, together with the description, serve to explain the principles of the present disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Aspects of the example implementations, as disclosed herein, relate to systems, methods, materials, compositions, articles, and improvements for a thermal energy storage system for power generation for various industrial applications.

I. Thermal Energy Storage System

This Section I of the Summary relates to the disclosure as it appears in U.S. Pat. No. 11,603,776, of which this application is a continuation-in-part.

U.S. Pat. No. 11,603,776 relates to the field of thermal energy storage and utilization systems and addresses the above-noted problems. A thermal energy storage system is disclosed that stores electrical energy in the form of thermal energy in a charging mode and delivers the stored energy in a discharging mode. The discharging can occur at the same time as charging; i.e., the system may be heated by electrical energy at the same time that it is providing a flow of convectively heated air. The discharged energy is in the form of hot air, hot fluids in general, steam, heated $CO_2$, heated supercritical $CO_2$, and/or electrical power generation, and can be supplied to various applications, including industrial uses. The disclosed implementations include efficiently constructed, long-service-life thermal energy storage systems having materials, fabrication, physical shape, and other properties that mitigate damage and deterioration from repeated temperature cycling.

Optionally, heating of the elements of the storage unit may be optimized, so as to store a maximum amount of heat during the charging cycle. Alternatively, heating of elements may be optimized to maximize heating element life, by means including minimizing time at particular heater temperatures, and/or by adjusting peak charging rates and/or peak heating element temperatures. Still other alternatives may balance these competing interests. Specific operations to achieve these optimizations are discussed further below.

Example implementations employ efficient yet economical thermal insulation. Specifically, a dynamic insulation design may be used either by itself or in combination with static primary thermal insulation. The disclosed dynamic insulation techniques provide a controlled flow of air inside the system to restrict dissipation of thermal energy to the outside environment, which results in higher energy storage efficiency.

System Overview as Disclosed in U.S. Pat. No. 11,603,776

Figure 1:
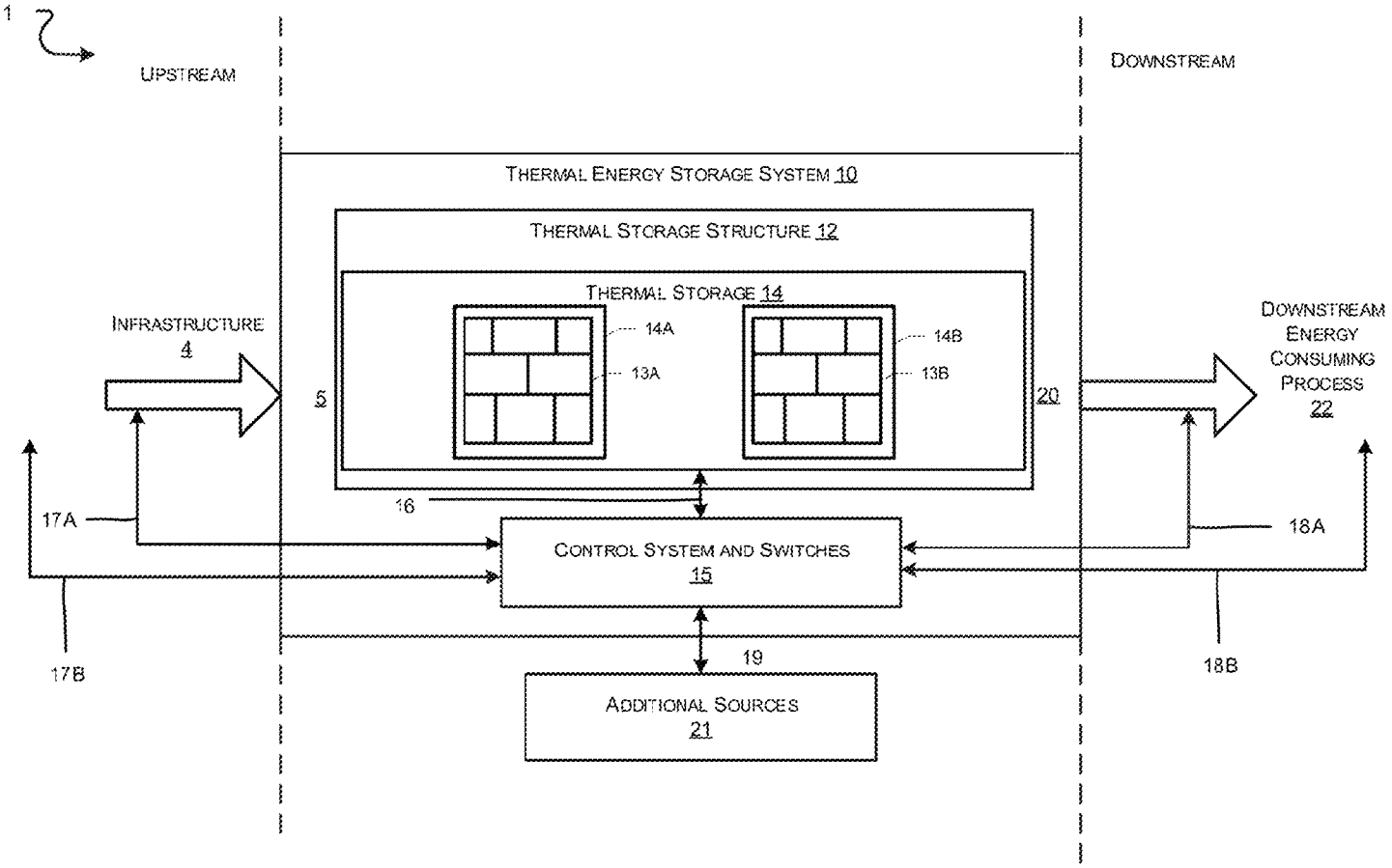
FIG. 1 illustrates a schematic diagram of the thermal energy storage system architecture according to the example implementations.

FIG. 1 is a block diagram of a system 1 that includes a thermal energy storage system 10, according to one implementation. In the implementation shown, thermal energy storage system 10 is coupled between an input energy source 2 and a downstream energy-consuming process 22. For case of reference, components on the input and output sides of system 1 may be described as being "upstream" and "downstream" relative to system 10.

In the depicted implementation, thermal energy storage system 10 is coupled to input energy source 2, which may include one or more sources of electrical energy. Source 2 may be renewable, such as photovoltaic (PV) cell or solar, wind, geothermal, etc. Source 2 may also be another source, such as nuclear, natural gas, coal, biomass, or other. Source 2 may also include a combination of renewable and other sources. In this implementation, source 2 is provided to thermal energy storage system 10 via infrastructure 4, which may include one or more electrical conductors, commutation equipment, etc. In some implementations, infrastructure 4 may include circuitry configured to transport electricity over long distances; alternatively, in implementations in which input energy source 2 is located in the immediate vicinity of thermal energy storage system 10, infrastructure 4 may be greatly simplified. Ultimately, infrastructure 4 delivers energy to input 5 of thermal energy storage system 10 in the form of electricity.

The electrical energy delivered by infrastructure 4 is input to thermal storage structure 12 within system 10 through switchgear, protective apparatus and active switches controlled by control system 15. Thermal storage structure 12 includes thermal storage 14, which in turn includes one more assemblages (e.g., 14A, 14B) of solid storage media (e.g., 7B, 13A) configured to store thermal energy. These assemblages are variously referred to throughout this disclosure as "stacks," "arrays," and the like. These terms are intended to be generic and not connote any particular orientation in space, etc. In general, an array can include any material that is suitable for storing thermal energy and can be oriented in any given orientation (e.g., vertically, horizontally, etc.). Likewise, the solid storage media within the assemblages may variously be referred to as thermal storage blocks, bricks, etc. In implementations with multiple arrays, the arrays may be thermally isolated from one another and are separately controllable, meaning that they are capable of being charged or discharged independently from one another. This arrangement provides maximum flexibility, permitting multiple arrays to be charged at the same time, multiple arrays to be charged at different times or at different rates, one array to be discharged while the other array remains charged, etc.

Thermal storage 14 is configured to receive electrical energy as an input. The received electrical energy may be provided to thermal storage 14 via resistive heating elements that are heated by electrical energy and emit heat, primarily as electromagnetic radiation in the infrared and visible spectrum. During a charging mode of thermal storage 14, the electrical energy is released as heat from the resistive heating elements, transferred principally by radiation emitted both by the heating elements and by hotter solid storage media, and absorbed and stored in solid media within storage 14. When an array within thermal storage 14 is in a discharging mode, the heat is discharged from thermal storage structure 12 as output 20. As will be described, output 20 may take various forms, including a fluid such as hot air. (References to the use of "air" and "gases" within the present disclosure may be understood to refer more generally to a "fluid.") The hot air may be provided directly to a downstream energy consuming process 22 (e.g., an industrial application), or it may be passed through a steam generator (not shown) to generate steam for process 22.

Additionally, thermal energy storage system 10 includes a control system 15. Control system 15, in various implementations, is configured to control thermal storage 14, including through setting operational parameters (e.g., discharge rate), controlling fluid flows, controlling the actuation of electromechanical or semiconductor electrical switching devices, etc. The interface 16 between control system 15 and thermal storage structure 12 (and, in particular thermal storage 14) is indicated in FIG. 1. Control system 15 may be implemented as a combination of hardware and software in various embodiments.

Control system 15 may also interface with various entities outside thermal energy storage system 10. For example, control system 15 may communicate with input energy source 2 via an input communication interface 17B. For example, interface 17B may allow control system 15 to receive information relating to energy generation conditions at input energy source 2. In the implementation in which input energy source 2 is a photovoltaic array, this information may include, for example, current weather conditions at the site of source 2, as well as other information available to any upstream control systems, sensors, etc. Interface 17B may also be used to send information to components or equipment associated with source 2.

Similarly, control system 15 may communicate with infrastructure 4 via an infrastructure communication interface 17A. In a manner similar to that explained above, interface 17A may be used to provide infrastructure information to control system 15, such as current or forecast VRE availability, grid demand, infrastructure conditions, maintenance, emergency information, etc. Conversely, communication interface 17A may also be used by control system 15 to send information to components or equipment within infrastructure 4. For example, the information may include control signals transmitted from the control system 15, that controls valves or other structures in the thermal storage structure 12 to move between an open position and a closed position, or to control electrical or electronic switches connected to heaters in the thermal storage 14. Control system 15 uses information from communication interface 17A in determining control actions, and control actions may adjust closing or firing of switches in a manner to optimize the use of currently available electric power and maintain the voltage and current flows within infrastructure 4 within chosen limits.

Control system 15 may also communicate downstream using interfaces 18A and/or 18B. Interface 18A may be used to communicate information to any output transmission structure (e.g., a steam transmission line), while interface 18B may be used to communicate with downstream process 22. For example, information provided over interfaces 18A and 18B may include temperature, industrial application demand, current or future expected conditions of the output or industrial applications, etc. Control system 15 may control the input, heat storage, and output of thermal storage structure based on a variety of information. As with interfaces 17A and 17B, communication over interfaces 18A and 18B may be bidirectional—for example, system 10 may indicate available capacity to downstream process 22. Still further, control system 15 may also communicate with any other relevant data sources (indicated by reference numeral 21 in FIG. 1) via additional communication interface 19. Additional data sources 21 are broadly intended to encompass any other data source not maintained by either the upstream or downstream sites. For example, sources 21 might include third-party forecast information, data stored in a cloud data system, etc.

Thermal energy storage system 10 is configured to efficiently store thermal energy generated from input energy source 2 and deliver output energy in various forms to a downstream process 22. In various implementations, input energy source 2 may be from renewable energy and downstream process 22 may be an industrial application that requires an input such as steam or hot air. Through various techniques, including arrays of thermal storage blocks that use radiant heat transfer to efficiently storage energy and a lead-lag discharge paradigm that leads to desirable thermal properties such as the reduction of temperature nonuniformities within thermal storage 14, system 10 may advantageously provide a continuous (or near-continuous) flow of output energy based on an intermittently available source. The use of such a system has the potential to reduce the reliance of industrial applications on fossil fuels.

Figure 2:
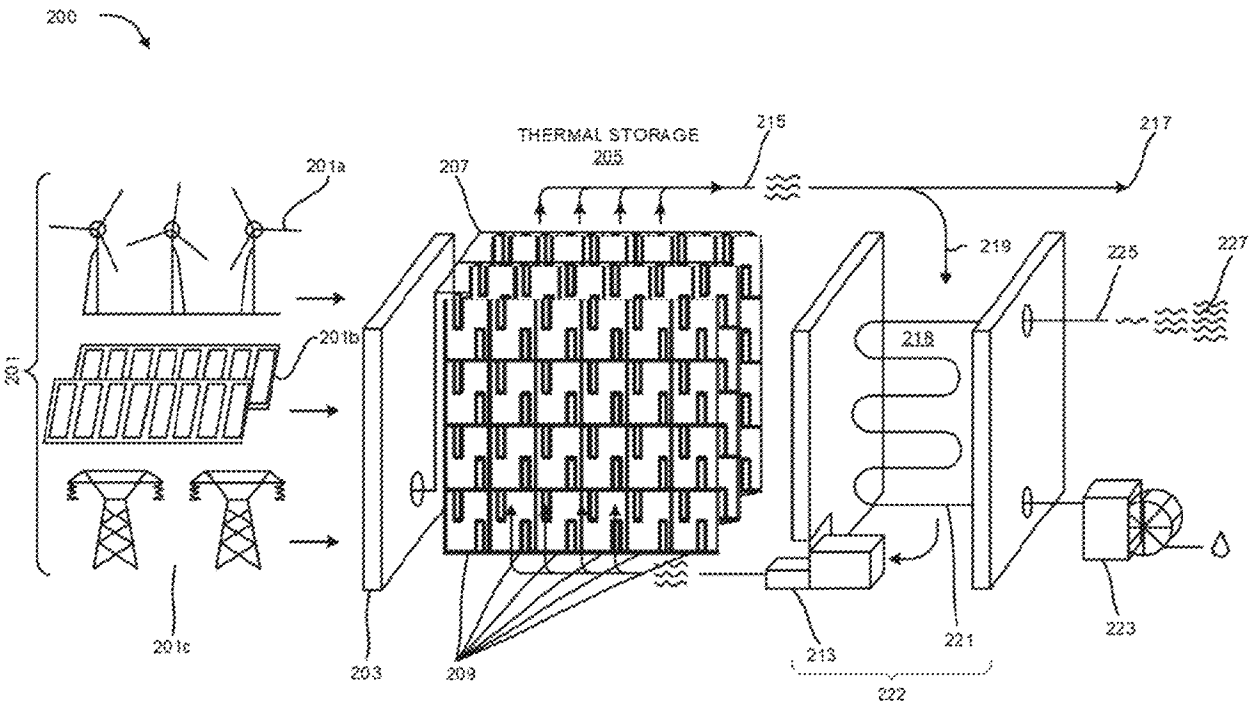
FIG. 2 illustrates a schematic diagram of a system according to the example implementations.

FIG. 2 provides a schematic view of one implementation of a system 200 for storing thermal energy, and further illustrates components and concepts just described with respect to FIG. 1. As shown, one or more energy sources 201 provide input electricity. For example, and as noted above, renewable sources such as wind energy from wind turbines 201*a*, solar energy from photovoltaic cells 201*b*, or other energy sources may provide electricity that is variable in availability or price because the conditions for generating the electricity are varied. For example, in the case of wind turbine 201*a*, the strength, duration and variance of the wind, as well as other weather conditions causes the amount of energy that is produced to vary over time. Similarly, the amount of energy generated by photovoltaic cells 201*b* also varies over time, depending on factors such as time of day, length of day due to the time of year, level of cloud cover due to weather conditions, temperature, other ambient conditions, etc. Further, the input electricity may be received from the existing power grid 201*c*, which may in turn vary based on factors such as pricing, customer demand, maintenance, and emergency requirements.

The electricity generated by source 201 is provided to the thermal storage structure within the thermal energy storage system. In FIG. 2, the passage of electricity into the thermal storage structure is represented by wall 203. The input electrical energy is converted to heat within thermal storage 205 via resistive heating elements 207 controlled by switches (not shown). Heating elements 207 provide heat to solid storage media 209. Thermal storage components (sometimes called "bricks") within thermal storage 205 are arranged to form embedded radiative chambers. FIG. 2 illustrates that multiple thermal storage arrays 209 may be present within system 200. These arrays may be thermally isolated from one another and may be separately controllable. FIG. 2 is merely intended to provide a conceptual representation of how thermal storage 205 might be implemented—one such implementation might, for example, include only two arrays, or might include six arrays, or ten arrays, or more.

In the depicted implementation, a blower 213 drives air or other fluid to thermal storage 205 such that the air is eventually received at a lower portion of each of the arrays 209. The air flows upward through the channels and chambers formed by bricks in each of the arrays 209, with flow controlled by louvers. By the release of heat energy from the resistive heating elements 207, heat is radiatively transferred to arrays 209 of bricks during a charging mode. Relatively hotter brick surfaces reradiate absorbed energy (which may be referred to as a radiative "echo") and participate in heating cooler surfaces. During a discharging mode, the heat stored in arrays 209 is output, as indicated at 215.

Once the heat has been output in the form of a fluid such as hot air, the fluid may be provided for one or more downstream applications. For example, hot air may be used directly in an industrial process that is configured to receive the hot air, as shown at 217. Further, hot air may be provided as a stream 219 to a heat exchanger 218 of a steam generator 222, and thereby heats a pressurized fluid such as air, water, $CO_2$ or other gas. In the example shown, as the hot air stream 219 passes over a line 221 that provides the water from the pump 223 as an input, the water is heated and steam is generated as an output 225, which may be provided to an industrial application as shown at 227.

Figure 3:
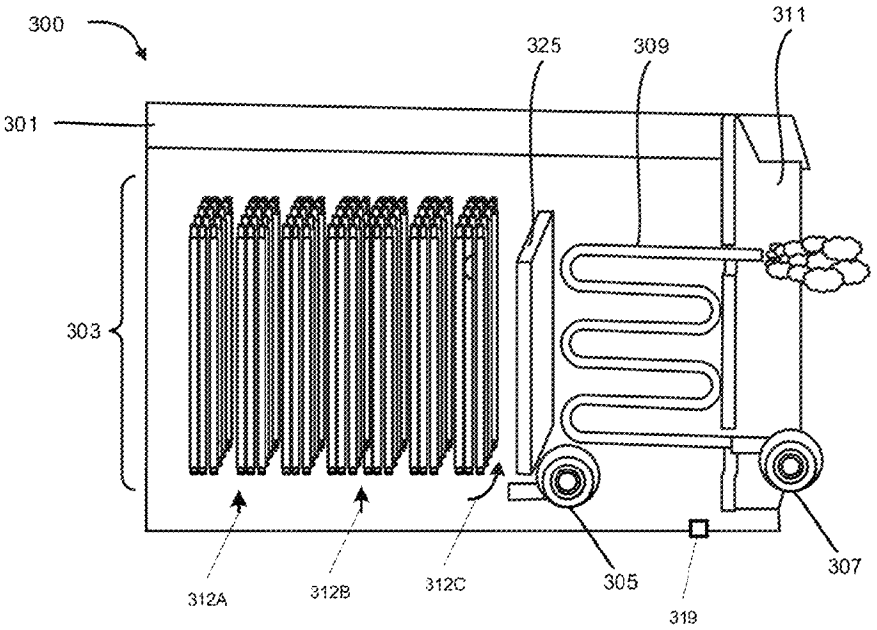
FIG. 3 illustrates a schematic diagram of a storage-fired once-through steam generator (OTSG) according to the example implementations.

A thermal storage structure such as that depicted in FIGS. 1-2 may also include output equipment configured to produce steam for use in a downstream application. FIG. 3, for example, depicts a block diagram of an implementation of a thermal storage structure 300 that includes a storage-fired once-through steam generator (OTSG). An OTSG is a type of heat recovery stream generator (HRSG), which is a heat exchanger that accepts hot air from a storage unit, returns cooler air, and heats an external process fluid. The depicted OTSG is configured to use thermal energy stored in structure 300 to generate steam at output 311.

As has been described, thermal storage structure 300 includes outer structure 301 such walls, a roof, as well as thermal storage 303 in a first section of the structure. The OTSG is located in a second section of the structure, which is separated from the first section by thermal barrier 325. During a charging mode, thermal energy is stored in thermal storage 303. During a discharging mode, the thermal energy stored in thermal storage 303 receives a fluid flow (e.g., air) by way of a blower 305. These fluid flows may be generated from fluid entering structure 300 via an inlet valve 319 and include a first fluid flow 312A (which may be directed to a first stack within thermal storage 303) and a second fluid flow 312B (which may be directed to a second stack within thermal storage 303).

As the air or other fluid directed by blower 305 flows through the thermal storage 303 from the lower portion to the upper portion, it is heated and is eventually output at the upper portion of thermal storage 303. The heated air, which may be mixed at some times with a bypass fluid flow 312C that has not passed through thermal storage 302, is passed over a conduit 309 through which flows water, or another fluid pumped by the water pump 307. As the hot air heats up the water in the conduit, steam is generated at 311. The cooled air that has crossed the conduit (and transferred heat to the water flowing through it) is then fed back into the brick heat storage 303 by blower 305. As explained below, the control system can be configured to control attributes of the steam, including steam quality, or fraction of the steam in the vapor phase, and flow rate.

As shown in FIG. 3, an OTSG does not include a recirculating drum boiler. Properties of steam produced by an OTSG are generally more difficult to control than those of steam produced by a more traditional HRSG with a drum, or reservoir. The steam drum in such an HRSG acts as a phase separator for the steam being produced in one or more heated tubes recirculating the water; water collects at the bottom of the reservoir while the steam rises to the top. Saturated steam (having a steam quality of 100%) can be collected from the top of the drum and can be run through an additional heated tube structure to superheat it and further assure high steam quality. Drum-type HRSGs are widely used for power plants and other applications in which the water circulating through the steam generator is highly purified and stays clean in a closed system. For applications in which the water has significant mineral content, however, mineral deposits form in the drum and tubes and tend to clog the system, making a recirculating drum design infeasible.

For applications using water with a higher mineral content, an OTSG may be a better option. One such application is oil extraction, in which feed water for a steam generator may be reclaimed from a water/oil mixture produced by a well. Even after filtering and softening, such water may have condensed solid concentrations on the order of 10,000 ppm or higher. The lack of recirculation in an OTSG enables operation in a mode to reduce mineral deposit formation; however, an OTSG needs to be operated carefully in some implementations to avoid mineral deposits in the OTSG water conduit. For example, having some fraction of water droplets present in the steam as it travels through the OTSG conduit may be required to prevent mineral deposits by retaining the minerals in solution in the water droplets. This consideration suggests that the steam quality (vapor fraction) of steam within the conduit must be maintained below a specified level. On the other hand, a high steam quality at the output of the OTSG may be important for the process employing the steam. Therefore, it is advantageous for a steam generator powered by VRE through TES to maintain close tolerances on outlet steam quality. There is a sensitive interplay among variables such as input water temperature, input water flow rate and heat input, which must be managed to achieve a specified steam quality of output steam while avoiding damage to the OTSG.

Implementations of the thermal energy storage system disclosed herein provide a controlled and specified source of heat to an OTSG. The controlled temperature and flow rate available from the thermal energy storage system allows effective feed-forward and feedback control of the steam quality of the OTSG output. In one implementation, feed-forward control includes using a target steam delivery rate and steam quality value, along with measured water temperature at the input to the water conduit of the OTSG, to determine a heat delivery rate required by the thermal energy storage system for achieving the target values. In this implementation, the control system can provide a control signal to command the thermal storage structure to deliver the flowing gas across the OTSG at the determined rate. In one implementation, a thermal energy storage system integrated with an OTSG includes instrumentation for measurement of the input water temperature to the OTSG.

In one implementation, feedback control includes measuring a steam quality value for the steam produced at the outlet of the OTSG, and a controller using that value to adjust the operation of the system to return the steam quality to a desired value. Obtaining the outlet steam quality value may include separating the steam into its liquid and vapor phases and independently monitoring the heat of the phases to determine the vapor phase fraction. Alternatively, obtaining the outlet steam quality value may include measuring the pressure and velocity of the outlet steam flow and the pressure and velocity of the inlet water flow, and using the relationship between values to calculate an approximation of the steam quality. Based on the steam quality value, a flow rate of the outlet fluid delivered by the thermal storage to the OTSG may be adjusted to achieve or maintain the target steam quality. In one implementation, the flow rate of the outlet fluid is adjusted by providing a feedback signal to a controllable element of the thermal storage system. The controllable element may be an element used in moving fluid through the storage medium, such as a blower or other fluid moving device, a louver, or a valve.

The steam quality measurement of the outlet taken in real time may be used as feedback by the control system to determine the desired rate of heat delivery to the OTSG. To accomplish this, an implementation of a thermal energy storage system integrated with an OTSG may include instruments to measure inlet water velocity and outlet steam flow velocity, and, optionally, a separator along with instruments for providing separate measurements of the liquid and vapor heat values. In some implementations, the tubing in an OTSG is arranged such that the tubing closest to the water inlet is positioned in the lowest temperature portion of the airflow, and that the tubing closest to the steam exit is positioned in the highest temperature portion of the airflow. In some implementations of the present innovations, the OTSG may instead be configured such that the highest steam quality tubes (closest to the steam outlet) are positioned at some point midway through the tubing arrangement, so as to enable higher inlet fluid temperatures from the TSU to the OTSG while mitigating scale formation within the tubes and overheating of the tubes, while maintaining proper steam quality. The specified flow parameters of the heated fluid produced by thermal energy storage systems as disclosed herein may in some implementations allow precise modeling of heat transfer as a function of position along the conduit. Such modeling may allow specific design of conduit geometries to achieve a specified steam quality profile along the conduit.

Figure 4:
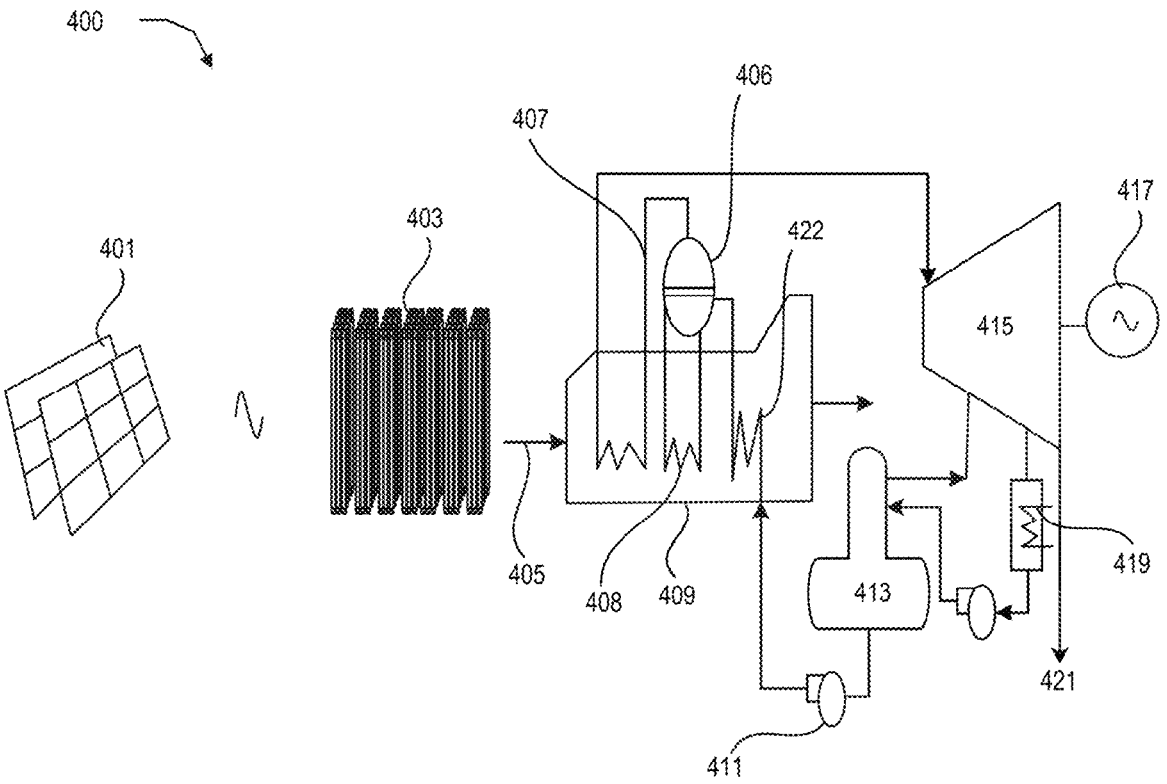
FIG. 4 illustrates an example view of a system being used as an integrated cogeneration system according to the example implementations.

As shown in FIG. 4, the output of the thermal energy storage system may be used for an integrated cogeneration system 400. As previously explained, an energy source 401 provides electrical energy that is stored as heat in the heat storage 403 of the TSU. During discharge, the heated air is output at 405. As shown in FIG. 4, lines containing a fluid, in this case water, arc pumped into a drum 406 of an HRSG 409 via a preheating section of tubing 422. In this implementation, HRSG 409 is a recirculating drum type steam generator, including a drum or boiler 406 and a recirculating evaporator section 408. The output steam passes through line 407 to a superheater coil, and is then provided to a turbine at 415, which generates electricity at 417. As an output, the remaining steam 421 may be expelled to be used as a heat source for a process or condensed at 419 and optionally passed through to a deaeration unit 413 and delivered to pump 411 in order to perform subsequent steam generation.

Certain industrial applications may be particularly well-suited for cogeneration. For example, some applications use higher temperature heat in a first system, such as to convert the heat to mechanical motion as in the case of a turbine, and lower-temperature heat discharged by the first system for a second purpose, in a cascading manner; or an inverse temperature cascade may be employed. One example involves a steam generator that makes high-pressure steam to drive a steam turbine that extracts energy from the steam, and low-pressure steam that is used in a process, such as an ethanol refinery, to drive distillation and electric power to run pumps. Still another example involves a thermal energy storage system in which hot gas is output to a turbine, and the heat of the turbine outlet gas is used to preheat inlet water to a boiler for processing heat in another steam generator (e.g., for use in an oilfield industrial application). In one application, cogeneration involves the use of hot gas at e.g., 840° C. to power or co-power hydrogen electrolysis, and the lower temperature output gas of the hydrogen electrolyzer, which may be at about 640° C., is delivered alone or in combination with higher-temperature heat from a TSU to a steam generator or a turbine for a second use. In another application, cogeneration involves the supply of heated gas at a first temperature e.g., 640° C. to enable the operation of a fuel cell, and the waste heat from the fuel cell which may be above 800° C. is delivered to a steam generator or a turbine for a second use, either alone or in combination with other heat supplied from a TSU.

A cogeneration system may include a heat exchange apparatus that receives the discharged output of the thermal storage unit and generates steam. Alternately, the system may heat another fluid such as supercritical carbon dioxide by circulating high-temperature air from the system through a series of pipes carrying a fluid, such as water or $CO_2$, (which transfers heat from the high-temperature air to the pipes and the fluid), and then recirculating the cooled air back as an input to the thermal storage structure. This heat exchange apparatus is an HRSG, and in one implementation is integrated into a section of the housing that is separated from the thermal storage.

The HRSG may be physically contained within the thermal storage structure or may be packaged in a separate structure with ducts conveying air to and from the HRSG. The HRSG can include a conduit at least partially disposed within the second section of the housing. In one implementation, the conduit can be made of thermally conductive material and be arranged so that fluid flows in a "once-through" configuration in a sequence of tubes, entering as lower-temperature fluid and exiting as higher temperature, possibly partially evaporated, two-phase flow. As noted above, once-through flow is beneficial, for example, in processing feedwater with substantial dissolved mineral contaminants to prevent accumulation and precipitation within the conduits.

Figure 6:
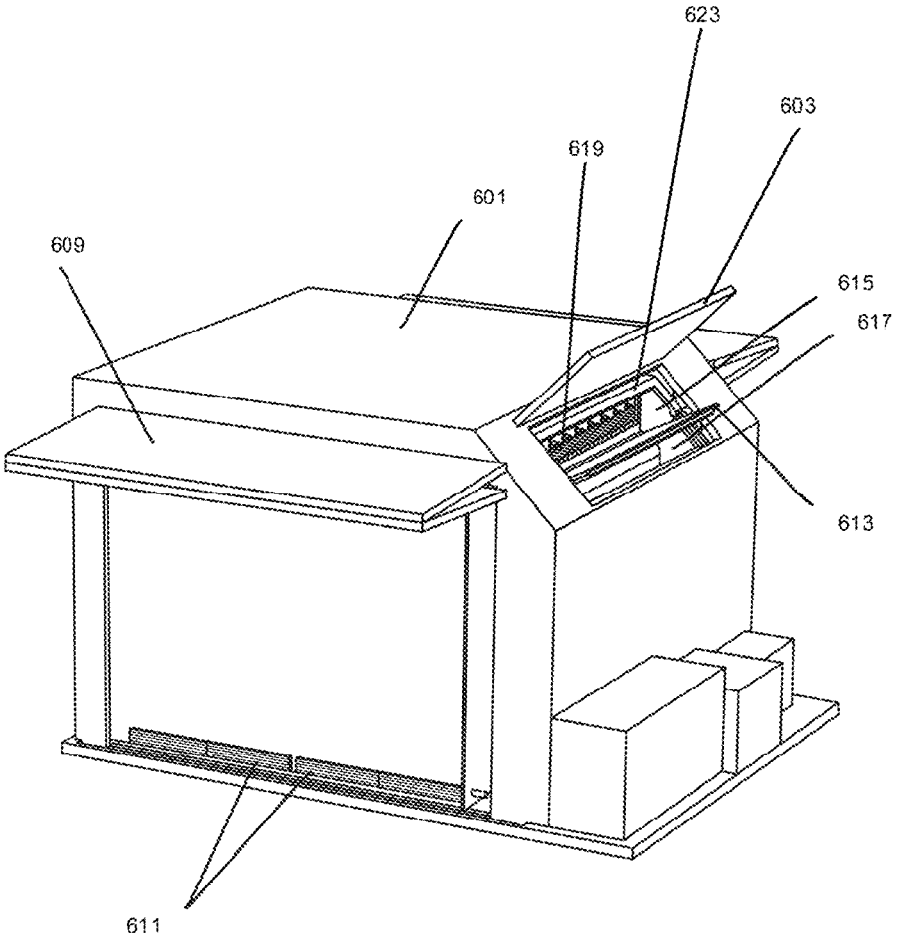
FIG. 6 provides an isometric view of the thermal storage unit with multiple vents closures open, according to some implementations.

In an OTSG implementation, a first end of the conduit can be fluidically coupled to a water source. The system may provide for inflow of the fluids from the water source into a first end of the conduit and enable outflow of the received fluid or steam from a second end of the conduit. The system can include one or more pumps configured to facilitate inflow and outflow of the fluid through the conduit. The system can include a set of valves configured to facilitate controlled outflow of steam from the second end of the conduit to a second location for one or more industrial applications or electrical power generation. As shown in FIG. 6, an HRSG may also be organized as a recirculating drum-type boiler with an economizer and optional superheater, for the delivery of saturated or superheated steam.

The output of the steam generator may be provided for one or more industrial uses. For example, steam may be provided to a turbine generator that outputs electricity for use as retail local power. The control system may receive information associated with local power demands, and determine the amount of steam to provide to the turbine, so that local power demands can be met.

In addition to the generation of electricity, the output of the thermal storage structure may be used for industrial applications as explained below. Some of these applications may include, but are not limited to, electrolyzers, fuel cells, gas generation units such as hydrogen, carbon capture, manufacture of materials such as cement, calcining applications, as well as others. More details of these industrial applications are provided below.

Dynamic Insulation

It is generally beneficial for a thermal storage structure to minimize its total energy losses via effective insulation, and to minimize its cost of insulation. Some insulation materials are tolerant of higher temperatures than others. Higher-temperature tolerant materials tend to be more costly.

Figure 5:
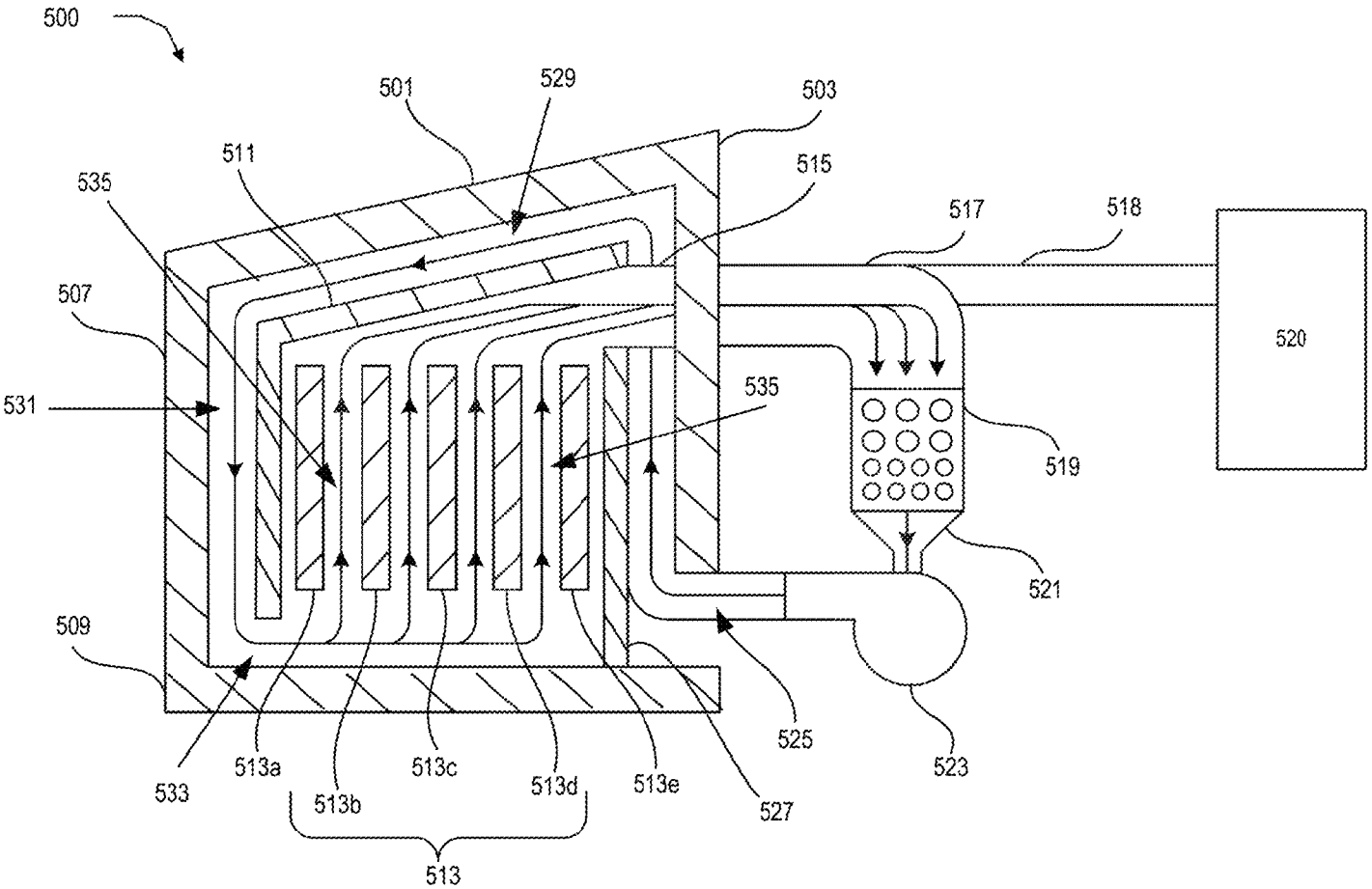
FIG. 5 illustrates dynamic insulation according to the example implementations.

FIG. 5 provides a schematic section illustration 500 of an implementation of dynamic insulation. The outer container includes roof 501, walls 503, 507 and a foundation 509. Within the outer container, a layer of insulation 511 is provided between the outer container and columns of bricks in stack 513, the columns being represented as 513*a*, 513*b*, 513*c*, 513*d* and 513*e*. The heated fluid that is discharged from the upper portion of the columns of bricks 513*a*, 513*b*, 513*c*, 513*d* and 513*e* exits by way of an output 515, which is connected to a duct 517. Duct 517 provides the heated fluid as an input to a steam generator 519. Once the heated fluid has passed through steam generator 519, some of its heat is transferred to the water in the steam generator and the stream of fluid is cooler than when exiting the steam generator. Further, the heated fluid may be used directly in an industrial process 520 that is configured to receive the heated fluid, as shown at 518. Cooler recycled fluid exits a bottom portion 521 of the steam generator 519. An air blower 523 receives the cooler fluid, and provides the cooler fluid, via a passage 525 defined between the walls 503 and insulation 527 positioned adjacent the stack 513, through an upper air passage 529 defined between the insulation 511 and the roof 501, down through side passages 531 defined on one or more sides of the stack 513 and the insulation 511, and thence down to a passage 533 directly below the stack 513.

The air in passages 525, 529, 531 and 533 acts as an insulating layer between (a) the insulations 511 and 527 surrounding the stack 513, and (b) the roof 501, walls 503, 507 and foundation 509. Thus, heat from the stack 513 is prevented from overheating the roof 501, walls 503, 507 and foundation 509. At the same time, the air flowing through those passages 525, 529, 531 and 533 carries by convection heat that may penetrate the insulations 511 and/or 517 into air flow passages 535 of the stack 513, thus preheating the air, which is then heated by passage through the air flow passages 535.

The columns of bricks 513*a*, 513*b*, 513*c*, 513*d* and 513*e* and the air passages 535 are shown schematically in FIG. 5. The physical structure of the stacks and air flow passages therethrough in embodiments described herein is more complex, leading to advantages.

In some implementations, to reduce or minimize the total energy loss, the layer of insulation 511 is a high-temperature primary insulation that surrounds the columns 513*a*, 513*b*, 513*c*, 513*d* and 513*e* within the housing. Outer layers of lower-cost insulation may also be provided. The primary insulation may be made of thermally insulating materials selected from any combination of refractory bricks, alumina fiber, ceramic fiber, and fiberglass or any other material that might be apparent to a person of ordinary skill in the art. The amount of insulation required to achieve low losses may be large, given the high temperature differences between the storage media and the environment. To reduce energy losses and insulation costs, conduits are arranged to direct returning, cooler fluid from the HRSG along the outside of a primary insulation layer before it flows into the storage core for reheating.

The cooler plenum, including passages 525, 529, 531 and 533, is insulated from the outside environment, but total temperature differences between the cooler plenum and the outside environment are reduced, which in turn reduces thermal losses. This technique, known as "dynamic insulation," uses the cooler returning fluid, as described above, to recapture heat which passes through the primary insulation, preheating the cooler air before it flows into the stacks of the storage unit. This approach further serves to maintain design temperatures within the foundation and supports of the thermal storage structure. Requirements for foundation cooling in existing designs (e.g., for molten salt) involve expensive dedicated blowers and generators—requirements avoided by implementations according to the present teaching.

The materials of construction and the ground below the storage unit may not be able to tolerate high temperatures, and in the present system active cooling—aided by the unassisted flowing heat exchange fluid in the case of power failure—can maintain temperatures within design limits.

A portion of the fluid returning from the HRSG may be directed through conduits such as element 521 located within the supports and foundation elements, cooling them and delivering the captured heat back to the input of the storage unit stacks as preheated fluid. The dynamic insulation may be provided by arranging the bricks 513*a*, 513*b*, 513*c*, 513*d* and 513*e* within the housing so that the bricks 513*a*, 513*b*, 513*c*, 513*d* and 513*e* are not in contact with the outer surface 501, 503, 507 of the housing, and are thus thermally isolated from the housing by the primary insulation formed by the layer of cool fluid. The bricks 513*a*, 513*b*, 513*c*, 513*d* and 513*e* may be positioned at an elevated height from the bottom of the housing, using a platform made of thermally insulating material.

During unit operation, a controlled flow of relatively cool fluid is provided by the fluid blowing units 523, to a region (including passages 525, 529, 531 and 533) between the housing and the primary insulation (which may be located on an interior or exterior of an inner enclosure for one or more thermal storage assemblages), to create the dynamic thermal insulation between the housing and the bricks, which restricts the dissipation of thermal energy being generated by the heating elements and/or stored by the bricks into the outside environment or the housing, and preheats the fluid. As a result, the controlled flow of cold fluid by the fluid blowing units of the system may facilitate controlled transfer of thermal energy from the bricks to the conduit, and also facilitates dynamic thermal insulation, thereby making the system efficient and economical.

In another example implementation, the buoyancy of fluid can enable an unassisted flow of the cold fluid around the bricks between the housing and the primary insulator 511 such that the cold fluid may provide dynamic insulation passively, even when the fluid blowing units 523 fail to operate in case of power or mechanical failure, thereby maintaining the temperature of the system within predefined safety limits, to achieve intrinsic safety. The opening of vents, ports, or louvres (not shown) may establish passive buoyancy-driven flow to maintain such flow, including cooling for supports and foundation cooling, during such power outages or unit failures, without the need for active equipment.

In the above-described fluid flow, the fluid flows to an upper portion of the unit, down the walls and into the inlet of the stacking, depending on the overall surface area to volume ratio, which is in turn dependent on the overall unit size, the flow path of the dynamic insulation may be changed. For example, in the case of smaller units that have greater surface area as compared with the volume, the amount of fluid flowing through the stack relative to the area may utilize a flow pattern that includes a series of serpentine channels, such that the fluid flows on the outside, moves down the wall, up the wall, and down the wall again before flowing into the inlet. Other channelization patterns may also be used.

Additionally, the pressure difference between the return fluid in the insulation layer and the fluid in the stacks may be maintained such that the dynamic insulation layer has a substantially higher pressure than the pressure in the stacks themselves. Thus, if there is a leak between the stacks and the insulation, the return fluid at the higher pressure may be forced into the leak or the cracks, rather than the fluid within the stacks leaking out into the dynamic insulation layer. Accordingly, in the event of a leak in the stacks, the very hot fluid of the stacks may not escape outside of the unit, but instead the return fluid may push into the stacks, until the pressure between the dynamic insulation layer in the stacks equalizes. Pressure sensors may be located on either side of the blower that provide relative and absolute pressure information. With such a configuration, a pressure drop within the system may be detected, which can be used to locate the leak.

Earlier systems that store high temperature sensible heat in rocks and molten salts have required continuous active means of cooling foundations, and in some implementations continuous active means of heating system elements to prevent damage to the storage system; thus, continuous active power and backup power supply systems are required. A system as described herein does not require an external energy supply to maintain the safety of the unit. Instead, as described below, the present disclosure provides a thermal storage structure that provides for thermally induced flows that passively cools key elements when equipment, power, or water fails. This also reduces the need for fans or other cooling elements inside the thermal storage structure.

Forecast-Based System Control

As noted above, forecast information such as weather predictions may be used by a control system to reduce wear and degradation of system components. Another goal of forecast-based control is to ensure adequate thermal energy production from the thermal energy storage system to the load or application system. Actions that may be taken in view of forecast information include, for example, adjustments to operating parameters of the thermal energy storage system itself, adjustments to an amount of input energy coming into the thermal energy storage system, and actions or adjustments associated with a load system receiving an output of the thermal energy storage system.

Weather forecasting information can come from one or more of multiple sources. One source is a weather station at a site located with the generation of electrical energy, such as a solar array or photovoltaic array, or wind turbines. The weather station may be integrated with a power generation facility, and may be operationally used for control decisions of that facility, such as for detection of icing on wind turbines. Another source is weather information from sources covering a wider area, such as radar or other weather stations, which may be fed into databases accessible by the control system of the thermal energy storage system.

Weather information covering a broader geography may be advantageous in providing more advanced notice of changes in condition, as compared to the point source information from a weather station located at the power source. Still another possible source of weather information is virtual or simulated weather forecast information. In general, machine learning methods can be used to train the system, taking into account such data and modifying behavior of the system.

As an example, historical information associated with a power curve of an energy source may be used as a predictive tool, taking into account actual conditions, to provide forecasting of power availability and adjust control of the thermal energy storage system, both as to the amount of energy available to charge the units and the amount of discharge heat output available. For example, the power curve information may be matched with actual data to show that when the power output of a photovoltaic array is decreasing, it may be indicative of a cloud passing over one or more parts of the array, or cloudy weather generally over the region associated with the array.

Forecast-related information is used to improve the storage and generation of heat at the thermal energy storage system in view of changing conditions. For example, a forecast may assist in determining the amount of heat that must be stored and the rate at which heat must be discharged in order to provide a desired output to an industrial application—for instance, in the case of providing heat to a steam generator, to ensure a consistent quality and amount of steam, and to ensure that the steam generator does not have to shut down. The controller may adjust the current and future output of heat in response to current or forecast reductions in the availability of charging electricity, so as to ensure across a period of future time that the state of charge of the storage unit does not reduce so that heat output must be stopped. By adjusting the continuous operation of a steam generator to a lower rate in response to a forecasted reduction of available input energy, the unit may operate continuously. The avoidance of shutdowns and later restarts is an advantageous feature: shutting down and restarting a steam generator is a time-consuming process that is costly and wasteful of energy, and potentially exposes personnel and industrial facilities to safety risks.

The forecast, in some cases, may be indicative of an expected lower electricity input or some other change in electricity input pattern to the thermal energy storage system. Accordingly, the control system may determine, based on the input forecast information, that the amount of energy that would be required by the thermal energy storage system to generate the heat desired to meet the demands of the steam generator or other industrial application is lower than the amount of energy expected to be available. In one implementation, making this determination involves considering any adjustments to operation of the thermal energy storage system that may increase the amount of heat it can produce. For example, one adjustment that may increase an amount of heat produced by the system is to run the heating elements in a thermal storage assemblage at a higher power than usual during periods of input supply availability, in order to obtain a higher temperature of the assemblage and greater amount of thermal energy stored. Such "overcharging" or "supercharging" of an assemblage, as discussed further below, may in some implementations allow sufficient output heat to be produced through a period of lowered input energy supply. Overcharging may increase stresses on the thermal storage medium and heater elements of the system, thus increasing the need for maintenance and the risk of equipment failure.

As an alternative to operational adjustments for the thermal energy storage system, or in embodiments for which such adjustments are not expected to make up for a forecasted shortfall of input energy, action on either the source side or the load side of the thermal energy storage system may be initiated by the control system. On the input side, for example, the forecast difference between predicted and needed input power may be used to provide a determination, or decision-support, with respect to sourcing input electrical energy from other sources during an upcoming time period, to provide the forecasted difference. For example, if the forecasting system determines that the amount of electrical energy to be provided from a photovoltaic array will be 70% of the expected amount needed over a given period of time, e.g., due to a forecast of cloudy weather, the control system may effectuate connection to an alternative input source of electrical energy, such as wind turbine, natural gas or other source, such that the thermal energy storage system receives 100% of the expected amount of energy. In an implementation of a thermal energy storage system having an electrical grid connection available as an alternate input power source, the control system may effectuate connection to the grid in response to a forecast of an input power shortfall.

In a particular implementation, forecast data may be used to determine desired output rates for a certain number of hours or days ahead, presenting to an operator signals and information relating to expected operational adjustments to achieve those output rates, and providing the operator with a mechanism to implement the output rates as determined by the system, or alternatively to modify or override those output rates. This may be as simple as a "click to accept" feedback option provided to the operator, a dead-man's switch that automatically implements the determined output rates unless overridden, and/or more detailed options of control parameters for the system.

II. Heat Transport in TSU: Bricks and Heating Elements

A. Problems Solved by One or More Disclosed Embodiments

Traditional approaches to the formation of energy storage cells may have various problems and disadvantages. For example, traditional approaches may not provide for uniform heating of the thermal energy storage cells. Instead, they may use structures that create uneven heating, such as hot spots and cold spots. Non-uniform heating may reduce the efficiency of an energy storage system, lead to earlier equipment failure, cause safety problems, etc. Further, traditional approaches may suffer from wear and tear on thermal energy storage cells. For example, stresses such as mechanical and thermal stress may cause deterioration of performance, as well as destabilization of the material, such as cracking of the bricks.

B. Example Solutions Disclosed Herein

In some implementations, thermal storage blocks (e.g., bricks) have various features that facilitate more even distribution. As one example, blocks may be formed and positioned to define fluid flow pathways with chambers that are open to heating elements to receive radiative energy. Therefore, a given fluid flow pathway (e.g., oriented vertically from the top to bottom of a stack) may include two types of openings: radiation chambers that are open to a channel for a heating element and fluid flow openings (e.g., fluid flow slots) that are not open to the channel. The radiation chambers may receive infrared radiation from heater elements, which, in conjunction with conductive heating by the heater elements may provide more uniform heating of an assemblage of thermal storage blocks, relative to traditional implementations. The fluid flow openings may receive a small amount of radiative energy indirectly via the chambers, but are not directly open to the heating element. The stack of bricks may be used alone or in combination with other stacks of bricks to form the thermal storage unit, and one or more thermal storage units may be used together in the thermal energy storage system. As the fluid blower circulates the fluid through the structure during charge and discharge as explained above, a thermocline may be formed in a substantially vertical direction. Further, the fluid movement system may direct relatively cooler fluid for insulative purposes, e.g., along the insulated walls and roof of the structure. Finally, a venting system may allow for controlled cooling for maintenance or in the event of power loss, water loss, blower failure, etc., which may advantageously improve safety relative to traditional techniques.

Designs according to the present disclosure combine several key innovations, which together address these challenges and enable a cost-effective, safe, reliable high-temperature thermal energy storage system to be built and operated. A carefully structured solid media system according to the present teaching incorporates structured airflow passages which accomplish effective thermocline discharge; repeated mixing chambers along the direction of air flow which mitigate the thermal effects of any localized air channel blockages or nonuniformities; effective shielding of thermal radiation from propagating in the vertical direction; and a radiation chamber structure which uniformly and rapidly heats brick material with high heater power loading, low and uniform exposed surface temperature, and long-distance heat transfer within the storage media array via multi-step thermal radiation.

Innovative structures according to the present disclosure may comprise an array of bricks that form chambers. The bricks have structured air passages, such that in the vertical direction air flows upwards in a succession of open chambers and small air passages. In some embodiments, the array of bricks with internal air passages is organized in a structure such that the outer surface of each brick within the TSU core forms a wall of a chamber in which it is exposed to radiation from other brick surfaces, as well as radiation originating from an electrical heater.

The chamber structure is created by alternating brick materials into a checkerboard-type pattern, in which each brick is surrounded on all sides by open chambers, and each open chamber has adjacent bricks as its walls. In addition, horizontal parallel passages are provided that pass through multiple chambers. Electrical heating elements that extend horizontally through the array are installed in these passages. An individual heating element it may be exposed along its length to the interior spaces of multiple chambers. Each brick within such a checkerboard structure is exposed to open chambers on all sides. Accordingly, during charging, radiant energy from multiple heating elements heats all outer surfaces of each brick, contributing to the rapid and even heating of the brick, and reducing reliance on conductive heat transfer within the brick by limiting the internal dimensions of the brick.

The radiation chamber structure provides a key advance in the design and production of effective thermal energy storage systems that are charged by electrical energy. The large surface area, which is radiatively exposed to heaters, causes the average temperature of the large surface to determine the radiation balance and thus the surface temperature of the heater. This intrinsic uniformity enables a high wattage per unit area of heater without the potential of localized overheating. And exposed brick surfaces are larger per unit of mass than in prior systems, meaning that incoming wattage per unit area is correspondingly smaller, and consequently thermal stresses due to brick internal temperature differences are lower. And critically, re-radiation of energy—radiation by hotter brick surfaces that is absorbed by cooler brick surfaces—reduces by orders of magnitude the variations in surface temperature, and consequently reduces thermal stresses in brick materials exposed to radiant heat. Thus, the radiation chamber design effectively enables heat to be delivered relatively uniformly to a large horizontally oriented surface area and enables high wattage per unit area of heater with relatively low wattage per unit area of brick.

Note that while this configuration is described in terms of "horizontal" and "vertical", these are not absolute degree or angle restrictions. Advantageous factors include maintaining a thermocline and providing for fluid flow through the stack in a direction that results in convective heat transfer, exiting the stack at a relatively hotter portion of the thermocline. An additional advantageous factor that may be incorporated is to position the stack in a manner that encourages buoyant, hot air to rise through the stack and exit at the hot end of the thermocline; in this case, a stack in which the hot end of the thermocline is at a higher elevation than the cold end of the thermocline is effective, and a vertical thermocline maximizes that effectiveness.

An important advantage of this design is that uniformity of heating element temperature is strongly improved in designs according to the present disclosure. Any variations in brick heat conductivity, or any cracks forming in a brick that result in changed heat conductivity, are strongly mitigated by radiation heat transfer away from the location with reduced conductivity. That is, a region reaching a higher temperature than nearby regions due to reduced effectiveness of internal conduction will be out of radiation balance with nearby surfaces, and will as a result be rapidly cooled by radiation to a temperature relatively close to that of surrounding surfaces. As a result, both thermal stresses within solid media, and localized peak heater temperatures, are reduced by a large factor compared to previous teachings.

The system may include one or more air blowing units including any combination of fans and, blowers, and configured at predefined positions in the housing to facilitate the controlled flow of air between a combination of the first section, the second section, and the outside environment. The first section may be isolated from the second section by a thermal barrier. The air blowing units may facilitate the flow of air through at least one of the channels of the bricks from the bottom end of the cells to the upper end of the cells in the first section at the predefined flow rate, and then into the second section, such that the air passing through the bricks and/or heating elements of the cells at the predefined flow rate may be heated to a second predefined temperature, and may absorb and transfer the thermal energy emitted by the heating elements and/or stored by the bricks within the second section. The air may flow from the second section across a steam generator or other heat exchanger containing one or more conduits, which carry a fluid, and which, upon receiving the thermal energy from the air having the second predefined temperature, may heat the fluid flowing through the conduit to a higher temperature or may convert the fluid into steam. Further, the system may facilitate outflow of the generated steam from the second end of the conduit, to a predefined location for one or more industrial applications. The second predefined temperature of the air may be based on the material being used in conduit, and the required temperature and pressure of the steam. In another implementation, the air leaving the second section may be delivered externally to an industrial process.

Additionally, the example implementations described herein disclose a resistive heating element. The resistive heating element may include a resistive wire. The resistive wire may have a cross-section that is substantially round, elongated, flat, or otherwise shaped to admit as heat the energy received from the input of electrical energy.

Passive Cooling

FIG. 6 provides an isometric view of the thermal storage unit with multiple vent closures open, according to some implementations. Therefore, FIG. 6 may represent a maintenance or failsafe mode of operation. As shown, the thermal storage unit also includes an inner enclosure 623. The outer surface of inner enclosure 623 and the inner surface of the outer enclosure define a fluid passageway through which fluid may be conducted actively for dynamic cooling or passively for failsafe operation.

Inner enclosure 623 includes two vents 615 and 617 which include corresponding vent closures in some implementations (portions of vent door 613, in this example). In some implementations, vents 615 and 617 define respective passages between an interior of the inner enclosure 623 and an exterior of the inner enclosure. When the external vent closure 603 is open, these two vents are exposed to the exterior of the outer enclosure as well.

As shown, vent 615 may vent heated fluid from the thermal storage blocks conducted by duct 619. The vent 617 may allow entry of exterior fluid into the fluid passageway and eventually into the bottoms of the thermal storage block assemblies via louvers 611 (the vent closure 609 may remain closed in this situation). In some implementations, the buoyancy of fluid heated by the blocks causes it to exit vent 615 and a chimney effect pulls external fluid into the outer enclosure via vent 617. This external fluid may then be directed through louvers 611 due to the chimney effect and facilitate cooling of the unit. Speaking generally, a first vent closure may open to output heated fluid and a second vent closure may open to input external fluid for passive venting operation.

During passive cooling, the louvers 611 may also receive external fluid directly, e.g., when vent closure 609 is open. In this situation, both vents 615 and 617 may output fluid from the inner and outer enclosures.

Vent door 613 in the illustrated implementation, also closes an input to the steam generator when the vents 615 and 617 are open. This may prevent damage to steam generator components (such as water tubes) when water is cut off, the blower is not operating, or other failure conditions. The vent 617 may communicate with one or more blowers which may allow fluid to passively move through the blowers even when they are not operating. Speaking generally, one or more failsafe vent closure may close one or more passageways to cut off fluid heated by the thermal storage blocks and reduce or avoid equipment damage.

When the vent door 613 is closed, it may define part of the fluid passageway used for dynamic insulation. For example, the fluid movement system may move fluid up along one wall of the inner enclosure, across an outer surface of the vent door 613, across a roof of the inner enclosure, down one or more other sides of the inner enclosure, and into the thermal storage blocks (e.g., via louvers 611). Louvers 611 may allow control of fluid flow into assemblages of thermal storage blocks, including independent control of separately insulated assemblages in some implementations.

In the closed position, vent door 613 may also define an input pathway for heated fluid to pass from the thermal storage blocks to duct 619 and beneath the vent door 613 into the steam generator to generate steam.

In some implementations, one or more of vent door 613, vent closure 603, and vent closure 609 are configured to open in response to a nonoperating condition of one or more system elements (e.g., nonoperation of the fluid movement system, power failure, water failure, etc.). In some implementations, one or more vent closures or doors are held in a closed position using electric power during normal operation and open automatically when electric power is lost or in response to a signal indicating to open.

In some implementations, one or more vent closures are opened while a fluid blower is operating, e.g., to rapidly cool the unit for maintenance.

Thermoelectric Power Generation

1. Problems to be Solved

Gasification is the thermal conversion of organic matter by partial oxidation into gaseous product, consisting primarily of $H_2$, carbon monoxide (CO), and may also include methane, water, $CO_2$ and other products. Biomass (e.g., wood pellets), carbon rich waste (e.g. paper, cardboard) and even plastic waste can be gasified to produce hydrogen rich syngas at high yields with high temperature steam, with optimum yields attained at >1000° C. The rate of formation of combustible gases are increased by increasing the temperature of the reaction, leading to a more complete conversion of the fuel. The yield of hydrogen, for example, increases with the rise of reaction temperature.

Turning waste carbon sources into a useable alternative energy or feedstock stream to fossil fuels is a potentially highly impactful method for reducing carbon emissions and valorizing otherwise unused carbon sources.

2. Thermoelectric Power Generation

Indirect gasification uses a Dual Fluidized Bed (DFB) system consisting of two intercoupled fluidized bed reactors—one combustor and one gasifier—between which a considerable amount of bed material is circulated. This circulating bed material acts as a heat carrier from the combustor to the gasifier, thus satisfying the net energy demand in the gasifier originated by the fact that it is fluidized solely with steam, i.e., with no air/oxygen present, in contrast to the classical approach in gasification technology also called direct gasification. The absence of nitrogen and combustion in the gasifying chamber implies the generation of a raw gas with much higher heating value than that in direct gasification. The char which is not converted in the gasifying chamber follows the circulating bed material into the combustor, which is fluidized with air, where it is combusted and releases heat which is captured by the circulating bed material and thereby transported into the gasifier in order to close the heat balance of the system.

Referring to FIG. 4, in some example implementations, the thermal energy storage structure 403 can be integrated directly with a steam power plant to provide an integrated cogeneration system 400 for a continuous supply of hot air, steam and/or electrical power for various industrial applications. Thermal storage structure 403 may be operatively coupled to electrical energy sources 401 to receive electrical energy and convert and store the electrical energy in the form of thermal energy. In some implementations, at least one of the electrical energy sources 401 may comprise an input energy source having intermittent availability. However, electrical energy sources 401 may also include input energy sources having on-demand availability, and combinations of intermittent and on-demand sources are also possible and contemplated. The system 403 can be operatively coupled to a heat recovery steam generator (HRSG) 409 which is configured to receive heated air from the system 403 for converting the water flowing through conduits 407 of the HRSG 409 into steam for the steam turbine 415. In an alternative implementation, HRSG 409 is a once-through steam generator in which the water used to generate steam is not recirculated. However, implementations in which the water used to generate steam is partially or fully circulated as shown in FIG. 4 are also possible and contemplated.

A control unit can control the flow of the heated air (and more generally, a fluid) into the HRSG 409, based on load demand, cost per KWH of available energy source, and thermal energy stored in the system. The steam turbine 415 can be operatively coupled to a steam generator 409, which can be configured to generate a continuous supply of electrical energy. Further, the steam turbine 415 can also release a continuous flow of relatively lower-pressure 421 steam as output to supply an industrial process. Accordingly, implementations are possible and contemplated in which steam is received by the turbine at a first pressure and is output therefrom at a second, lower pressure, with lower pressure steam being provided to the industrial process. Examples of such industrial process that may utilize the lower pressure output steam include (but are not limited to) production of liquid transportation fuels, including petroleum fuels, biofuel production, production of diesel fuels, production of ethanol, grain drying, and so on.

The production of ethanol as a fuel from starch and cellulose involves aqueous processes including hydrolysis, fermentation and distillation. Ethanol plants have substantial electrical energy demand for process pumps and other equipment, and significant demands for heat to drive hydrolysis, cooking, distillation, dehydrating, and drying the biomass and alcohol streams. It is well known to use conventional electric power and fuel-fired boilers, or fuel-fired cogeneration of steam and power, to operate the fuel production process. Such energy inputs are a significant source of $CO_2$ emissions, in some cases 25% or more of total $CO_2$ associated with total agriculture, fuel production, and transportation of finished fuel. Accordingly, the use of renewable energy to drive such production processes is of value. Some ethanol plants are located in locations where excellent solar resources are available. Others are located in locations where excellent wind and solar resources are available.

The use of electrothermal energy storage may provide local benefits in such locations to grid operators, including switchable electricity loads to stabilize the grid; and intermittently available grid electricity (e.g., during low-price periods) may provide a low-cost continuous source of energy delivered from the electrothermal storage unit.

The use of renewable energy (wind or solar power) as the source of energy charging the electrothermal storage may deliver important reductions in the total. $CO_2$ emissions involved in producing the fuel, as up to 100% of the driving electricity and driving steam required for plant operations may come from cogeneration of heat and power by a steam turbine powered by steam generated by an electrothermal storage unit. Such emissions reductions are both valuable to the climate and commercially valuable under programs which create financial value for renewable and low-carbon fuels.

The electrothermal energy storage unit having air as a heat transfer fluid may provide other important benefits to an ethanol production facility, notably in the supply of heated dry air to process elements including spent grain drying. One useful combination of heated air output and steam output from a single unit is achieved by directing the outlet stream from the HRSG to the grain dryer. In this manner, a given amount of energy storage material (e.g., brick) may be cycled through a wider change in temperature, enabling the storage of extra energy in a given mass of storage material. There may be periods where the energy storage material temperature is below the temperature required for making steam, but the discharge of heated air for drying or other operations continues.

In some implementations thermal storage structure 403 may be directly integrated to industrial processing systems in order to directly deliver heat to a process without generation of steam or electricity. For example, thermal storage structure 403 may be integrated into industrial systems for manufacturing lime, concrete, petrochemical processing, or any other process that requires the delivery of high temperature air or heat to drive a chemical process. Through integration of thermal storage structure 403 charged by VRE, the fossil fuel requirements of such industrial process may be significantly reduced or possibly eliminated.

The control unit can determine how much steam is to flow through a condenser 419 versus steam output 421, varying both total electrical generation and steam production as needed. As a result, the integrated cogeneration system 400 can cogenerate steam and electrical power for one or more industrial applications.

If implemented with an OTSG as shown in FIG. 3 instead of the recirculating HRSG shown in FIG. 5, the overall integrated cogeneration system 400 can be used as thermal storage once-through steam generator (TSOTG) which can be used in oil fields and industries to deliver wet saturated steam or superheated dry steam at a specific flow rate and steam quality under automated control. High temperature delivered by the bricks and heating elements of the system 403 can power the integrated heat recovery steam generator (HRSG) 409. A closed air recirculation loop can minimize heat losses and maintain overall steam generation efficiency above 98%.

The HRSG 409 can include a positive displacement (PD) pump 411 under variable frequency drive (VFD) control to deliver water to the HRSG 409. Automatic control of steam flow rate and steam quality (including feed-forward and feed-back quality control) can be provided by the TSOTG 400. In an exemplary example implementation, a built-in Local Operator Interface (LOI) panel operatively coupled to system 400 and the control unit can provide unit supervision and control. Further, thermal storage structure 403 can be connected to a supervisory control and data acquisition system (SCADA)) associated with the steam power plant (or other load system). In one implementation, a second electrical power source is electrically connected to the steam generator pumps, blowers, instruments, and control unit.

In some implementations, system 400 may be designed to operate using feedwater with substantially dissolved solids; accordingly, a recirculating boiler configuration is impractical. Instead, a once-through steam generation process can be used to deliver wet steam without the buildup of mineral contaminants within the boiler. A serpentine arrangement of conduits 407 in an alternative once-through configuration of the HRSG 409 can be exposed to high-temperature air generated by the thermal storage structure 403, in which preheating and evaporation of the feedwater can take place consecutively. Water can be forced through the conduits of HRSG 409 by a boiler feedwater pump, entering the HRSG 409 at the "cold" end. The water can change phase along the circuit and may exit as wet steam at the "hot" end. In one implementation, steam quality is calculated based on the temperature of air provided by the thermal storage structure 403, and feedwater temperatures and flow rates, and is measured based on velocity acceleration at the HRSG outlet. Embodiments implementing a separator to separate steam from water vapor and determine the steam quality based on their relative proportions are also possible and contemplated.

In the case of an OTSG implementation, airflow (or other fluid flow) can be arranged such that the hottest air is nearest to the steam outlet at the second end of the conduit. An OTSG conduit can be mounted transversely to the airflow path and arranged in a sequence to provide highly efficient heat transfer and steam generation while achieving a low cost of materials. As a result, other than thermal losses from energy storage, steam generation efficiency can reach above 98%. The prevention of scale formation within the tubing is an important design consideration in the selection of steam quality and tubing design. As water flows through the serpentine conduit, the water first rises in temperature according to the saturation temperature corresponding to the pressure, then begins evaporating (boiling) as flow continues through heated conduits.

As boiling occurs, volume expansion causes acceleration of the rate of flow, and the concentration of dissolved solids increases proportionally with the fraction of liquid phase remaining. Maintaining concentrations below precipitation concentration limits is an important consideration to prevent scale formation. Within a bulk flow whose average mineral precipitation, localized nucleate and film boiling can cause increased local mineral concentrations at the conduit walls. To mitigate the potential for scale formation arising from such localized increases in mineral concentration, conduits which carry water being heated may be rearranged such that the highest temperature heating air flows across conduits which carry water at a lower steam quality, and that heating air at a lower-temperature flows across the conduits that carry the highest steam quality flow.

Returning to FIG. 6, various implementations are contemplated in which a fluid movement device moves fluid across a thermal storage medium, to heat the fluid, and subsequently to an HRSG such as HRSG 409 for use in the generation of steam. In one implementation, the fluid is air. Accordingly, air circulation through the HRSG 409 can be forced by a variable-speed blower, which serves as the fluid movement device in such an embodiment. Air temperature can be adjusted by recirculation/mixing, to provide inlet air temperature that does not vary with the state of charge of the bricks or other mechanisms used to implement a thermal storage unit. The HRSG 409 can be fluidically coupled to a steam turbine generator 415, which upon receiving the steam from the HRSG 409, causes the production of electrical energy using generator 417. Further, the steam gas turbine 415 in various embodiments releases low-pressure steam that is condensed to a liquid by a condenser 419, and then de-aerated using a deacrator 413, and again delivered to the HRSG 409.

III. Thermal Energy Storage for Industrial Applications

Thermal Energy Storage with a Radiant Energy Emitting Surface

Figure 7:
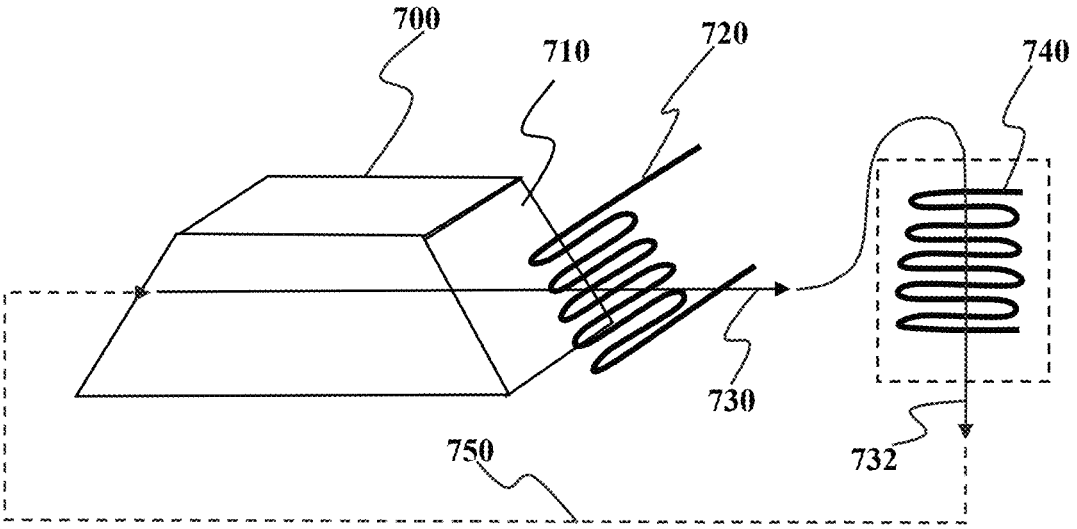
FIG. 7 illustrates a TES system with a radiant energy receiving structure according to at least one implementation described herein.

FIG. 7 illustrates one implementation of a Thermal Energy Storage (TES) 700, incorporating at least one radiant energy emitting surface 710 and at least one radiant energy receiving structure such as tubing 720 with a gas flow pathway as represented by arrow 730. After the initial passage of hot gas or fluid through the storage medium in TES 700, the hot gas or fluid is subsequently channeled as indicated by arrow 732 through one or more additional structures such as pipes that may constitute a component of a heat exchanger (HEX) 740 in a variety of different systems, notably but not limited to a Heat Recovery Steam Generator (HRSG) as shown in phantom by the dashed-line rectangle. This setup facilitates extraction of high temperature heat from the thermal energy storage medium by means of radiation from the emitting surface 710 serving as a radiant energy emitter to a fluid passing through radiant energy receiving tubes 720 and then subsequently the further extraction of heat by convection through the flow of gas or fluid from the TES medium to heat exchanger 740. FIG. 7 also shows a return flow 750 (shown in phantom) for returning the outlet flow from the HEX 740 back to the TES 700. Optionally, some implementations may exhaust the outflow from the HEX 740 and not return the flow back to the TES 700.

Figure 7A:
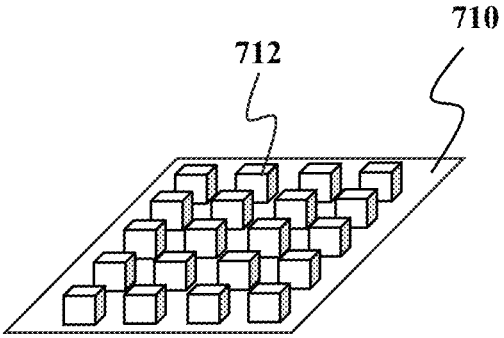
FIGS. 7A and 7B illustrate surface shapes for improving emission of radiant energy according to implementations as described herein

In one implementation, the radiant energy emitting surface 710 may have enhanced thermal emissivity through which convective flow transfers heat to that surface 710 which is then delivered as radiation to receiving structures 720. Some implementations of surface 710 may include one or more of the following: bulk emitters, naturally selective emitters, photonic crystals, 2D photonic crystals, and multilayer stacks. Other examples may be found in "Practical emitters for thermophotovoltaics: a review" R Sakakibara, Journal of Photonics for Energy, Vol. 9, Issue 3, 032713 (February 2019). https://doi.org/10.1117/1.JPE.9.032713 fully incorporated herein by reference for all purposes. FIG. 7A shows that the emitting surface 710 may be shaped to include multiple protrusions 712 that are configured to enhance radiant energy emissions. In this implementation, the protrusions 712 are shown to be cubic in shape. It should be understood that other suitable shapes are not excluded. Optionally, some implementations may use a pyramid shape. Optionally, some implementations may use a spheroidal shape. Optionally, some implementations may use two or more different shapes for the protrusion 712. Optionally, some implementations may use two or more different sizes for the protrusion 712.

Figure 7B:
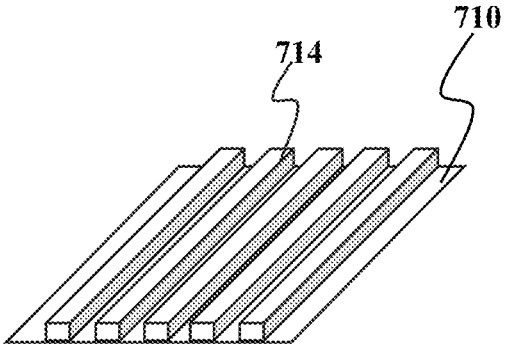

FIG. 7B shows another implementation where the emitting surface 710 is shaped to include multiple ridges 714 that are configured to enhance radiant energy emissions. The ridges 714 may be parallel to one another as shown in FIG. 7B. Optionally, the ridges 714 may be oriented at different angles so that the ridges 714 intersect one another. Some implementations may have ridges 714 all of the same height relative to plane of surface 710. Some implementations may have ridges 714 of two or more heights relative to plane of surface 710. Optionally, some implementations may have indentations and/or ridges in a predetermined pattern on the emitting surface 710. Optionally, some may have areas around the perimeter or other select areas of emitter surface 710 without indentations or protrusions.

These structures 712 and 714 may be created as part of the mold or forms used to manufacture the thermal energy storage medium. Optionally, some may create the structures 712 and 714 using laser etching or suitable techniques for roughening or shaping the thermal energy storage medium. Although some of the above structures 712 and 714 are shown as protrusions, it should be understood that some implementations may use indentations instead of protrusions on the emitting surface 710.

In one implementation as seen in FIG. 7, there are structures such as radiant energy receiving structures 720 opposite the emitting surface 710 for receiving the radiant thermal energy from the emitting surface 710. These structures 720, notably tubes in the current implementation, may experience temperatures as high as 1000° C. or more, whereas pipes or structures in the HEX 740 encounter comparatively lower temperatures as they are downstream from the tubes 720 in this particular implementation. The structures 720 may also include one or more of the features described above for emitting surface 710 to improve the ability of the receiving structure 720 to receive radiant energy. To withstand the higher temperatures, the material for the radiant energy receiving structures 720 could withstand temperatures between about 1000° C. to 2000° C. Optionally, the material may be selected to withstand temperatures between about 1000° C. to 1500° C.

Figure 8:
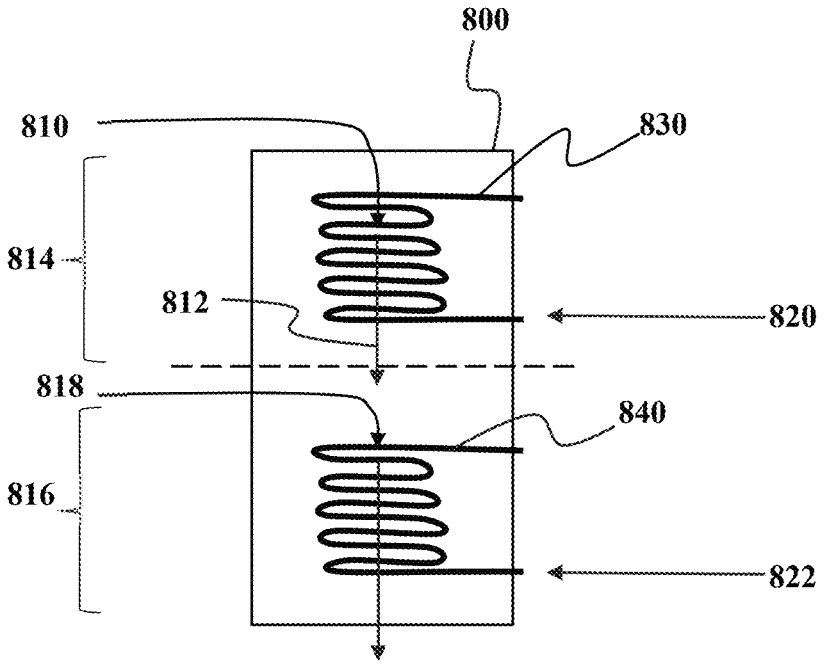
FIG. 8 illustrates a cross-sectional view of a heat exchanger according to at least one implementation described herein.

FIG. 8 demonstrates another implementation of a HEX 800 with multiple inlets. A first working fluid inlet flow is represented by arrow 810. Additionally, arrow 812 shows an exhaust of flow 810 exiting the first HEX stage 814 and entering the second HEX stage 816 at a temperature lower than the inlet temperature of flow 810. Optionally, additional bypass flow 818 may be mixed with the exhaust flow 812 to further adjust the temperature of the flow for the second HEX stage 816. Although only two stages are shown here for the HEX 800, it should be understood that the HEX may have one or more additional stages.

Arrow 820 denotes inlet flow of a fluid that is to be heated in the first HEX section piping 830, and arrow 822 denotes inlet flow of a fluid that is to be heated in the second HEX section piping 840 at a lower temperature than the fluid is heated to in piping 830. The HEX 800 may be configured as a multi-stage system, which includes a section for receiving hotter gas 810 and another lower temperature section for receiving cooler gas 818. The piping 830 in the first HEX section 814 receives heat at elevated temperatures before optionally blending that flow with the cooler gas flow, while the structure 830 situated in the second section handles lower-temperature source of heat. To withstand these higher temperatures, the material for the structure 830 in the first HEX section 814 could include but is not limited to a nickel-chromium alloy or an Inconel® alloy, among other similar materials. Conversely, the material for the structure 840 in the second HEX stage 816 which is subjected to lower temperatures, may be but is not limited to, carbon steel or other suitable material(s).

Figure 9:
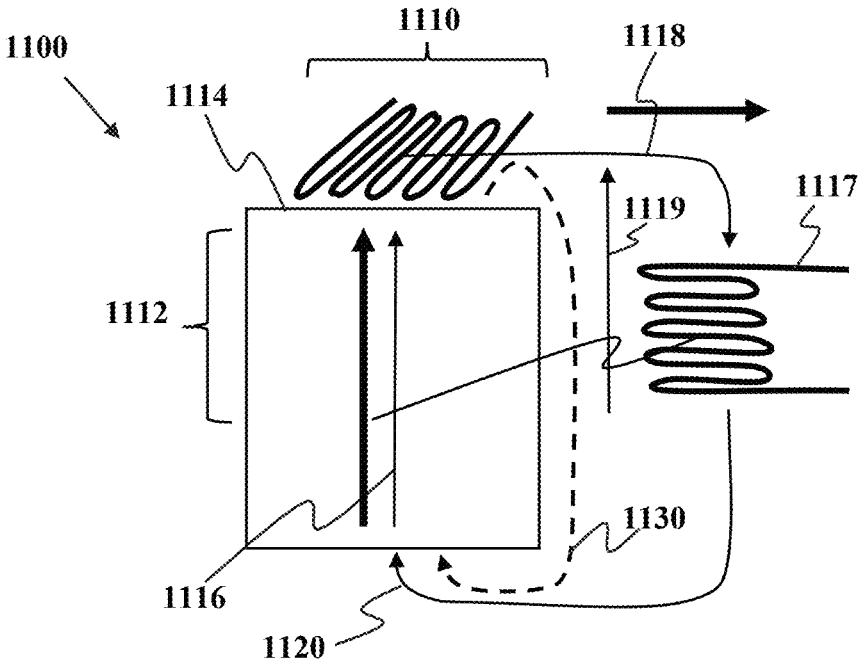
FIG. 9 illustrates a TES system with multiple possible fluid flow pathways according to at least one implementation described herein.

FIG. 9 portrays a lead-lag configuration involving at least two thermal energy storage media 900 and 902. In an exemplary implementation, one of the thermal energy storage media is undergoing deep discharge while the other operates at a working temperature for the system. This arrangement may include a bypass gas or fluid flow 910, as well as a hotter temperature gas or fluid flow 920 from one storage medium and cooler gas or fluid flow 922 from another storage medium, which are mixed in the HEX 930. Optionally, there may also be an additional higher temperature heat exchanger preceding the HEX 930. This extra heat exchanger could either be a flowing gas type or a direct radiation heat exchanger, and it could potentially employ a cascade design as seen for HEX 800 in FIG. 8.

Reheating a Radiant Energy Emitting Surface

FIG. 9 presents an implementation of a TES system 1100, featuring structures 1110 such as piping or reaction vessels designed to receive radiant energy from an emitting surface 1114 of the TES 1100. The upper portion of the TES 1100 may include at least one radiant energy emitting surface 1114. This radiant energy emitting surface 1114 releases heat via radiation, thereby cooling the emitting surface 1114 as heat is released to the receiving structure 1110. However, as discussed in more detail further below, the thermal storage medium with the emitting surface 1114 is also being reheated by the gas or fluid passing or flowing through the TES 1100. Optionally, some implementations may have multiple radiant energy emitting surfaces 1114, depending on the shape and/or number of thermal storage blocks used for the TES 1100.1

In one implementation, the radiant energy emitting surface 1114 is being heated or reheated by flow or heat from elsewhere in the TES 1100, resulting in the emitting surface 1114 becoming a high temperature and/or constant temperature radiation heat source. The system may be configured to reach a steady state where the surface cooling through radiant emission from the emitting surface 1114 is balanced by reheating provided by active gas or fluid flow through the TES medium to, through, or adjacent the emitting surface 1114. During an operating period for the TES 1100, this implementation maintains a constant and/or a high temperature within a set temperature range for a radiant energy emitting surface 1114 that emits heat due to radiation but is also reheated by gas, fluid, or other medium associated with the TES 1100. In this manner, this non-limiting implementation of the TES 1100 provides an isothermal radiation heat source. The radiant energy source is being cooled by radiation while simultaneously being reheated by convection that transports heat from another portion of the thermal storage medium to the emitting surface 1114. Alternatively, or supplementarily, some implementations may position structures such as but not limited to thermal photovoltaic (TPV) cells opposite the thermal energy emitting surface 1114 to receive thermal energy alone or combination with the pipes or other structure already receiving radiant energy.

Optionally, in some implementations, the radiant energy receiving structure 1110 may be shaped to improve its heating by convection while also retaining its ability to be heated by radiation. Optionally, the radiant energy receiving structure 1120 heated by radiation from emitting surface 1114 may also be warmed by convection from heated gas or fluid flow from the TES 1100 and/or another source. Optionally, in some implementations, the radiant energy emitting surface 1114 is not a flat surface but is shaped to provide improved thermal output. Optionally, the surface of the receiving structure 1120 may have a rough surface texture, such as with micro-scale roughness to create more interaction points with incoming radiation, enhancing absorption compared to a smooth surface. Processes like etching, machining, or laser ablation can create textured surfaces on various materials. Optionally, the receiving structure 1120 may be configured to have selective absorption that can selectively absorb radiation within a specific wavelength range, allowing for targeted heat capture. Optionally, the receiving structure 1120 may be configured to have black paint or coatings with high emissivity across the infrared spectrum. Optionally, the receiving structure 1120 may be configured to have a nanostructured surfaces utilizing nanoparticles or nano-scale features to manipulate light interaction and enhance absorption. Optionally, the receiving structure 1120 may be configured to have metal oxide coatings where certain metal oxides like black chrome or nickel oxide can exhibit high emissivity in the infrared range. Optionally, the receiving structure 1120 may be configured to have metamaterials which are engineered structures with unique electromagnetic properties that can be designed to optimize radiation absorption.

The TES 1100 may use a vertical stack of refractory material as the TES medium, with an upward gas or fluid flow as depicted by arrow 1116. It is noted, however, that this TES medium can also be reconfigured into a horizontal stack of refractory material with horizontal gas or fluid flow similar to that of FIG. 7. Optionally, other implementations may have the flow at an angle somewhere between vertical or horizontal through the TES medium. The implementations may have the TES medium heated by radiation to the TES medium and cooled by convection. Such implementations are not limited to a particular angle of the flow through the TES medium. In at least one implementation, the emitting surface 1114 may be heated by convection and cooled by radiation.

In one described implementation, the thermal energy storage medium may maintain at least one of its surfaces at a high temperature output throughout its discharge cycle. This consistent output is achieved regardless of whether the output surface is located atop the vertical stack as shown in FIG. 9, along the side of a horizontal stack as shown in FIG. 7, or oriented at another angle relative horizontal or vertical. In one example, the output temperature remains stable due to the input flow rate, which creates and sustains a thermocline that reheats the radiant energy emitting surface being cooled by radiant emission.

This radiant energy emitting surface can be configured to enable high-temperature applications such as but not limited to output temperatures of around 1300° C. or even higher. Ethylene crackers and other high-temperature industrial processes can significantly benefit from radiation at temperatures close to 1350° C. or more. A TES system that is outputting heat at 1350° C. could power the ethylene cracker and its conventional cracker tube.

With these elevated temperatures, some implementations of the TES may prefer a low return gas or fluid temperature back into the thermal storage medium. In some implementations, this stems in part from a desire to extract more heat from the flowing gas before it is redirected back into the thermocline of the TES unit, thereby increasing the utilization of stored energy within the TES system. More heat can be extracted from the TES unit if the return temperature of the gas or fluid is lower than if it returned at a higher temperature. This effectively increases the accessible thermal storage capacity of the TES. Additionally, some thermal storage media have a preference of a return gas or fluid temperature in a selected temperature range. Having the ability extract additional heat from the gas or fluid can be beneficial for overall system efficiency and for ensuring a return temperature in the desired range.

In various implementations, the system is configured to provide alternative uses for lower-temperature heat delivered by flowing gas 1118 that exits the thermal storage medium after reheating the emitting surface 1114. This use of lower temperature heat is sought in order to increase the amount of heat extracted from the flowing gas 1050 prior to its return into the thermocline of the thermal energy storage unit. This arrangement ensures that the stored energy within the TES system can be efficiently utilized and optimized for maximum effectiveness.

Another optional approach involves using gas or fluid from a thermal storage medium for radiant heat extraction, with the slightly lower temperature air or fluid then being returned to the stack of the TES unit without undergoing a secondary heat use. Although this may result in a high return temperature, some thermal energy storage systems can be configured to handle such higher return temperatures.

For any of the TES systems described herein, the system can be used with an inert gas or fluid with the TES medium. The TES system may also use graphite heaters if used with an inert gas environment. Optionally, some embodiments may also use graphite or similar material as the TES medium. In some implementations, the TES system may use ceramic heaters or heaters formed from other suitable materials for heating the TES medium.

For any of the TES system described herein, some implementations may use an active blower to move gas or fluid through the TES system. Optionally, some may be passive and use the buoyancy of the gas or fluid to move the gas or fluid through the TES system. Optionally, some implementations may bring the gas or fluid to the TES system and then heat the gas or fluid with the thermal storage medium. This heating can be direct exposure of the gas or fluid to the thermal storage medium or it may expose the gas or fluid to heating structures such as pipes or tubes carrying the gas or fluid. In some systems, a gate, valve, louver, door, or other system can control the exposure of the gas or fluid to the thermal storage medium to control the heat transfer.

FIG. 9 shows a schematic view of an implementation of a TES system 1100 where a radiant energy receiving section 1110 absorbs radiation, while a cool-to-hot thermocline or thermal gradient 1112 progresses through the TES medium. Heated gas flows along path 1116 to help maintain the radiant energy emitting surface 1114 within a desired temperature range using heat derived from elsewhere within the thermal storage medium to replenish heat dissipated through radiation from emitting surface 1114.

Continuing with the implementation of FIG. 9, flow path 1118 traverses at least a portion of radiant energy receiving section 1110 and may be optionally blended with cooler air 1119 before being directed to a second heat use such as but not limited to an HEX represented by tubing 1117. The gas or fluid then returns as cooler gas or fluid 1120 back to the TES system. Alternatively, there is an implementation in which the gas is returned directly to the thermal storage medium via pathway 1130 (shown in phantom) without going through a secondary use. The gas in pathway 1130 is at a higher temperature than that of the gas on pathway 1120 which has been further cooled such as by a second thermal use such as but not limited to a HEX having tubing 1117.

TES with Multiple Storage Media

Figure 10:
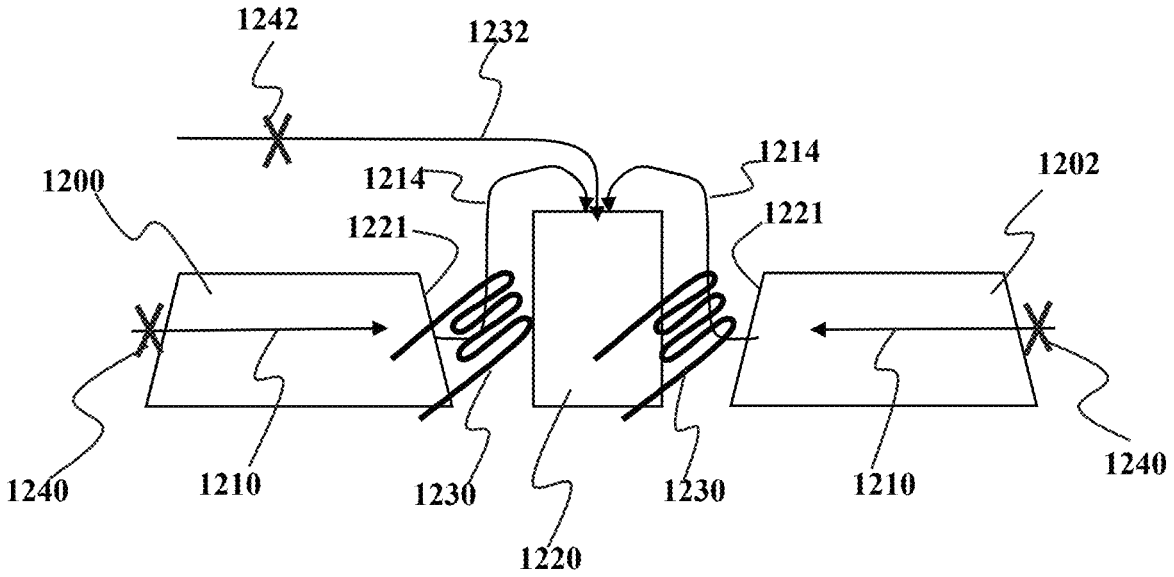
FIG. 10 illustrates a TES system with multiple storage media according to at least one implementation described herein.

FIG. 10 illustrates a TES system with at least two TES media 1200 and 1202 with gas or fluid flowing horizontally through each TES medium as indicated by arrows 1210. In one implementation, the gas or fluid is then directed to flow upward and then downward as shown by arrows 1214 into a shared HEX 1220. A set of radiant energy receiving structures 1230 such as pipes, TPV cells, or reaction vessels may be positioned opposite a radiating surface 1221 of the storage mediums to receive radiant energy from the radiating surface of the storage media. In some implementations, there may be bypass channel(s) providing one or more flows 1232 to HEX 1220 for adjusting the temperature blend to a desired range and/or to extract additional heat from another energy source such as waste heat from a process. Louvers 1240 can be situated at one end of the TES system 1200 to regulate fluid flow through the TES 1200. In one implementation, these louvers are moving parts located away from the "hot" end of the TES system receiving flow 1210 and thus these moving parts are at a temperature lower than a hot end of the TES system. A louver 1242 may also be positioned to control flow through bypass pathway(s) before blending with the other flows. The configuration shown in FIG. 12 can also be used to perform a lead-lag operation using the second TES 1202 that joins with flow 1214. Optionally, the TES system 1200 may be operated where multiple sections of piping 1230 are not heated simultaneously. Alternatively, the system 1200 can heat two or more sections of piping 1230 concurrently.

Figure 11:
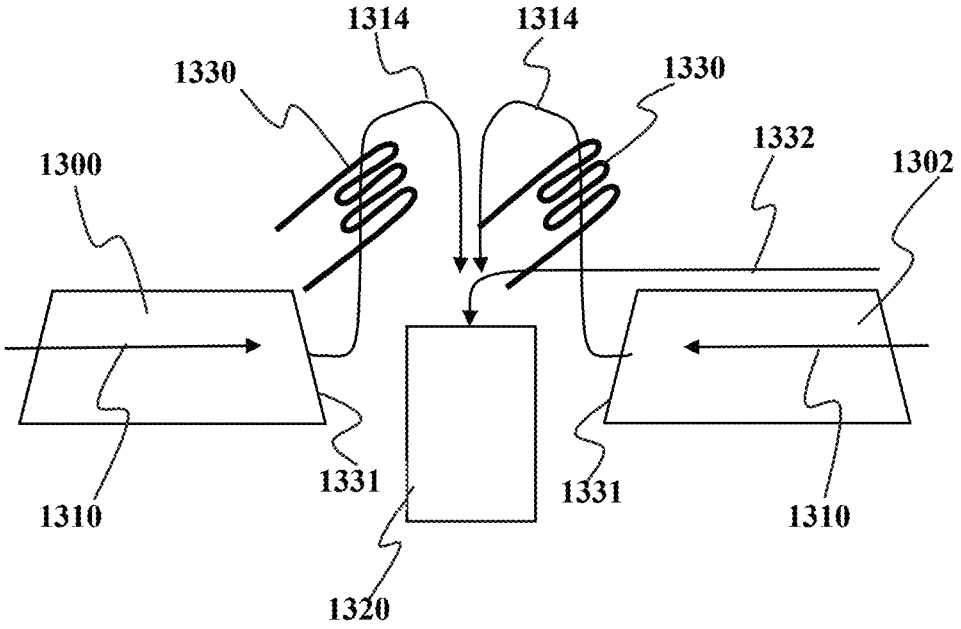
FIG. 11 illustrates a TES system with multiple storage media according to at least one implementation described herein.

FIG. 11 depicts a version of TES system 1300 with gas or fluid flowing horizontally as indicated by arrows 1310. In one implementation, the gas or fluid is directed to flow upward and then downward as shown by arrows 1314 into a heat exchanger 1320. A set of pipes 1330 may be positioned opposite the storage medium to receive radiant energy from a radiating surface 1331 of the storage medium. Similar to FIG. 12, there can be a cooling flow 1332 that may be a bypass gas or other less-heated gas or fluid blended with the flow. The heat exchanger 1320 can be utilized for industrial purposes such as but not limited to steam cracking, ethylene cracking, steam methane reformer (SMR), sustainable aviation fuel (SAF), and $CO_2$+$H_2$ production.

Gas Turbine Power Generation

Figure 12:
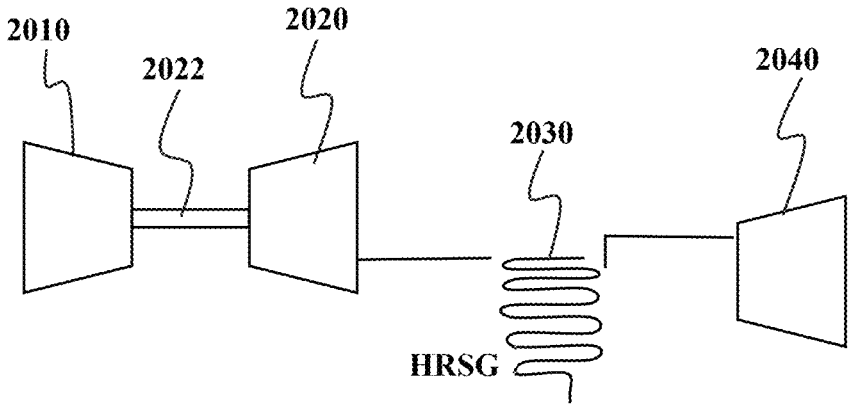
FIGS. 12-13 illustrate gas turbine power generation systems according to implementations described herein.

FIG. 12 shows an exemplary gas turbine power generation system featuring a gas turbine with a compression stage 2010 and an expansion stage 2020 on the same shaft 2022. The waste heat is directed through a HEX such as an HRSG 2030, which subsequently drives a steam turbine 2040. Combining these elements can result in overall efficiency exceeding approximately 50%, translating to efficient conversion of thermal energy to electrical power.

Figure 13:
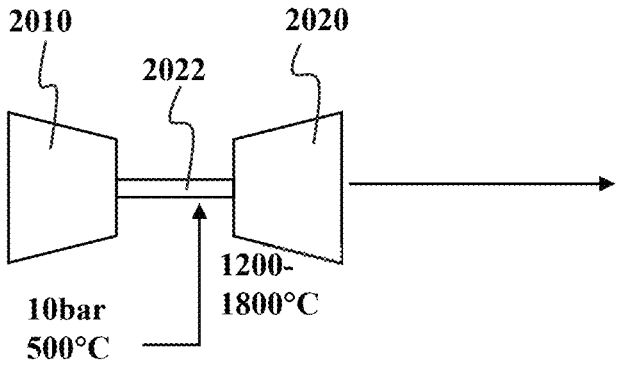

FIG. 13 illustrates an example of a gas turbine system designed to elevate the temperature of incoming gas by compressing it to a pressure such as about 10 bar or higher and heating it to about 500° C. or higher using a heat source, notably but not limited to a TES. The high-pressure, heated gas is then passed through an expander turbine for energy recovery. This implementation could involve the integration of gas or fluid from the TES with the primary gas flow within the system to enhance overall performance and efficiency.

Figure 14:
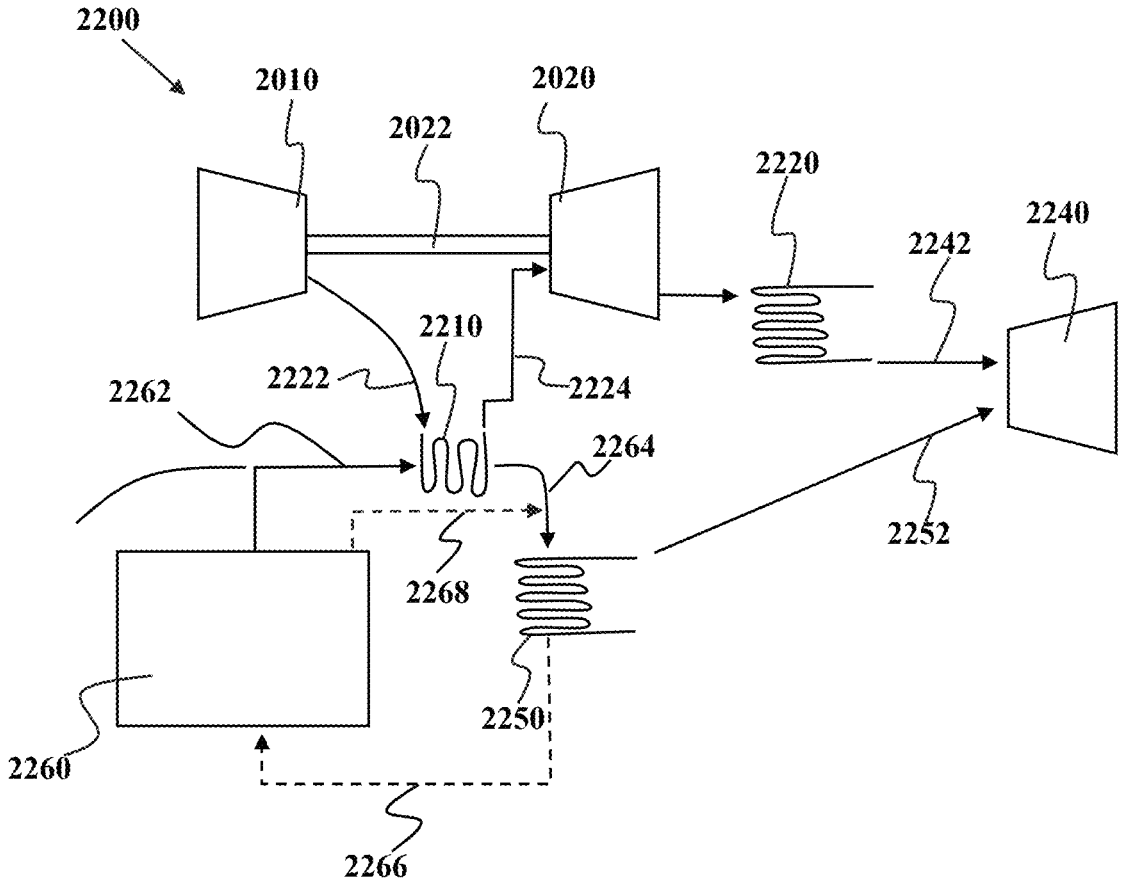
FIGS. 14-14A illustrate gas turbine power generation systems with a TES system according to implementations described herein.

FIG. 14 illustrates one implementation of a TES system where a high-temperature heat exchanger 2210 and a low-temperature heat exchanger 2220 are combined with a gas turbine system 2200. The system may optionally include a firebox in fluid communication with at least one of the heat exchangers. The gas from the turbine 2200 flows outward, as indicated by arrow 2222, through the low-temperature heat exchanger 2220 and is subsequently directed back up through the high-temperature heat exchanger 2210, as indicated by arrow 2224. This heated gas then drives an expander turbine 2020. The thermal energy generated from the expander turbine 2020 heats the low-temperature heat exchanger 2220, which can be used to produce steam that powers a steam turbine generator (STG) 2240 via flow 2242. In this configuration, there is a first use of heat via flow 2262 from the TES unit 2260 driving the gas turbine system 2200, followed by a second use of heat via flow 2264 at another structure, notably heat exchanger 2250, that also drives the steam turbine generator (STG) 2240, as indicated by arrow 2252. The flows 2242 and 2252 may be combined prior to entering the STG 2240, or optionally, the STG 2240 may have an inlet for each of the flows 2242 and 2252. The flow 2266 (shown in phantom) can then be returned to the TES unit 2260 or directed elsewhere in the system. The TES unit 2260 can also supply heat to the high-temperature heat exchanger 2210. The high temperature heat exchanger 2210 may feature a ceramic heat exchanger capable of withstanding high pressures. In another variation instead of ceramic, the heat exchanger could be made from a high alloy such as but not limited to a nickel-chromium alloy or any other suitable material. Although turbine 2200 is described as a gas turbine, some other implementations may use a different type of turbine or power generation device in place of turbine 2200. Optionally, the compression stages 2010 and 2020 may be part of the same turbine 2200 or they may be separate turbines and not stages of the same turbine.

Figure 14A:
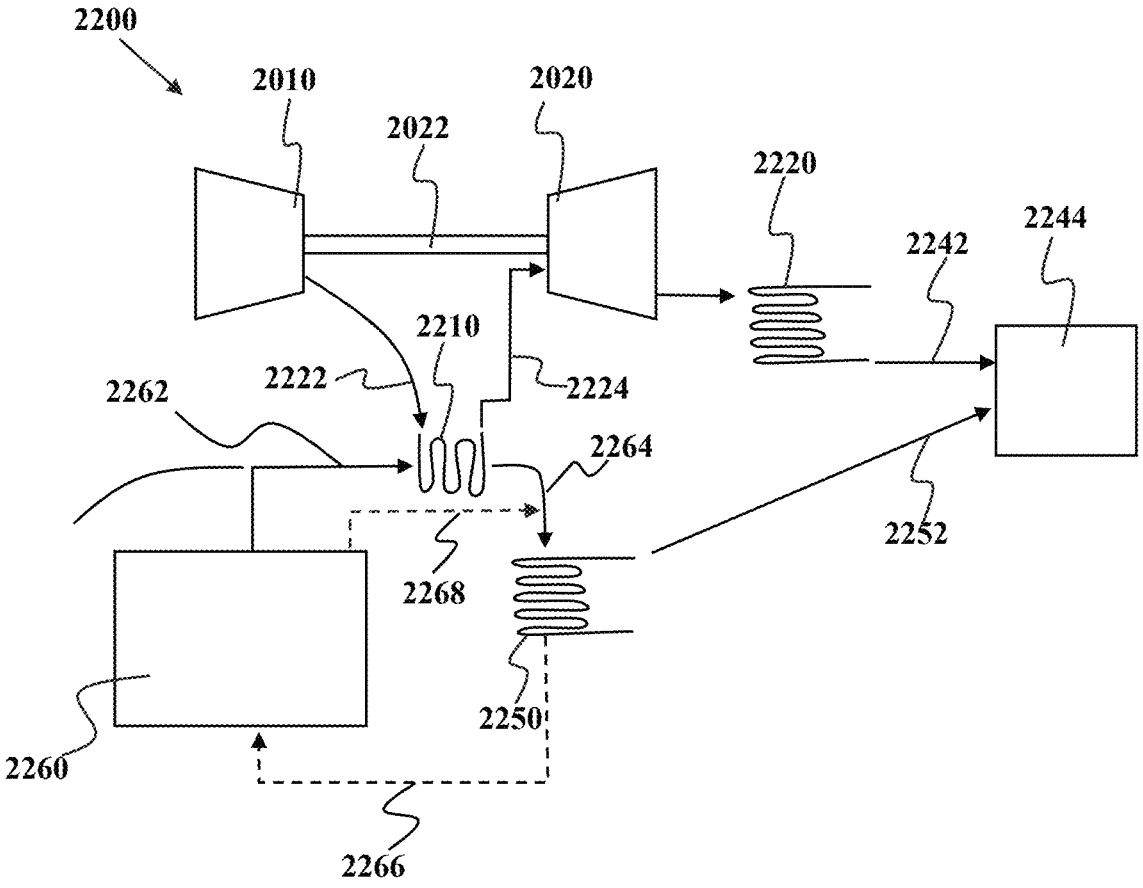

FIG. 14 also shows that in some implementations, there may be an additional flow 2268 that directs some output from the TES unit 2260 to heat the flow 2264 to a higher temperature. Optionally, the additional flow 2268 can be directed to the heat exchanger 2250. This additional flow 2268 may be used to provide additional heat should the FIG. 14A shows a still further implementation where instead of STG 2240, an industrial use or industrial load 2242 is positioned to receive the flows 2242 and 2252.

Figure 15:
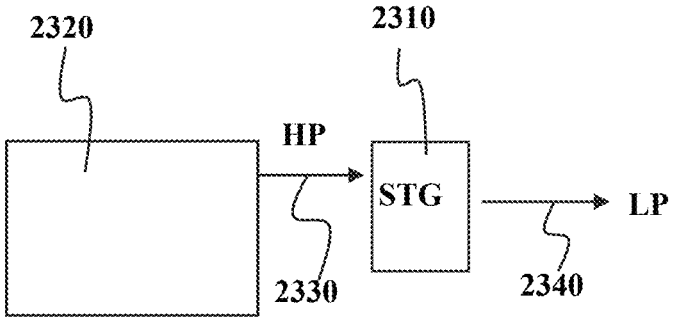
FIG. 15 illustrates a steam turbine cogeneration system according to at least one implementation described herein.

FIG. 15 showcases a steam turbine cogeneration system using an STG 2310 and generating high-pressure (HP) steam 2320 from a TES 2330, which is subsequently directed to the STG 2310. The output from this system includes low-pressure (LP) steam 2340.

Figure 16:
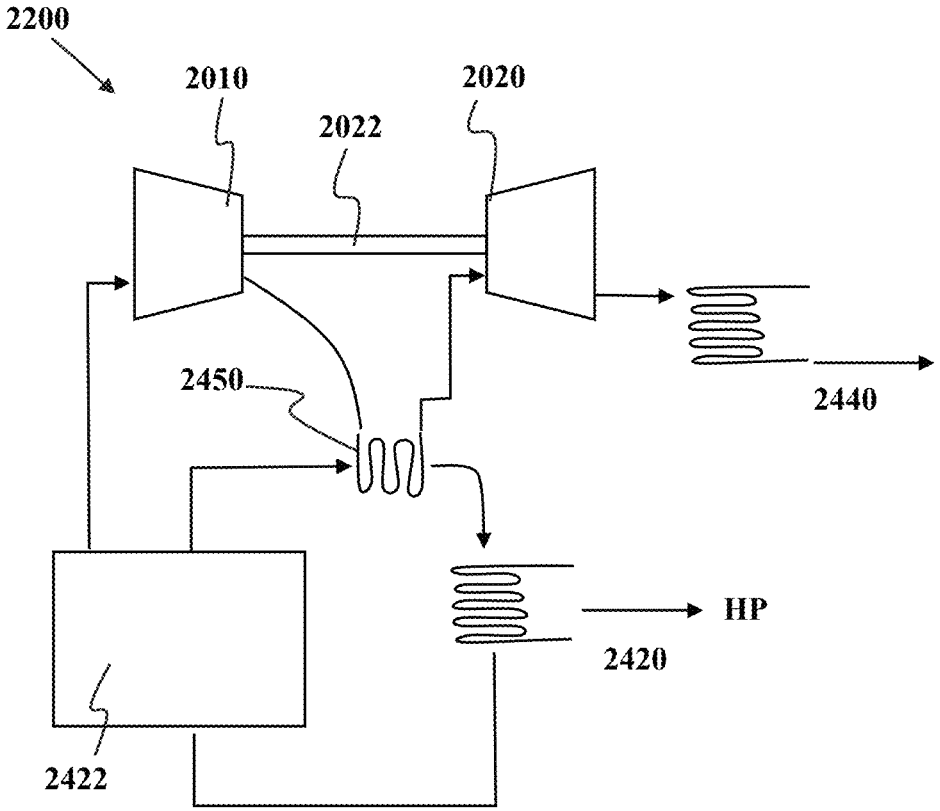
FIG. 16 illustrates a gas turbine cogeneration system according to at least one implementation described herein.

FIG. 16 illustrates a gas turbine cogeneration system that produces both high-pressure (HP) steam 2420 and electrical power with a TES 2422. This setup can achieve overall efficiency in the range of approximately 30% to 33%, translating to efficient conversion of thermal energy to electricity. The HP steam output 2420 can be adjusted to meet specific requirements, such as 100 bar plus steam.

FIG. 16 presents a parallel system where exhaust steam from a gas turbine (GT) exits at arrow 2440 for further use. The outputs 2420 and 2440 can be combined or remain separate, leading to moderately high temperature from the GT. By setting the temperature lower than that obtained through combustion, the GT's operational life is extended due to reduced stress on its blades. One particular example would be a low temperature HRSG that was e.g. making hot water or LP steam for an industrial process, a much lower threshold than making HP steam to drive a steam turbine.

Mini-Stove Configuration

Figure 17:
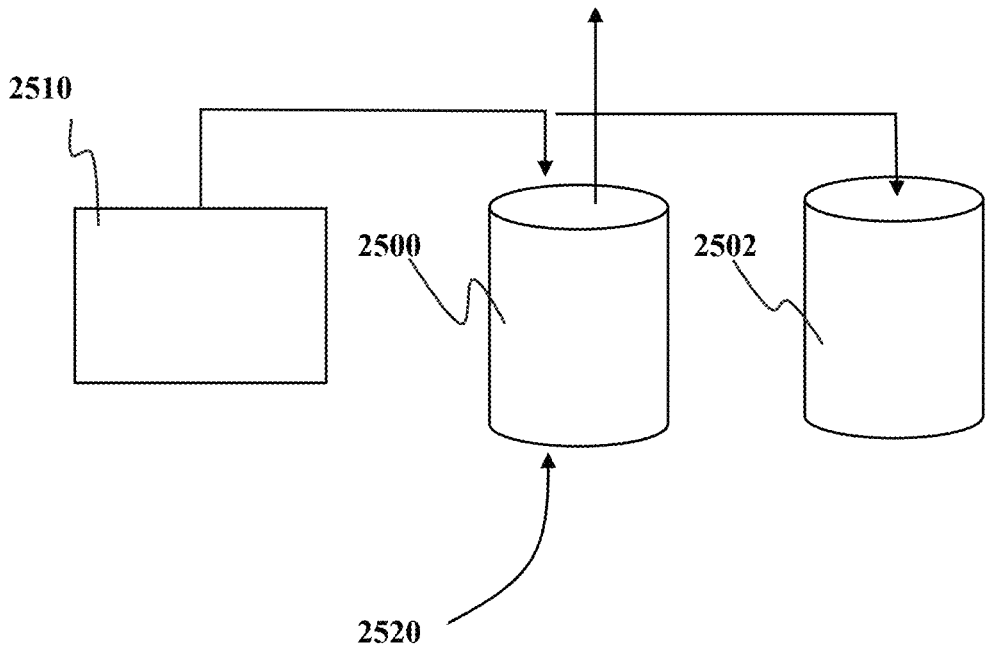
FIG. 17 illustrates a TES system with a pressured enclosure according to at least one implementation described herein.
Figure 24:
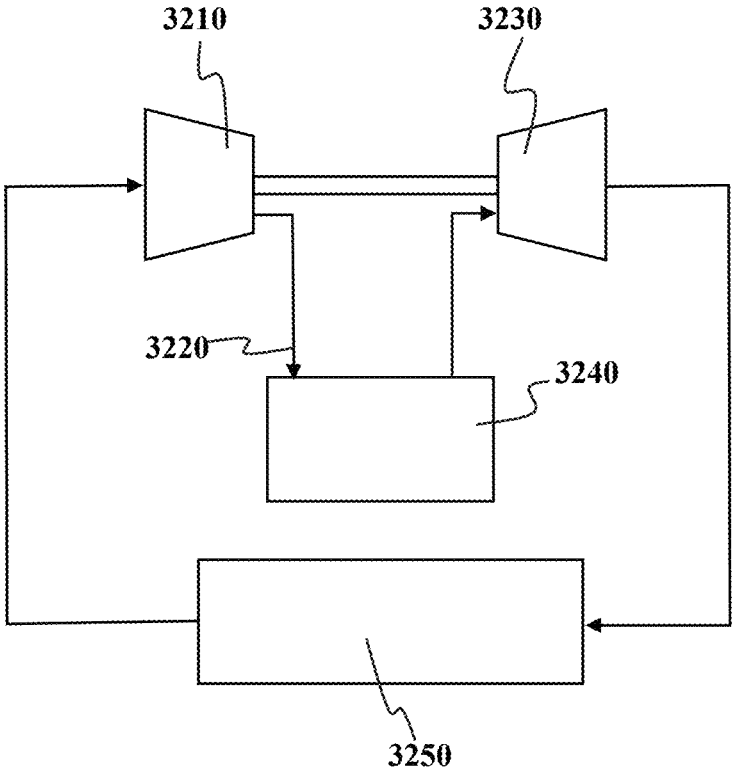
FIG. 24 illustrates a TES system configured for a sub-atmospheric brayton cycle (SABC) according to at least one implementation described herein.

FIG. 17 demonstrates an implementation using a pressurized enclosure 2500 such as a blast stove or mini blast stove for heat transfer of high-temperature, pressurized gas or fluid in place of the heat exchanger 2450 that was used the system of FIG. 24. A thermal energy storage device 2510 can provide heated input to the pressurized vessel 2500 and/or a second pressurized vessel 2502. The thermal energy storage device 2510 flows high-pressure gas 2520 into the pressurized vessels 2500 and/or 2502, such as blast stoves, in an alternating pattern, resulting in pressure cycling for these stoves, containers, vessels, or enclosures. These pressurized vessels can operate with one or more recuperators, and the recuperators can undergo frequent recharges to provide a heat exchange function.

Thermal Energy Storage Utilizing a Hub Configuration

Figure 18:
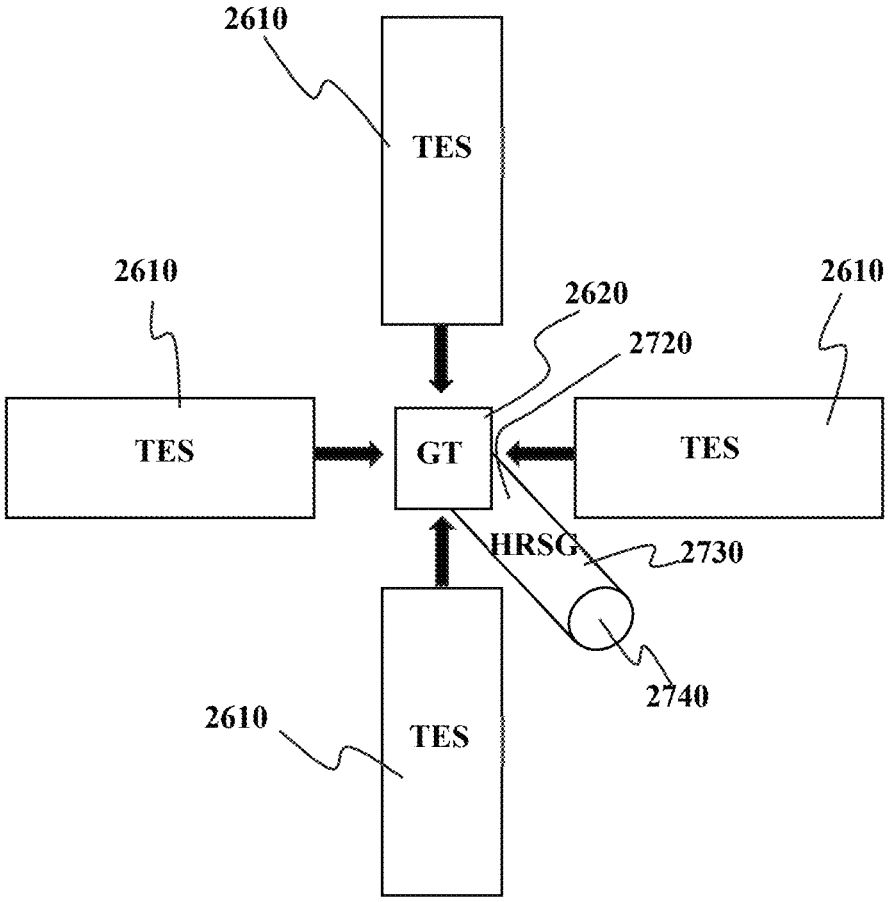
FIG. 18 illustrates a TES system with a central gas turbine according to at least one implementation described herein.

FIG. 18 shows a configuration for multiple thermal energy storage (TES) units 2610 connected to a central gas turbine (GT) 2620, or other industrial equipment, located at a hub-like position. This arrangement ensures that high-temperature gas output from various TES sources 2610 can be efficiently utilized, minimizing hardware costs and reducing the overall length of gas pathways leading to the common gas turbine 2620 or common industrial equipment. By having several TES units 2610 supply one centralized gas turbine 2620 or other industrial equipment, the hot gas or fluid can be conveniently harnessed without requiring long travel distances, long expensive ducts, thereby enabling a more efficient system with ample energy storage capacity that effectively supports the overall system.

Figure 19:
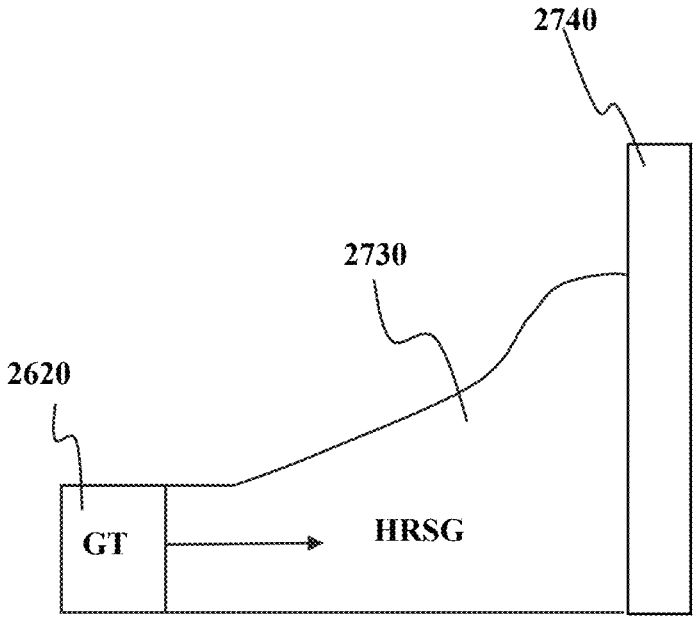
FIG. 19 illustrates a side view of a gas turbine coupled to an exhaust stack according to at least one implementation described herein.

FIG. 19 illustrates an example where a gas turbine 2620 is positioned at one end, while a small hot duct expands in size in the Heat Recovery Steam Generator (HRSG) portion 2730 leading to the exhaust stack 2740. This design facilitates the consolidation of high-temperature gas output from various TES sources 2610 into a centralized location and sharing common hardware, thereby optimizing energy utilization and costs within the system.

Figure 20:
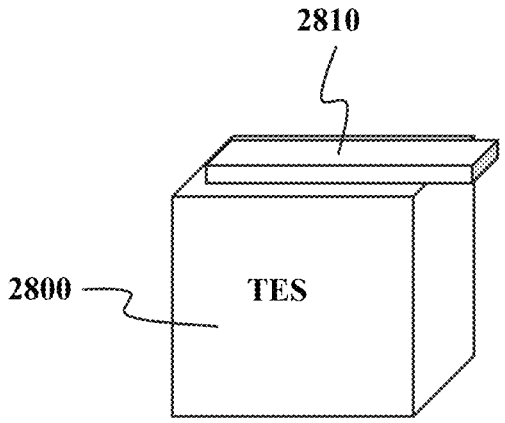
FIGS. 20 to 21 illustrate various configurations for a TES system according to implementations described herein.

FIG. 20 presents an implementation that includes a thermal storage medium 2800 with a longer, hot metal duct 2810 situated over the top of the thermal energy storage unit. As the thermal storage medium 2800 increases in size, the accompanying duct 2810 must also expand to adequately capture and channel the output from the TES medium effectively.

Figure 21:
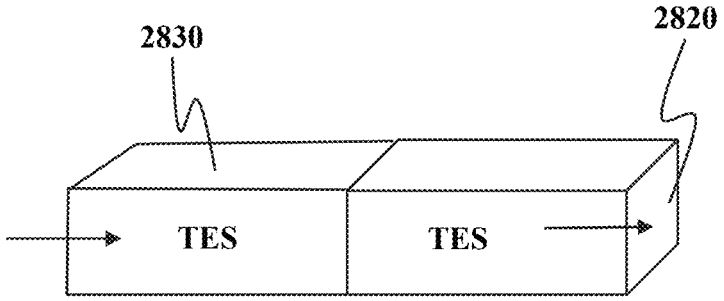

In another configuration shown in FIG. 21, the output is directed through an end 2820 of the thermal storage medium 2830. This arrangement enables increased storage capacity by simply making the array or storage medium 2830 longer without requiring a longer or larger duct at the end of the storage medium.

Figure 22:
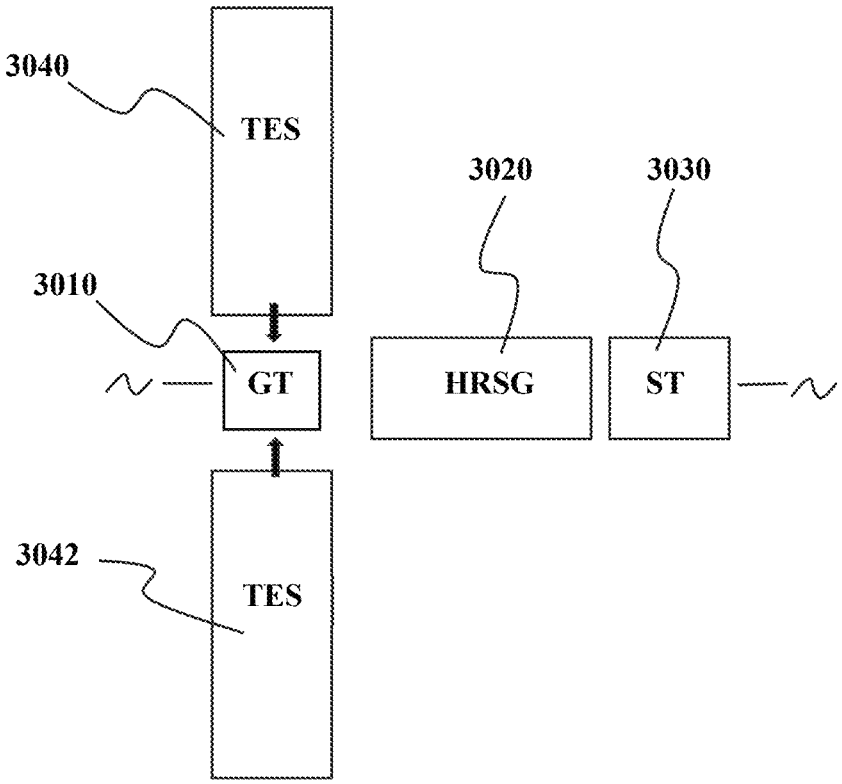
FIG. 22 illustrates a TES system with both a gas turbine and a steam turbine according to at least one implementation described herein.

FIG. 22 illustrates an implementation where the gas turbine (GT) 3010 is positioned alongside the HRSG 3020 and a steam turbine 3030 within a side space. This example layout provides ample room for retrofitting thermal energy storage units 3040 and 3042 into existing spaces, making it more convenient to incorporate the envisioned placement of these storage components into existing systems that may already have set locations for the HRSG and ST.

Figure 23:
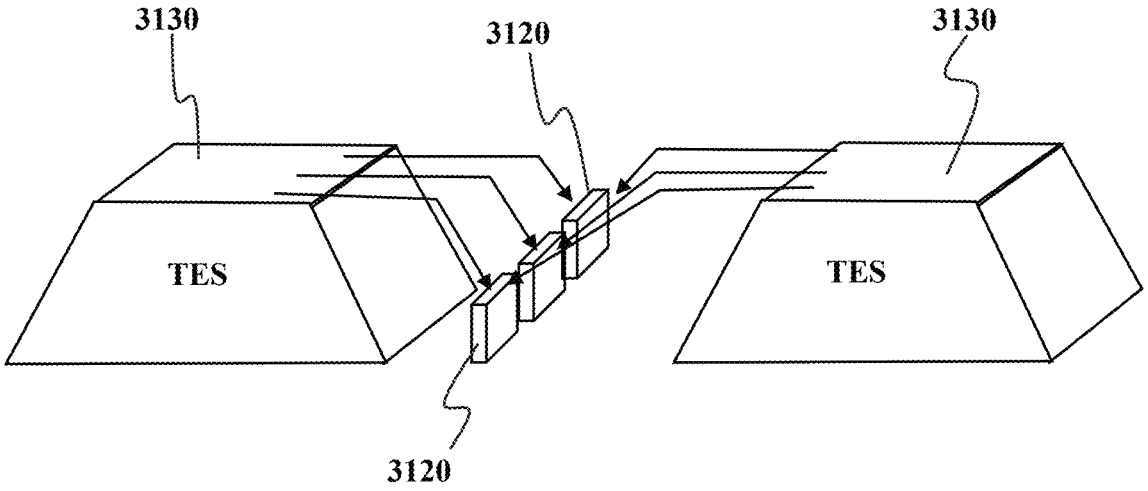
FIG. 23 illustrates a TES system with multiple boilers configured for use with a TES system according to at least one implementation described herein.

FIG. 23 presents an example layout for generating continuous steam from intermittent electrical power sources. Due to constraints in transporting large-scale items via public roads, this configuration employs multiple smaller heat exchangers such as but not limited boilers 3120 because no single boiler would be road-transportable and adequately sized to accommodate the thermal energy storage system. An alternative approach might involve implementing several Heat Recovery Steam Generators (HRSG) instead of using the boilers 3120, ensuring sufficient steam capacity to handle the thermal storage output feeding these HRSGs.

The gas turbine (GT) arrangement shown in FIG. 27 may include multiple HRSG with a transverse flow design, designed to accommodate the associated thermal storage medium 3130. In another configuration, a high-temperature heat exchanger could be incorporated, whose outlet temperature is set at an elevated level. Following this, a second heat exchange component may be employed using the lower temperature gas. The heat exchanger can manage either gas or fluid inputs within a pressure range of about 100 bar to about 10 bar. This system demonstrates an impressive thermal-to-electric efficiency, ranging from about 45% to about 50%, in addition to its ability to operate with various fuel sources within a combustion turbine setup or by drawing input from affordable electricity when the thermal energy storage unit is fully charged.

In another alternative approach, stoves could be designed without the inclusion of heat exchangers, particularly those engineered to withstand high pressures and temperatures. This alternative methodology might necessitate the development of stoves devoid of heat exchangers, especially those explicitly intended for frequent recharging.

Sub-Atmospheric Brayton Cycle

FIG. 24 shows a system layout designed for a Sub-Atmospheric Brayton Cycle (SABC). This design deviates considerably from conventional gas turbine operation, presenting numerous innovative elements. A regular Brayton Cycle may function by including a turbine that operates with pressure values before the compression stage 3210 at one bar, increasing to 10 bar after the compression stage 3220, and then decreasing back to one bar after the expansion stage 3230.

In contrast, an exemplary system configured for SABC may feature pressures before the compression stage 3210 and after the expansion stage 3230 are at sub-atmospheric levels. The pressure following the compression stage 3220 could be near ambient pressures in at least some implementations. In this design, the SABC system might include a thermal energy storage unit 3240 that operates under ambient pressure or near-ambient pressures such as one bar. The output from the expansion stage may then be directed to an HRSG 3250 or a condenser. Due to the lower pressures involved, the turbo machinery for both the compression and expansion stages in this system is likely to be larger than that used in a regular gas turbine. In addition, the tubing surface area within the HRSG may be increased to accommodate the reduced mass density across it. However, as previously mentioned, there is only one HRSG in this illustrative example with no accompanying pressure vessel.

In certain implementations, an optional high-temperature heat exchanger might be omitted from the system due to the inclusion of a single HRSG in which the process gas flows directly through. This system can be configured in a closed-loop arrangement which would then enable the use of an inert gas atmosphere, such as nitrogen, without any loss of that gas into the environment.

Some embodiments may also incorporate a heat rejection mechanism for the Brayton cycle operating at sub-atmospheric pressure levels. In certain examples, excess heat generated during the compression stage might be released through this system. Nevertheless, other implementations may operate as closed systems without a heat ejection mechanism. This design may allow for the use of alternative fuels or energy sources to drive the combustion turbine component of the system, providing increased flexibility and adaptability in terms of fuel supply options.

Optionally, some embodiments may employ multiple HRSGs instead of the singular unit depicted in FIG. 24. This design choice could be implemented to accommodate various thermal storage medium inputs or to optimize the system's performance based on specific operational requirements. In such configurations, the thermal storage output would be evenly distributed among several HRSGs, ensuring sufficient steam capacity for the desired application.

Furthermore, in some implementations, the gas turbine (GT) setup might include multiple Heat Recovery Steam Generators (HRSG) with a transverse flow design, tailored to handle the associated thermal storage medium 3230. A high-temperature heat exchanger could also be incorporated into this configuration, set to maintain an elevated outlet temperature. Following this, a second heat exchange component might be employed to manage cither gas or fluid inputs within a pressure range of 100 bar to 10 bar.

Overall, the system layout depicted in FIG. 29 presents elements and/or modifications to enhance performance, adaptability, and efficiency for various applications and operational requirements.

Summary of Claim Areas for Inventive Embodiments

Thermal Energy Storage System with an Emitting Surface

A thermal energy storage system including a thermal energy storage medium having a radiant energy emitting surface;

at least one structure opposite the emitting surface configured to receive the radiant energy from the emitting surface; and a fluid movement system for directing heated gas or fluid flow towards the radiant energy emitting surface for maintaining the emitting surface at a temperature within a desired range.

A thermal energy storage system including a thermal energy storage medium having a radiant energy emitting surface;

at least one structure opposite the emitting surface configured to receive the radiant energy from the emitting surface; and a heat extraction system configured for maintaining the emitting surface at a temperature within a desired range.

A thermal energy storage system including a thermal energy storage medium having a radiant energy emitting surface; and at least one structure opposite the emitting surface configured to receive the radiant energy from the emitting surface;

wherein the storage medium is configured to direct heat towards the radiant energy emitting surface for maintaining the emitting surface at a temperature within a desired temperature range.

The TES system may be configured to include one or more of the following:

The system further includes a heat exchanger configured to receive the gas or fluid after the gas or fluid has interacted with the radiant energy emitting surface for a second industrial use.

The system wherein the heat exchanger has a first stage for processing at a first temperature and a second stage for processing at a second, lower temperature.

The system wherein the radiant energy emitting surface is at a temperature between about 900° C. and 1500° C.

The system wherein the radiant energy emitting surface is at a temperature between about 1300° C. and 2000° C.

The system wherein the gas or fluid flowing over the heat exchanger is at a temperature between about 500° C. and 1100° C.

The system wherein the at least one structure includes a pipe or reaction vessel.

The system wherein the at least one structure includes thermal photovoltaic device.

The system may be configured to direct a bypass gas or fluid flow to mix with gas or fluid flow from the fluid movement system to create a combined flow for the second industrial use.

The system includes a heat recovery steam generator for the second industrial use.

The system further includes another thermal energy storage medium that also provides thermal energy to a common heat exchanger receiving thermal energy from multiple storage media.

Ore Pre-Processing

A method of processing ore including crushing, roasting, processing, and refining the ore, wherein the roasting uses gas or fluid heated to a first temperature and the processing or refining uses gas or fluid at a second, lower temperature, after the gas or fluid was used for the roasting step.

The method may be configured to include one or more of the following:

The method wherein the ore roasting includes directing heat from a thermal storage unit to the ore.

The method wherein the gas or fluid that was used for the roasting step is used for a cogeneration step to power the processing or refining of the ore.

The method wherein the cogeneration step includes using a steam generator using steam heated by the gas or fluid that was used for the roasting step.

A method of using a thermal energy storage system, the method including using a radiant energy transfer from the thermal energy storage system for a first processing step; and using a convective energy transfer from a gas or fluid heated by the thermal energy storage system for a second processing step.

The method may be configured to include one or more of the following:

The method wherein the first processing step is an ore roasting step.

The method wherein the second processing step is a refining step.

The method wherein the second processing step use a lower temperature heat to provide steam to a steam turbine to provide electricity to an electrolyzer.

The method further includes adding cooler gas or fluid to the gas or fluid from the first processing step to lower the temperature of the combined gas or fluid.

Pressurized Vessel

A pressurized thermal energy storage system including a pressure vessel; and a thermal energy storage medium housed within the pressure vessel.

The pressurized system may be configured to include one or more of the following:

The pressurized system wherein the pressure vessel is a blast stove.

The pressurized system wherein the pressure vessel is vertically oriented with a length longer in a vertical axis than a length in a horizontal axis.

The pressurized system wherein the pressure vessel is horizontally oriented with a length longer in a horizontal axis than a length in a vertical axis.

The pressurized system includes a pressurization fan.

The pressurized system includes an induced draft fan.

Rotary Kiln

A material processing system including a thermal energy storage medium;

a rotary kiln configured to receive thermal energy from the thermal energy storage medium; and a heat exchanger configured to receive gas or fluid from the rotary kiln;

wherein an entry temperature of the gas or fluid entering the rotary kiln is at least 1000° C. and an exit temperature of the gas or fluid from the rotary of at least 600° C.

The system may be configured to include one or more of the following:

The rotary kiln has a reduced length due to a higher exit temperature and because the material is processed with a higher initial temperature.

Gas Turbine Power Generation

An energy generating system including a gas turbine with a compression stage and an expansion stage;

a thermal energy storage unit; and a first heat exchanger;

wherein the thermal energy storage unit provides thermal energy to the gas turbine and also provides thermal energy to the first heat exchanger.

Thermal Storage in a Hub Configuration

An energy generating system including a gas turbine;

multiple thermal energy storage units in thermal communication with the gas turbine;

a steam generator; and an exhaust stack receiving excess heat from the steam generator;

wherein the gas turbine receives energy from the multiple thermal energy storage units, which provides thermal energy to the gas turbine which sends thermal energy to power the steam generator.

The system may be configured to include one or more of the following:

The system wherein the steam generator includes multiple boilers.

The system wherein the steam generator includes multiple heat exchangers.

Sub-Atmospheric Brayton Cycle

An energy generating method including inputting gas or fluid at a sub-atmospheric pressure to a compression stage of a gas turbine;

inputting the gas or fluid output at about an ambient pressure from the compression stage to a thermal energy storage unit;

inputting the gas or fluid output from the thermal energy storage unit to an expansion stage of the gas turbine; and inputting the gas or fluid output from the expansion stage of the gas turbine to a heat exchanger.

The method may be configured to include one or more of the following:

The method wherein the gas is an inert gas such as nitrogen.

The method further includes inputting the gas or fluid from the heat exchanger that is then routed back to an inlet of the compression stage of the gas turbine, forming a closed system.

Embodiment 1: An electrically heated thermal energy storage (TES) system including:

a TES medium having at least one radiant energy emitting surface;

a heater for providing thermal energy to the TES medium for storage;

at least one radiant energy receiving structure configured to receive radiant energy from the emitting surface; and a heat extraction system for directing a fluid through the TES medium and towards the emitting surface configured to reheat the emitting surface to a temperature within a set temperature range, wherein the TES system is configured to maintain the emitting surface is at a temperature between about 800° C. and about 1900° C. during operation by delivering heat via a combination of convection and radiation heat transfer from the storage medium to the emitting surface.

Embodiment 2. The system of claim 1, further including a heat exchanger configured to receive a flow of fluid that has contributed heat to the emitting surface.

Embodiment 3. The system of embodiment 2 wherein the heat exchanger has a first stage for processing at a first temperature and a second stage for processing at a second, lower temperature.

Embodiment 4. The system of embodiment 1 wherein the emitting surface is at a temperature between about 900° C. and about 1500° C. during operation of the TES system.

Embodiment 5. The system of embodiment 1 wherein the emitting surface is at a temperature between about 1300° C. and about 2000° C. during operation of the TES system.

Embodiment 6. The system of embodiment 2 wherein the fluid flowing to the heat exchanger is at a temperature between about 500° C. and about 1100° C. during operation of the TES system.

Embodiment 7. The system of embodiment 1 wherein the at least one radiant energy receiving structure includes one or more pipes.

Embodiment 8. The system of embodiment 1 wherein the at least one radiant energy receiving structure includes one or more reaction vessels.

Embodiment 9. The system of embodiment 1 wherein the at least one radiant energy receiving structure includes thermal photovoltaic device.

Embodiment 10. The system of embodiment 1 wherein the heat extraction system includes a blower for directing a flow of fluid through the TES medium to maintain the emitting surface at the temperature in the set temperature range.

Embodiment 11. The system of embodiment 1 includes a heat recovery steam generator configured to receive a flow of fluid that has interacted with the receiving surface.

Embodiment 12. The system of embodiment 2 further configured to include a bypass fluid flow to mix with fluid flow from the heat extraction system to create a combined flow to the heat exchanger.

Embodiment 13. The system of embodiment 1 further including another TES medium that is configured to provide thermal energy to a common heat exchanger receiving thermal energy from the TES medium and said another TES medium.

Embodiment 14. The system of embodiment 1 further including an assemblage of TES blocks formed from the TES medium.

Embodiment 15. The system of embodiment 1 where the TES medium includes a refractory material.

Embodiment 16. The system of embodiment 1 further including at least one heating element configured for heating the TES medium.

Embodiment 17. The system of embodiment 16 wherein the heating element includes an electrical heating element.

Embodiment 18. The system of embodiment 16 wherein the heating element is positioned within an assemblage of TES blocks formed from the TES medium.

Embodiment 19. The system of embodiment 1 further including a pressure vessel configured to enclose the TES medium therein.

Embodiment 20. The system of embodiment 10 wherein the blower directs the flow through the TES medium along a vertical axis through the TES medium.

Embodiment 21. The system of embodiment 10 wherein the blower directs the flow through the TES medium along a horizontal axis through the TES medium.

Embodiment 22. The system of embodiment 1 wherein the radiant energy receiving structure is positioned opposite the emitting surface.

Embodiment 23. A method of using a thermal energy storage (TES) system including:

heating a TES medium in the TES system;

using radiant energy transfer from a radiant energy emitting surface of a TES medium to a radiant energy receiving structure positioned opposite the emitting surface for a first processing step;

extracting heat from TES medium to maintain the emitting surface at a temperature within a set temperature range between about 800° C. and about 2000° C. during operation of the TES system; and using a convective energy transfer from a fluid heated by the TES medium for a second processing step.

Embodiment 24. The method of embodiment 23 wherein the first processing step is an ore roasting step.

Embodiment 25. The method of embodiment 23 wherein the second processing step is a refining step.

Embodiment 26. The method of embodiment 23 wherein the second processing step use a lower temperature heat to provide steam to a steam turbine.

Embodiment 27. The method of embodiment 23 further including adding a second fluid to the fluid from the first processing step to lower the temperature of the combined fluid.

Embodiment 28. The method of embodiment 23 wherein the emitting surface is at a temperature between about 900° C. and about 1500° C. during operation of the TES system.

Embodiment 29. The method of embodiment 23 wherein the emitting surface is at a temperature between about 1300° C. and about 2000° C. during operation of the TES system.

Embodiment 30. The method of embodiment 23 wherein extracting the heat to maintain the temperature of the emitting surface includes using a blower to direct fluid through the TES medium.

Embodiment 31. The method of embodiment 23 wherein the TES medium includes a solid medium Embodiment 32. The method of embodiment 23 wherein the TES medium includes a refractory material.

Embodiment 33. The method of embodiment 23 wherein heating the TES medium including using energy from an intermittent energy source.

Embodiment 34. The method of embodiment 33 wherein the intermittent energy source is selected from one of the following: solar, wind, or wave energy source.

Embodiment 35. The method of embodiment 22 wherein heating the TES medium including using energy from a geothermal energy source.

Embodiment 36. An energy generating system including a turbine;

multiple thermal energy storage (TES) units in thermal communication with the turbine;

a steam generator; and an exhaust stack receiving excess heat from the steam generator;

wherein the turbine is configured to receive thermal energy from the multiple thermal energy storage units, which provides thermal energy to the turbine which sends energy to power the steam generator.

Embodiment 37. The system of embodiment 35 wherein the steam generator includes multiple boilers.

Embodiment 38. The system of embodiment 35 The system wherein the steam generator includes multiple heat exchangers.

Embodiment 39. The system of embodiment 35 wherein the turbine and TES units are arranged in a hub-and-spoke configuration, wherein the turbine is the hub.

Embodiment 40. The system of embodiment 35 wherein the turbine is a gas turbine.

Embodiment 41. An energy generating method including inputting fluid at a pressure below ambient pressure to a compression stage of a gas turbine;

inputting the fluid output at about ambient pressure from the compression stage to a thermal energy storage (TES) unit;

inputting the fluid output from the (TES) unit to an expansion stage of the gas turbine; and inputting the gas or fluid output from the expansion stage of the gas turbine to a heat exchanger.

Embodiment 42. The method of embodiment 40 wherein the gas is an inert gas such as nitrogen.

Embodiment 43. The method of embodiment 40 further including inputting the gas or fluid from the heat exchanger that is then routed back to an inlet of the compression stage of the gas turbine, forming a closed system.

Embodiment 44. The method of embodiment 40 wherein the pressure below ambient pressure is at a pressure less than about 1 bar.

Embodiment 45. A system including:

a thermal energy storage (TES) unit including a TES medium for storing thermal energy;

a gas turbine;

a first heat exchanger;

a second heat exchanger;

a third heat exchanger; and a steam turbine;

wherein the first heat exchanger is configured to receive heat from the TES unit to heat a flow from one stage of the gas turbine to form a heated flow that is directed to another stage of the gas turbine;

wherein the second heat exchanger is configured to receive output from the first heat exchanger to heat a second flow to form a heated second flow that is directed to the steam turbine;

wherein the third heat exchanger is configured to receive output from said another stage of the gas turbine to heat a third flow to form a heated third flow that is directed to the steam turbine.

Embodiment 46. The system of embodiment 44 wherein the flow is a pressurized flow at a pressure above about 1 bar.

Embodiment 47. The system of embodiment 44 wherein the first heat exchanger is configured to withstand pressures above about 1 bar.

Embodiment 48. The system of embodiment 44 wherein the first heat exchanger includes a ceramic material.

Embodiment 49. The system of embodiment 44 wherein the first heat exchanger includes a metallic material.

Embodiment 50. The system of embodiment 44 wherein the TES unit is configured to receive output from the second heat exchanger.

The claimable subject matter includes any of the systems or methods in the exemplary claims. Optionally, a method is provided comprising at least one technical feature from any of the prior features. Optionally, the method comprises at least any two technical features from any of the prior features. Optionally, a device is provided comprising at least one technical feature from any of the prior features. Optionally, the device comprises at least any two technical features from any of the prior features. Optionally, the system is provided comprising at least one technical feature from any of the prior features. Optionally, the system comprises at least any two technical features from any of the prior features.

Terminology

To the extent a term used in a claim is not defined below, it should be given the broadest definition persons in the pertinent art have given that term as reflected in printed publications and issued patents at the time of filing. For example, the following terminology may be used interchangeably, as would be understood to those skilled in the art:

A Amperes
AC Alternating current
DC Direct current
DFB Dual Fluidized Bed
EAR Enhanced Oil Recovery
EV Electric vehicle
GT Gas turbine
HRSG Heat recovery steam generator
kV kilovolt
kW kilowatt
MED Multi-effect desalination
MPPT Maximum power point tracking
MSF Multi-stage flash
MW megawatt
OTSG Once-through steam generator
PEM Proton-exchange membrane
PV Photovoltaic
RSOC Reversible solid oxide cell
SOEC Solid oxide electrolyzer cell
SOFC Solid oxide fuel cell
ST Steam turbine
TES Thermal Energy Storage
TSU Thermal Storage Unit Additionally, the term "heater" is used to refer to a conductive element that generates heat. For example, the term "heater" as used in the present example implementations may include, but is not limited to, a wire, a ribbon, a tape, or other structure that can conduct electricity in a manner that generates heat. The composition of the heater may be metallic (coated or uncoated), ceramic or other composition that can generate heat.

Further, the term furnace and reactor can be used interchangeably in the above work meant to signify the reactor of a material processing system which, for example in the case of DRI production, may be referred to as a furnace from art approaches.

For any of the TES system described herein, the system can be used with an inert gas or fluid passing therethrough. The TES system may also use graphite heaters if used with an inert gas environment. Optionally, some embodiments may also use graphite or similar material as the thermal storage medium.

For any of the TES system described herein, some implementations may use an active blower to move gas or fluid through the TES system. Optionally, some may be passive and use the thermocline to move gas or fluid through the TES system. Optionally, some implementation may bring the gas or fluid to the TES system and then heat the gas or fluid with the thermal storage medium. This heating can be direct exposure of the gas or fluid to the thermal storage medium or it may involve heating structures such as pipes or tubes carrying the gas or fluid. In some systems, a gate, valve, louver, door, or other system can control the exposure of the gas or fluid to the thermal storage medium to control the heat transfer.

Similarly, the terms describing fluid compressions devices (such as, but not limited to, blowers, compressors, fans and pumps) can be used interchangeably.

The terms air, fluid and gas are used interchangeably herein to refer to a fluid heat transfer medium of any suitable type, including various types of gases (air, $CO_2$, oxygen and other gases, alone or in combination), and when one is mentioned, it should be understood that the others can equally well be used. Thus, for example, "air" can be any suitable fluid or gas or combinations of fluids or gases.

While foregoing example implementations may refer to "air", the inventive concept is not limited to this composition, and other fluid streams may be substituted therefor for additional industrial applications, such as but not limited to, enhanced oil recovery, sterilization related to healthcare or food and beverages, drying, chemical production, desalination and hydrothermal processing (e.g. Bayer process.) The Bayer process includes a calcination step. The composition of fluid streams may be selected to improve product yields or efficiency, or to control the exhaust stream.

In any of the thermal storage units, the working fluid composition may be changed at times for a number of purposes, including maintenance or re-conditioning of materials. Multiple units may be used in synergy to improve charging or discharging characteristics, sizing or case of installation, integration or maintenance. As would be understood by those skilled in the art, the thermal storage units disclosed herein may be substituted with other thermal storage units having the desired properties and functions; results may vary, depending on the manner and scale of combination of the thermal storage units.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided with respect to certain example implementations herein is intended merely to better illuminate the example implementation and does not pose a limitation on the scope of the example implementation otherwise claimed. No language in the specification should be construed as indicating any non-claimed element essential to the practice of the example implementation.

Groupings of alternative elements or example implementations of the example implementation disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all groups used in the appended claims.

In the specification, reference may be made to the spatial relationships between various components and to the spatial orientation of various aspects of components as the devices are depicted in the attached drawings. However, as will be recognized by those skilled in the art after a complete reading of the present application, the devices, members, devices, etc. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

As used herein the term "substantially" is used to indicate that exact values are not necessarily attainable. By way of example, one of ordinary skill in the art will understand that in some chemical reactions 100% conversion of a reactant is possible, yet unlikely. Most of a reactant may be converted to a product and conversion of the reactant may asymptotically approach 100% conversion. In some embodiments of the present disclosure, the term "substantially" is defined as approaching a specific numeric value or target to within 20%, 15%, 10%, 5%, or within 1% of the value or target. In further embodiments of the present disclosure, the term "substantially" is defined as approaching a specific numeric value or target to within 1%, 0.9%, 0.8%, 0.7%, 0.6%, 0.5%, 0.4%, 0.3%, 0.2%, or 0.1% of the value or target.

As used herein, the term "about" is used to indicate that exact values are not necessarily attainable. Therefore, the term "about" is used to indicate this uncertainty limit. In some embodiments of the present disclosure, the term "about" is used to indicate an uncertainty limit of less than or equal to ±20%, ±15%, ±10%, ±5%, or ±1% of a specific numeric value or target. In some embodiments of the present disclosure, the term "about" is used to indicate an uncertainty limit of less than or equal to ±1%, ±0.9%, ±0.8%, ±0.7%, ±0.6%, ±0.5%, ±0.4%, ±0.3%, ±0.2%, or ±0.1% of a specific numeric value or target.

While the foregoing describes various example implementations of the example implementation, other and further example implementations of the example implementation may be devised without departing from the basic scope thereof. The scope of the example implementation is determined by the claims that follow. The example implementation is not limited to the described example implementations, versions or examples, which are included to enable a person having ordinary skill in the art to make and use the example implementation when combined with information and knowledge available to the person having ordinary skill in the art.

What is claimed is:

1. An electrically heated thermal energy storage (TES) system including:

a TES medium having at least one radiant energy emitting surface;

a heater for providing thermal energy to the TES medium for storage;

at least one radiant energy receiving structure configured to receive radiant energy from the emitting surface; and a heat extraction system for directing a fluid through the TES medium and towards the emitting surface configured to reheat the emitting surface to a temperature within a set temperature range, wherein the TES system is configured to maintain the emitting surface in predetermined temperature range during operation by delivering heat via a combination of convection and radiation heat transfer from the TES medium to the emitting surface, and a heat exchanger configured to receive a flow of fluid that has contributed heat to the emitting surface.

2. The system of claim 1 wherein the heat exchanger has a first stage configured to process the fluid flow at a first temperature and a second stage configured to process the fluid flow at a second, lower temperature.

3. The system of claim 1 wherein the at least one radiant energy receiving structure includes one or more pipes.

4. The system of claim 1 wherein the at least one radiant energy receiving structure includes one or more reaction vessels.

5. An electrically heated thermal energy storage (TES) system including:

a TES medium having at least one radiant energy emitting surface;

a heater for providing thermal energy to the TES medium for storage;

at least one radiant energy receiving structure configured to receive radiant energy from the emitting surface; and a heat extraction system for directing a fluid through the TES medium and towards the emitting surface configured to reheat the emitting surface to a temperature within a set temperature range, wherein the TES system is configured to maintain the emitting surface is in a predetermined temperature range during operation by delivering heat via a combination of convection and radiation heat transfer from the TESstorage medium to the emitting surface, and a heat exchanger configured to receive a flow of fluid that has contributed heat to the emitting surface;

wherein the at least one radiant energy receiving structure includes a thermal photovoltaic device.

6. The system of claim 1 wherein the heat extraction system includes a blower configured to direct a flow of fluid through the TES medium to maintain the emitting surface at the temperature in the predetermined temperature range.

7. The system of claim 6 wherein the blower is configured to direct the flow through the TES medium along a vertical axis through the TES medium.

8. The system of claim 6 wherein the blower is configured to direct the flow through the TES medium along a horizontal axis through the TES medium.

9. The system of claim 1 includes a heat recovery steam generator configured to receive a flow of fluid that has interacted with the radiant energy receiving structure.

10. The system of claim 1 further including an inlet configured to introduce a bypass fluid flow to mix with fluid flow from the heat extraction system to create a combined flow to the heat exchanger.

11. The system of claim 1 further including another TES medium that is configured to provide thermal energy to a common heat exchanger configured to receive thermal energy from the TES medium and said another TES medium.

12. The system of claim 1 further including an assemblage of TES blocks formed from the TES medium.

13. The system of claim 1 where the TES medium includes a refractory material.

14. The system of claim 1 wherein the heater includes an electrical heating element.

15. The system of claim 1 wherein the heater is positioned within an assemblage of TES blocks formed from the TES medium.

16. The system of claim 1 further including a pressure vessel configured to enclose the TES medium therein.

17. The system of claim 1 wherein the radiant energy receiving structure is positioned opposite the emitting surface.

18. The system of claim 1 wherein the predetermined temperature range is between about 800° C. and about 1900° C.

19. A method for an electrically heated thermal energy storage (TES) system including:

providing a TES medium having at least one radiant energy emitting surface;

using a heater to deliver thermal energy to the TES medium for storage;

using at least one radiant energy receiving structure to receive the radiant energy from the emitting surface;

using a heat extraction system to direct a fluid through the TES medium and towards the emitting surface configured to reheat the emitting surface to a temperature within a set temperature range;

maintaining the emitting surface of the TES medium in a predetermined temperature range during operation by delivering heat via a combination of convection and radiation heat transfer through the TES medium to the emitting surface, and using a heat exchanger to receive a flow of fluid that has contributed heat to the emitting surface.

20. The method of claim 19 wherein the heat exchanger has a first stage for processing the flow at a first temperature and a second stage for processing the flow at a second, lower temperature.

21. The method of claim 19 further including using a blower in the heat extraction system to direct a flow of fluid through the TES medium to maintain the emitting surface at the temperature in the set temperature range.

22. The method of claim 21 wherein the blower is used to direct the flow through the TES medium along a vertical axis through the TES medium.

23. The method of claim 21 wherein the blower is used to direct the flow through the TES medium along a horizontal axis through the TES medium.

24. The method of claim 19 further including using a heat recovery steam generator to receive a flow of fluid that has interacted with the radiant energy receiving structure.

25. The method of claim 19 further including mixing a bypass fluid flow with the fluid flow to create a combined flow to the heat exchanger.

26. The method of claim 19 wherein using the heater includes using an electrical heating element.

27. The method of claim 19 further including positioning the heater within an assemblage of TES blocks formed from the TES medium.

28. The method of claim 19 further including using a pressure vessel to enclose the TES medium therein.

29. The method of claim 19 further including postioning the radiant energy receiving structure opposite the emitting surface.

* * * * *